US011151942B2

(12) United States Patent
Miyasaka et al.

(10) Patent No.: US 11,151,942 B2
(45) **Date of Patent: *Oct. 19, 2021**

(54) ELECTRO-OPTICAL DEVICE AND ELECTRONIC APPARATUS

(71) Applicant: SEIKO EPSON CORPORATION, Tokyo (JP)

(72) Inventors: Mitsutoshi Miyasaka, Suwa (JP); Yoichi Momose, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/922,092

(22) Filed: Jul. 7, 2020

(65) Prior Publication Data

US 2020/0335041 A1 Oct. 22, 2020

Related U.S. Application Data

(63) Continuation of application No. 16/194,695, filed on Nov. 19, 2018, now Pat. No. 10,755,641.

(30) Foreign Application Priority Data

Nov. 20, 2017 (JP) ..... JP2017-222481
Sep. 28, 2018 (JP) ..... JP2018-183517

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/2022* (2013.01); *G09G 3/3233* (2013.01);
(Continued)

(58) Field of Classification Search
CPC .. G09G 3/3258; G09G 3/2022; G09G 3/3233; G09G 3/3291; G09G 3/3266; G09G 2300/0857
See application file for complete search history.

(56) References Cited

U.S. PATENT DOCUMENTS

2002/0070913 A1 6/2002 Kimura et al.
2002/0093472 A1 7/2002 Numao
(Continued)

FOREIGN PATENT DOCUMENTS

EP 1 098 290 A2 5/2001
JP 2001-222256 A 8/2001
(Continued)

OTHER PUBLICATIONS

Nov. 14, 2019 Office Action Issued in U.S. Appl. No. 16/194,695.
Apr. 9, 2020 Notice of Allowance Issued in U.S. Appl. No. 16/194,695.

*Primary Examiner* — Carolyn R Edwards
(74) *Attorney, Agent, or Firm* — Oliff PLC

(57) ABSTRACT

An electro-optical device includes scan line, data line, pixel circuit located at a position corresponding to an intersection of the scan line and the data line, a first high potential line supplies a first potential, a low potential line supplies a second potential, and a second high potential line supplies a third potential. The pixel circuit includes a light emitting element, a memory circuit disposed between the first high potential line and the low potential line, a first transistor including a gate electrically connected to the memory circuit, and a second transistor including a gate electrically connected to the scan line. The second transistor is disposed between the memory circuit and f the data line. A potential difference between the first potential and the second poten-
(Continued)

tial is smaller than a potential difference between the third potential and the second potential.

20 Claims, 18 Drawing Sheets

(51) Int. Cl.
*G09G 3/3291* (2016.01)
*G09G 3/3266* (2016.01)
*G09G 3/20* (2006.01)

(52) U.S. Cl.
CPC ..... *G09G 3/3266* (2013.01); *G09G 3/3291* (2013.01); *G09G 2300/0857* (2013.01)

(56) References Cited

U.S. PATENT DOCUMENTS

2002/0140642 A1 10/2002 Okamoto
2004/0047530 A1 3/2004 Hara et al.
2004/0196239 A1* 10/2004 Kwon ..... G09G 3/325 345/92
2008/0074412 A1 3/2008 Nozawa
2008/0238855 A1* 10/2008 Teranishi ..... G09G 3/2011 345/98
2009/0244110 A1 10/2009 Ogura
2011/0273429 A1* 11/2011 Choi ..... G09G 3/3225 345/212
2012/0019436 A1* 1/2012 Yamashita ..... G09G 3/3225 345/76
2014/0117862 A1* 5/2014 Qing ..... G09G 3/3225 315/172
2016/0148988 A1 5/2016 Cho et al.
2016/0372054 A1* 12/2016 Yamazaki ..... G09G 3/344
2017/0294171 A1 10/2017 Shima
2019/0005883 A1* 1/2019 Kim ..... G09G 3/3233
2019/0088223 A1* 3/2019 Wang ..... G09G 3/3648
2019/0096325 A1* 3/2019 Miyasaka ..... G09G 3/3275

FOREIGN PATENT DOCUMENTS

JP 2002-287695 A 10/2002
JP 2002-287718 A 10/2002
JP 2004-62161 A 2/2004
JP 2004-62163 A 2/2004
JP 2004-62199 A 2/2004
JP 2004-163601 A 6/2004
JP 2008-014995 A 1/2008
JP 2008-216353 A 9/2008
JP 2009-244411 A 10/2009
JP 2017-507367 A 3/2017
JP 2017-187713 A 10/2017
JP 2019-061084 A 4/2019

* cited by examiner

ELECTRO-OPTICAL DEVICE AND ELECTRONIC APPARATUS

CROSS REFERENCE TO RELATED APPLICATION

This application is a continuation of U.S. patent application Ser. No. 16/194,695, filed Nov. 19, 2018, the contents of which are incorporated herein by reference.

BACKGROUND

1. Technical Field

The invention relates to an electro-optical device and an electronic apparatus.

2. Related Art

In recent years, head-mounted displays (HMDs) have been proposed that are a type of electronic apparatus that enables formation and viewing of a virtual image by directing image light from an electro-optical device to the pupil of an observer. One example of the electro-optic device used in these electronic apparatuses is an organic electro-luminescence (EL) device that includes an organic EL element as a light-emitting element. The organic EL devices used in head-mounted displays are required to provide high resolution, fine pixels, multi-grey-scale of display, and low power consumption.

In known organic EL devices, when a select transistor is brought into an ON-state by a scan signal supplied to a scan line, a potential based on an image signal supplied over a data line is maintained in a capacitor connected to the gate of a drive transistor. When the drive transistor is brought into the ON-state according to the potential maintained in the capacitor, namely, the gate potential of the drive transistor, a current according to the gate potential of the drive transistor flows to the organic EL element, and the organic EL element emits light at intensity according to the current amount.

In this way, the grey-scale display is performed by analog driving that controls the current flowing through the organic EL element according to the gate potential of the drive transistor in a typical organic EL device. Thus, variations in voltage-current characteristics and threshold voltages of drive transistors cause variations in luminance and unevenness in grey-scale between pixels. As a result, display quality may decrease. In contrast, an organic EL device including a compensating circuit that compensates for variations in voltage-current characteristics and threshold voltages of drive transistors has been proposed (for example, see JP-A-2004-062199).

However, when a compensating circuit is provided as described in JP-A-2004-062199, a current also flows through the compensating circuit, which may cause an increase in power consumption. For typical analog driving, a capacitance of a capacitor that stores an image signal needs to be increased in order to achieve more grey-scales of display. Thus, it is difficult to achieve a higher resolution, i.e., finer pixels, at the same time, and power consumption also increases due to charge and discharge of the capacitor. In other words, in the typical technology, an electro-optical device capable of displaying a high-resolution, multi-grey-scale, and high-quality image at low power consumption may be difficult to achieve.

SUMMARY

The invention is made to address at least some of the above-described issues, and can be implemented as the following aspects or application examples.

Application Example 1

An electro-optical device according to the present application example includes scan lines, data lines, a pixel circuit located at a position corresponding to an intersection of the scan line and the data line, a first potential line supplying a first potential, a second potential line supplying a second potential, and a third potential line supplying a third potential. The pixel circuit includes a light emitting element, a memory circuit disposed between the first potential line and the second potential line, a first transistor of which a gate is electrically connected to the memory circuit, and a second transistor of which a gate is electrically connected to each of the scan line. The second transistor is disposed between the memory circuit and the data line. The light emitting element and the first transistor are disposed in series between the second potential line and the third potential line. And, $A<B$, A is an absolute value of a potential difference between the first potential and the second potential, and B is an absolute value of a potential difference between the second potential and the third potential.

According to the configuration of the present application example, the pixel circuit includes the memory circuit disposed between the first potential line and the second potential line, the second transistor providing the gate electrically connected to the scan line is disposed between the memory circuit and the data line, and the light emitting element and the first transistor providing the gate electrically connected to the memory circuit are disposed in series between the second potential line and the third potential line. Thus, grey-scale display can be performed by writing a digital signal expressed by binary values of ON and OFF to the memory circuit through the second transistor and controlling a proportion of light emission to non-light emission of the light emitting element through the first transistor. In this way, variations in voltage-current characteristics and a threshold voltage of each transistor have a smaller influence, and variations in luminance and unevenness in grey-scale between pixels can be reduced without a compensating circuit. In the digital driving, the number of grey-scale can be easily increased without a capacitor by increasing the number of subfields that serve as units for controlling emission and non-emission of the light emitting element in a field displaying a single image. Further, a capacitor having a greater capacitance does not need to be possessed, and thus finer pixels can be achieved. In this way, finer pixels and a higher resolution can be achieved and power consumption due to charge and discharge of the capacitor can also be reduced.

Further, an absolute value of a potential difference between the first potential and the second potential supplied to the memory circuit is smaller than an absolute value of a potential difference between the third potential and the second potential supplied to the light emitting element and the first transistor. In other words, a low-voltage power-supply based on the first potential and the second potential is used to operate the memory circuit. A high-voltage power-supply based on the second potential and the third potential is used to allow the light emitting element to emit light. Therefore, the memory circuit can be made finer, and can be operated at a higher speed. Light emitting intensity of the light emitting element can be increased as well. Therefore, an image signal can be written and rewritten promptly. Brighter display can be achieved as well. As a result, the electro-optical device capable of displaying a brighter, high-resolution, multi-grey-scale, and high-quality image at low power consumption can be achieved.

Application Example 2

Preferably, in the electro-optical device according to the present application example, the memory circuit may include a third transistor, and a gate length of the third transistor may be shorter than a gate length of the first transistor.

According to the configuration of the present application example, the gate length of the third transistor included in the memory circuit is shorter than the gate length of the first transistor disposed in series with the light emitting element. Therefore, the third transistor can be smaller than the first transistor, making the memory circuit finer. Therefore, the memory circuit can be operated at a higher speed. The light emitting element is allowed to emit light at a higher voltage as well.

Application Example 3

Preferably, in the electro-optical device according to the present application example, an area of a channel forming region of the third transistor may be smaller than an area of a channel forming region of the first transistor.

According to the configuration of the present application example, a transistor capacity of the third transistor included in the memory circuit is smaller than a transistor capacity of the first transistor. An image signal can thus be promptly written and rewritten into the memory circuit.

Application Example 4

Preferably, in the electro-optical device according to the present application example, a source of the first transistor may be electrically connected to the second potential line, and the light emitting element may be disposed between a drain of the first transistor and the third potential line.

According to the configuration of the present application example, a source potential of the first transistor is fixed to the second potential. Even when the first transistor is brought into an ON-state, and an absolute value of a source-drain voltage of the first transistor is smaller, electric conductivity of the first transistor can be increased. In other words, when the first transistor is brought into the ON-state, and the light emitting element emits light, the first transistor can be operated almost linearly. Hereinafter, operating a transistor almost linearly is referred to as "simply operating linearly". In this way, most of a potential difference between the second potential and the third potential both configuring the high-voltage power-supply is applied to the light emitting element. Thus, when the light emitting element emits light, variations in a threshold voltage of the first transistor have a smaller influence. As a result, uniformity in luminance among pixels can be improved.

Application Example 5

Preferably, in the electro-optical device according to the present application example, an ON-resistance of the first transistor may be lower than an ON-resistance of the light emitting element.

According to the configuration of the present application example, when the light emitting element emits light while the first transistor is brought into the ON-state, the first transistor can be linearly operated. As a result, most of a potential drop occurring in the light emitting element and the first transistor is applied to the light emitting element. Thus, when the light emitting element emits light, variations in a threshold voltage of the first transistor have a smaller influence. In this way, variations in luminance and unevenness in grey-scale between pixels can be reduced.

Application Example 6

Preferably, in the electro-optical device according to the present application example, a polarity of the first transistor and a polarity of the second transistor may be identical to each other.

According to the configuration of the present application example, for example, when the first transistor is of N-type, and is brought into the ON-state with a High signal, the second transistor is also of the N-type, and is brought into the ON-state with a High signal. A potential of a selection signal supplied over each of the scan lines to a gate of the second transistor can be set to the third potential that is highest among the first potential, the second potential, and the third potential. A potential of a non-selection signal can be set to the second potential that is lowest among the first potential, the second potential, and the third potential. The potential of the selection signal can thus be set higher than a potential of an image signal (first potential or second potential). Therefore, when the second transistor is brought into the ON-state, and an image signal is written into the memory circuit, a gate-source voltage of the second transistor can be increased by a difference due to the selection signal that is higher. Even when the image signal is written and a source potential increases, i.e., even when the first potential on a high potential side is supplied as the image signal, an ON-resistance of the second transistor can be kept lower.

Similarly, when the first transistor is of P-type, and is brought into the ON-state with a Low signal, the second transistor is also of the P-type, and is brought into the ON-state with a Low signal. The potential of the selection signal supplied over each of the scan lines to the gate of the second transistor can be set to the third potential that is lowest among the first potential, the second potential, and the third potential. The potential of the non-selection signal can be set to the second potential that is highest among the first potential, the second potential, and the third potential. The potential of the selection signal can thus be set lower than a potential of an image signal (first potential or second potential). Therefore, when the second transistor is brought into the ON-state, and an image signal is written into the memory circuit, an absolute value of the gate-source voltage of the second transistor can be increased by a difference due to the selection signal that is lower. Even when the image signal is written and a source potential decreases, i.e., even when the first potential on a low potential side is supplied as the image signal, the ON-resistance of the second transistor can be kept lower. Therefore, the image signal can be written and rewritten promptly and securely into the memory circuit.

Application Example 7

Preferably, the electro-optical device according to the present application example may include enable lines. The pixel circuit may includes a fourth transistor including a gate electrically connected to the enable line. The light emitting element, the first transistor, and the fourth transistor may be disposed in series between the second potential line and the third potential line.

According to the configuration of the present application example, the fourth transistor disposed in series with the light emitting element and the first transistor can be controlled via the enable line independently from the second transistor. In other words, a period for writing an image signal into the memory circuit by bringing the second transistor into the ON-state and a period in which the light emitting element may be caused to emit light by bringing the fourth transistor into the ON-state can be controlled individually. Therefore, in the pixel, the light emitting element is in a non-light emission state in the period for writing an image signal into the memory circuit. After the image signal is written into the memory circuit, a certain period of time can be the display period, the light emitting element can be ready for emitting light, and accurate grey-scale expression can be achieved by time division driving.

Application Example 8

Preferably, in the electro-optical device according to the present application example, a drain of the fourth transistor may be electrically connected to the light emitting element.

According to the configuration of the present application example, the drain of the fourth transistor is electrically connected to the light emitting element disposed between the third potential line and the first transistor including the source electrically connected to the second potential line. Therefore, when the fourth transistor is of the N-type, the fourth transistor is disposed on a low potential side with respect to the light emitting element. When the fourth transistor is of the P-type, the fourth transistor is disposed on a high potential side with respect to the light emitting element. Therefore, when the fourth transistor is brought into the ON-state, and even when a source-drain voltage of the fourth transistor is smaller, electric conductivity of the fourth transistor can be increased. In other words, when the light emitting element emits light while the fourth transistor is brought into the ON-state, the fourth transistor can be linearly operated. In this way, most of a potential difference between the second potential and the third potential both configuring the high-voltage power-supply is applied to the light emitting element. Thus, when the light emitting element emits light, variations in a threshold voltage of the fourth transistor have a smaller influence. As a result, uniformity in luminance among pixels can be improved.

Application Example 9

Preferably, in the electro-optical device according to the present application example, an ON-resistance of the fourth transistor may be lower than the ON-resistance of the light emitting element.

According to the configuration of the present application example, when the light emitting element emits light while the first transistor and the fourth transistor are brought into the ON-state, the fourth transistor can be linearly operated. As a result, most of a potential drop occurring in the light emitting element, the first transistor, and the fourth transistor is applied to the light emitting element. Thus, when the light emitting element emits light, variations in a threshold voltage of the fourth transistor have a smaller influence. In this way, variations in luminance and unevenness in grey-scale between pixels can be reduced.

Application Example 10

Preferably, in the electro-optical device according to the present application example, the polarity of the first transistor and a polarity of the fourth transistor may be opposite to each other.

According to the configuration of the present application example, the source of the first transistor and a source of the fourth transistor are electrically connected to potential lines having different potentials. Therefore, each of the source potential of the first transistor and a source potential of the fourth transistor is fixed to a corresponding potential. When both of the transistors are brought into the ON-state, electric conductivity of both of the transistors can be increased. Both of the transistors can thus be linearly operated.

Application Example 11

Preferably, in the electro-optical device according to the present application example, when the second transistor is brought into the ON-state, the fourth transistor may be brought into an OFF-state.

According to the configuration of the present application example, when the second transistor is brought into the ON-state, and an image signal is written, over each of the data lines, into the memory circuit, the fourth transistor is brought into the OFF-state, and the light emitting element is brought into the non-light emission state, the signal can be written or rewritten into the memory circuit securely and promptly at lower power consumption. In this way, false display and decreased quality of image display due to false writing of an image signal into the memory circuit can be suppressed.

Application Example 12

Preferably, in the electro-optical device according to the present application example, an inactive signal that makes the fourth transistor be in an OFF-state is supplied to the enable line during a first period in which a selection signal that makes the second transistor be in an ON-state is supplied to the scan line.

According to the configuration of the present application example, the fourth transistor is brought into the OFF-state in the first period in which the second transistor is brought into the ON-state by the selection signal. Thus, in the first period in which an image signal is written into the memory circuit, the light emitting element does not emit light.

Application Example 13

Preferably, in the electro-optical device according to the present application example, a non-selection signal that makes the second transistor be in an OFF-state is supplied to the scan line during a second period in which an active signal that makes the fourth transistor be in an ON-state is supplied to the enable line.

According to the configuration of the present application example, the second transistor is brought into the OFF-state in the second period in which the fourth transistor is brought into the ON-state by the active signal. Thus, writing of an image signal into the memory circuit in the second period in which the light emitting element may emit light can be stopped. Since the first period and the second period can be individually controlled, the second period in which the light emitting element may emit light can have different lengths regardless of a length of the first period. In this way, display with higher grey-scale can be achieved by digital time division driving. Furthermore, a signal that is an active signal or an inactive signal supplied to each of the enable lines can be shared among a plurality of pixels, and thus the electro-optical device can be easily driven even when some subfields have the second period shorter than one vertical period in which selection of all the scan lines is completed.

Application Example 14

Preferably, in the electro-optical device according to the application example, the first transistor may be of the r, and the fourth transistor may be of the P-type, and, a potential of the active signal supplied to the enable line may be V3−(V1−V2) or lower, V1 is the first potential, V2 is the second potential and V3 is the third potential.

According to the configuration of the application example, the source of the first transistor of the N-type is electrically connected to the second potential line, and the source of the fourth transistor of the P-type is electrically connected to the third potential line. Therefore, the third potential is higher than the second potential. The fourth transistor is brought into the ON-state when the active signal at Low is supplied to its gate. However, the potential of the active signal is V3−(V1−V2) or lower, i.e., can be lowered by a voltage of the low-voltage power-supply than the third potential representing the source potential of the fourth transistor. The active signal can thus securely bring the fourth transistor into the ON-state. When the potential of the active signal is lowered, a gate-source voltage of the fourth transistor increases in a negative direction. The ON-resistance of the fourth transistor being brought into the ON-state lowers. When the light emitting element emits light, variations in a threshold voltage of the fourth transistor have a smaller influence.

Application Example 15

Preferably, in the electro-optical device according to the present application example, the potential of the active signal may be the second potential.

According to the configuration of the present application example, the potential of the active signal is set to the second potential that is lowest among the first potential, the second potential, and the third potential. This eliminates introduction of a new potential. An absolute value of the gate-source voltage of the fourth transistor can thus be sufficiently increased. By sufficiently reducing the ON-resistance of the fourth transistor being brought into the ON-state, even when variations in a threshold voltage is present in the fourth transistor, its negative effects on light emitting intensity of the light emitting element can be almost sufficiently suppressed.

Application Example 16

Preferably, in the electro-optical device according to the application example, the first transistor and the second transistor may be of the N-type, and a potential of the selection signal supplied to the scan line may be equal or higher than the first potential.

According to the configuration of the present application example, the first transistor of the N-type and including the source electrically connected to the second potential line is brought into the ON-state when a High signal is suppled to its gate from the memory circuit disposed between the first potential line and the second potential line. Therefore, the first potential is higher than the second potential. A source potential of the second transistor of the N-type is an intermediate potential between the first potential and the second potential. The potential of the selection signal supplied over the scan line to the gate of the second transistor is the first potential or higher. Therefore, the second transistor can be securely brought into the ON-state. When the potential of the selection signal is increased higher than the first potential, the ON-resistance of the second transistor being in the ON-state lowers. Therefore, an image signal can be promptly and securely written and rewritten into the memory circuit without causing an erroneous behavior.

Application Example 17

Preferably, in the electro-optical device according to the present application example, the potential of the selection signal supplied to the scan line may be the third potential.

According to the configuration of the present application example, the potential of the selection signal is set to the third potential that is highest among the first potential, the second potential, and the third potential. This eliminates introduction of a new potential. The gate-source voltage of the second transistor can be sufficiently increased. By sufficiently lowering the ON-resistance of the second transistor, an image signal can be promptly and securely written and rewritten into the memory circuit without causing an erroneous behavior.

Application Example 18

Preferably, in the electro-optical device according to the application example, the first transistor may be P-type, and the fourth transistor may be N-type, and, a potential of the active signal supplied to the enable line may be equal or higher than V3+(V2−V1), V1 is the first potential, V2 is the second potential and V3 is the third potential.

According to the configuration of the application example, the source of the first transistor of the P-type is electrically connected to the second potential line, and the source of the fourth transistor of the N-type is electrically connected to the third potential line. Therefore, the third potential is lower than the second potential. The fourth transistor is brought into the ON-state when the active signal at High is supplied to its gate. However, the potential of the active signal is V3+(V2−V1) or higher, i.e., is increased by a voltage of the low-voltage power-supply than the third potential representing the source potential of the fourth transistor. The active signal can thus securely bring the fourth transistor into the ON-state. When the potential of the active signal is increased, the gate-source voltage of the fourth transistor increases. The ON-resistance of the fourth transistor being brought into the ON-state lowers. When the light emitting element emits light, variations in a threshold voltage of the fourth transistor have a smaller influence.

Application Example 19

Preferably, in the electro-optical device according to the present application example, the potential of the active signal may be the second potential.

According to the configuration of the present application example, the potential of the active signal is set to the second potential that is highest among the first potential, the second potential, and the third potential. This eliminates introduction of a new potential. The gate-source voltage of the fourth transistor can thus be sufficiently increased. By sufficiently reducing the ON-resistance of the fourth transistor being brought into the ON-state, even when variations in a threshold voltage is present in the fourth transistor, its negative effects on light emitting intensity of the light emitting element can be almost sufficiently suppressed.

Application Example 20

Preferably, in the electro-optical device according to the application example, the first transistor and the second transistor may be P-type, and a potential of the selection signal supplied to the scan line may be equal or lower than the first potential.

According to the configuration of the present application example, the first transistor of the P-type and including the source electrically connected to the second potential line is brought into the ON-state when a Low signal is suppled to its gate from the memory circuit disposed between the first potential line and the second potential line. Therefore, the first potential is lower than the second potential. The source potential of the second transistor of the P-type is an intermediate potential between the first potential and the second potential. The potential of the selection signal supplied over each of the scan lines to the gate of the second transistor is the first potential or lower. Therefore, the second transistor can be securely brought into the ON-state. When the potential of the selection signal is decreased lower than the first potential, the ON-resistance of the second transistor being in the ON-state lowers. Therefore, an image signal can be promptly and securely written and rewritten into the memory circuit without causing an erroneous behavior.

Application Example 21

Preferably, in the electro-optical device according to the present application example, the potential of the selection signal may be the third potential.

According to the configuration of the present application example, the potential of the selection signal is set to the third potential that is lowest among the first potential, the second potential, and the third potential. This eliminates introduction of a new potential. The gate-source voltage of the second transistor can be sufficiently increased. By sufficiently lowering the ON-resistance of the second transistor, an image signal can be promptly and securely written and rewritten into the memory circuit without causing an erroneous behavior.

Application Example 22

An electronic apparatus according to the present application example includes the electro-optical device described in the above-described application example.

According to the configuration of the present application example, high quality of an image displayed in the electronic apparatus such as a head-mounted display can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to drawings. Note that, in each of the drawings below, to make each layer, member, and the like recognizable in terms of size, each of the layers, members, and the like are not to scale.

Outline of Electronic Apparatus

Figure 1:
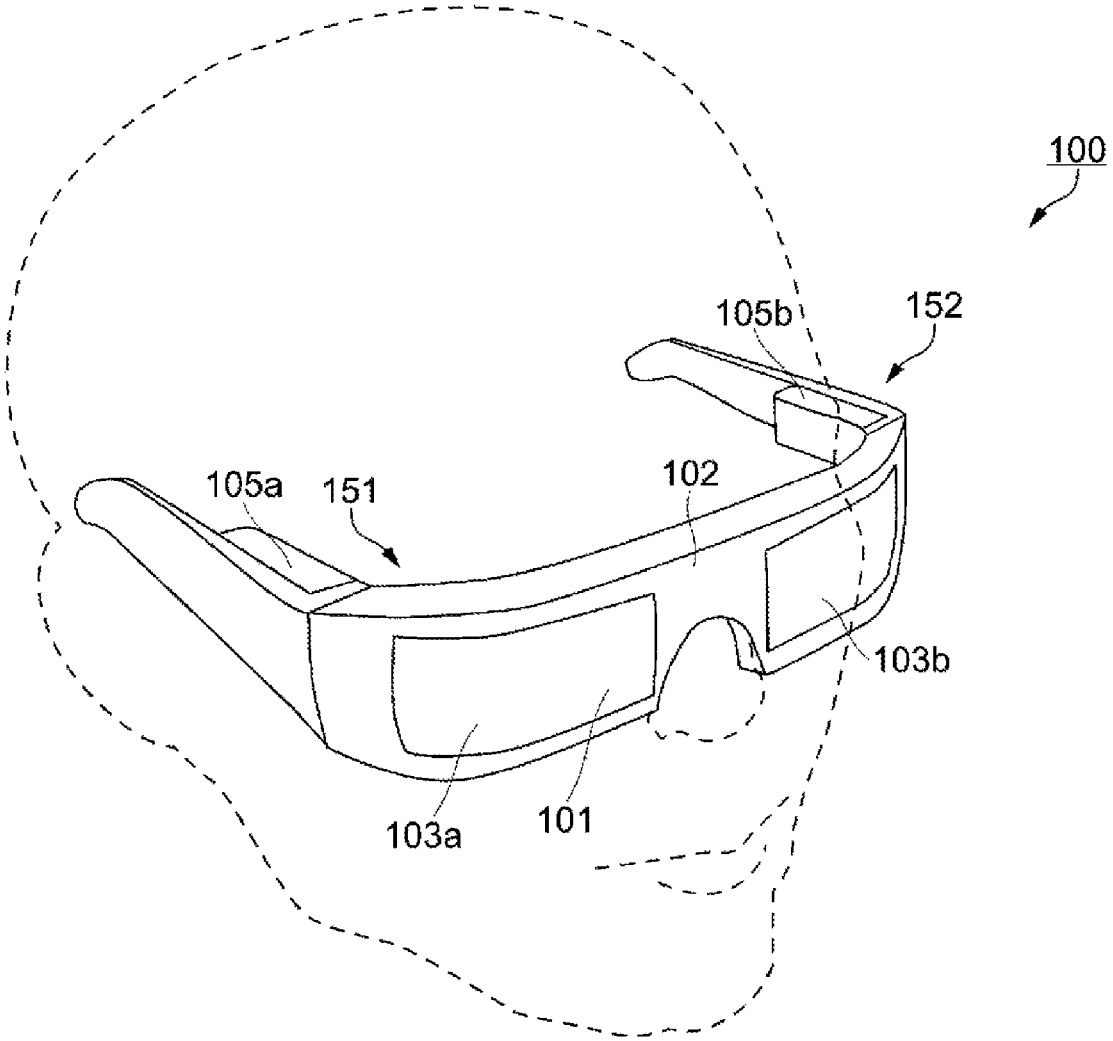
FIG. 1 illustrates a diagram for describing an outline of an electronic apparatus according to the present exemplary embodiment.

First, an outline of an electronic apparatus will be described with reference to FIG. 1. FIG. 1 illustrates a diagram for describing the outline of the electronic apparatus according to the present exemplary embodiment.

Figure 3:
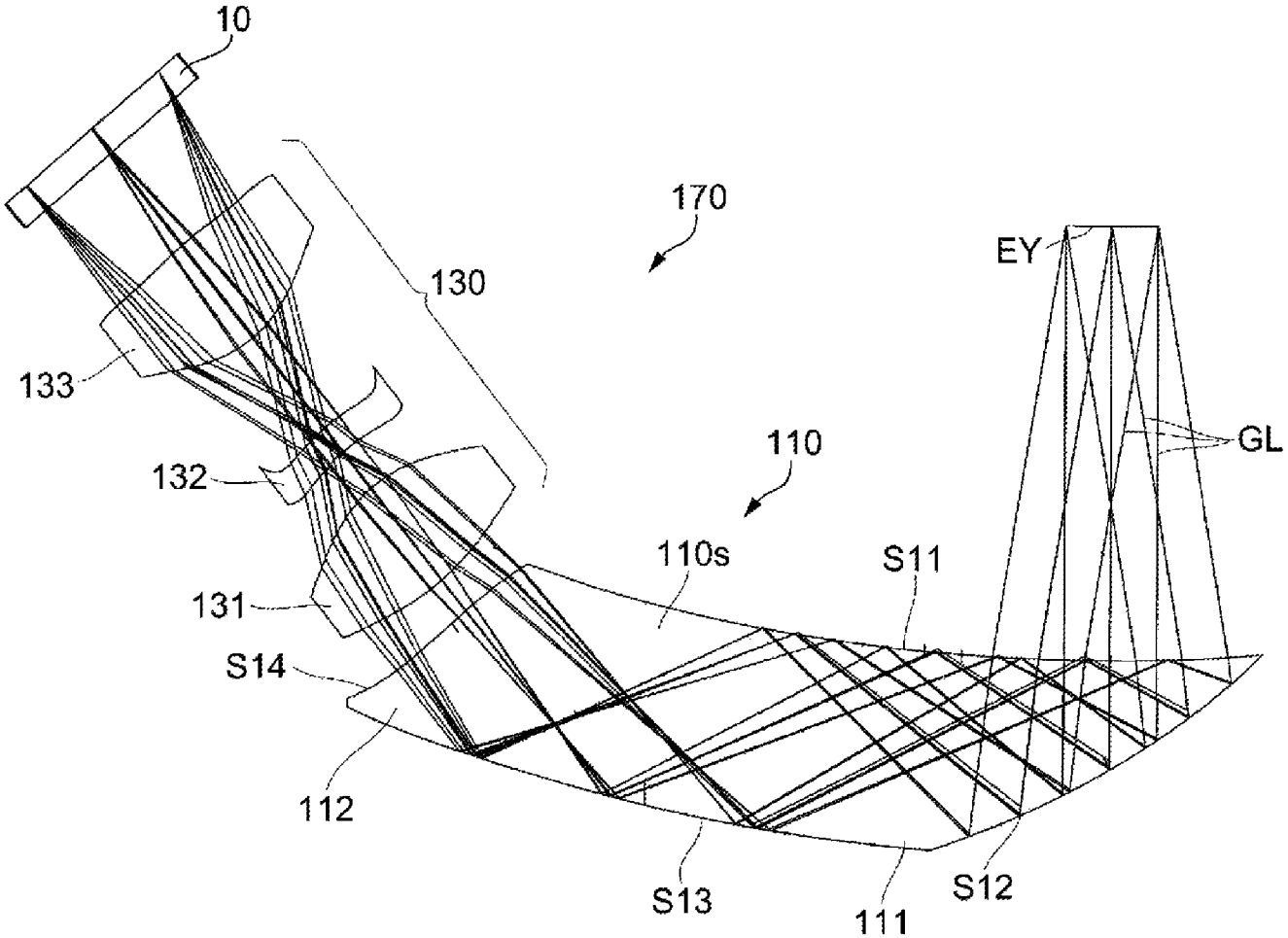
FIG. 3 illustrates a diagram for describing an optical system of the electronic apparatus according to the present exemplary embodiment.

A head-mounted display 100 is one example of the electronic apparatus according to the present exemplary embodiment, and includes an electro-optical device 10 (see FIG. 3). As illustrated in FIG. 1, the head-mounted display 100 has an external appearance similar to a pair of glasses. The head-mounted display 100 allows a user who wears the head-mounted display 100 to view image light GL of an image (see FIG. 3) and allows the user to view extraneous light as a see-through image. In other words, the head-mounted display 100 has a see-through function of displaying an image where the image light GL is superimposed over the extraneous light, and has a small size and weight while having a wide angle of view and high performance.

The head-mounted display 100 includes a see-through member 101 that covers the front of user's eyes, a frame 102 that supports the see-through member 101, and a first built-in device unit 105*a* and a second built-in device unit 105*b* attached to respective portions of the frame 102 extending from cover portions at both left and right ends of the frame 102 over rear sidepieces (temples).

The see-through member 101 is a thick, curved optical member and can be also referred to as a transmission eye cover that covers the front of user's eyes and is separated into a first optical portion 103*a* and a second optical portion 103*b*. A first display apparatus 151 illustrated on the left side of FIG. 1 that results from combining the first optical portion 103*a* and the first built-in device unit 105*a* is a portion that displays a see-through virtual image for the right eye and can alone serves as an electronic apparatus having a display function. A second display apparatus 152 illustrated on the right side of FIG. 1 that results from combining the second optical portion 103*b* and the second built-in device unit 105*b* is a portion that forms a see-through virtual image for the left eye and can alone serve as an electronic apparatus having a display function. The electro-optical device 10 (see FIG. 3) is incorporated in each of the first display apparatus 151 and the second display apparatus 152.

Internal Structure of Electronic Apparatus

Figure 2:
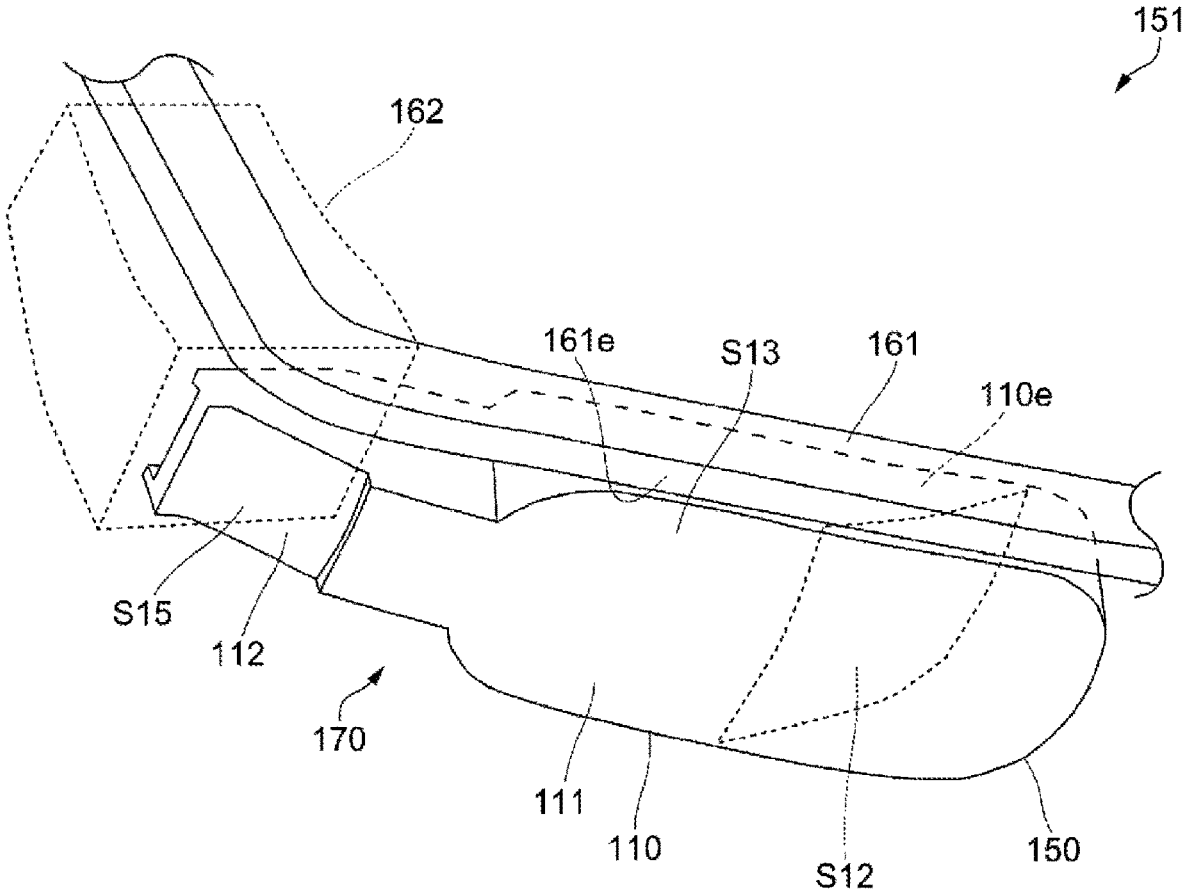
FIG. 2 illustrates a diagram for describing an internal structure of the electronic apparatus according to the present exemplary embodiment.

FIG. 2 illustrates a diagram for describing the internal structure of the electronic apparatus according to the present exemplary embodiment. FIG. 3 illustrates a diagram for describing an optical system of the electronic apparatus according to the present exemplary embodiment. Next, the internal structure and the optical system of the electronic apparatus will be described with reference to FIGS. 2 and 3. While FIG. 2 and FIG. 3 illustrate the first display apparatus 151 as an example of the electronic apparatus, the second display apparatus 152 is symmetrical to the first display apparatus 151 and is identical in structure to the first display apparatus 151. Accordingly, only the first display apparatus 151 will be described here and detailed description of the second display apparatus 152 will be omitted.

As illustrated in FIG. 2, the first display apparatus 151 includes a see-through projection device 170 and the electro-optical device 10 (see FIG. 3). The see-through projection device 170 includes a prism 110 serving as a light-guiding member, a light transmission member 150, and a projection lens 130 for image formation (see FIG. 3). The prism 110 and the light transmission member 150 are integrated together by bonding and are securely fixed on a lower side of a frame 161 such that an upper surface 110*e* of the prism 110 is in contact with a lower surface 161*e* of the frame 161, for example.

The projection lens 130 is fixed to an end portion of the prism 110 through a lens tube 162 that houses the projection lens 130. The prism 110 and the light transmission member 150 of the see-through projection device 170 correspond to the first optical portion 103*a* in FIG. 1. The projection lens 130 of the see-through projection device 170 and the electro-optical device 10 correspond to the first built-in device unit 105*a* in FIG. 1.

The prism 110 of the see-through projection device 170 is an arc-shaped member curved along the face in a plan view and may be considered to be separated into a first prism portion 111 on a central side close to the nose and a second prism portion 112 on a peripheral side away from the nose. The first prism portion 111 is disposed on a light emission side and includes a first surface S11 (see FIG. 3), a second surface S12, and a third surface S13 as side surfaces having an optical function.

The second prism portion 112 is disposed on a light incident side and includes a fourth surface S14 (see FIG. 3) and a fifth surface S15 as side surfaces having an optical function. Of these surfaces, the first surface S11 is adjacent to the fourth surface S14, the third surface S13 is adjacent to the fifth surface S15, and the second surface S12 is disposed between the first surface S11 and the third surface S13. Further, the prism 110 includes the upper surface 110*e* adjacent to the first surface S11 and the fourth surface S14.

The prism 110 is made of a resin material having high transmissivity in a visible range and is molded by, for example, pouring a thermoplastic resin in a mold, and solidifying the thermoplastic resin. While a main portion 110*s* (see FIG. 3) of the prism 100 is illustrated as an integrally formed member, it can be considered to be separated into the first prism portion 111 and the second prism portion 112. The first prism portion 111 can guide and emit the image light GL while also allowing for see-through of the extraneous light. The second prism portion 112 can receive and guide the image light GL.

The light transmission member 150 is fixed integrally with the prism 110. The light transmission member 150 is a member that assists a see-through function of the prism 110 and can be also referred to as an auxiliary prism. The light transmission member 150 has high transmissivity in a visible range and is made of a resin material having substantially the same refractive index as the refractive index of the main portion 110*s* of the prism 110. The light transmission member 150 is formed by, for example, molding a thermoplastic resin.

As illustrated in FIG. 3, the projection lens 130 includes, for example, three lenses 131, 132, and 133 along an incident side-optical axis. Each of the lenses 131, 132, and 133 is rotationally symmetric about a central axis of a light incident surface of the lens. At least one of the lenses 131, 132, and 133 is an aspheric lens.

The projection lens 130 allows the image light GL emitted from the electro-optical device 10 to enter the prism 110 and refocus the image on an eye EY. In other words, the projection lens 130 is a relay optical system for refocusing the image light GL emitted from each pixel of the electro-optical device 10 on the eye EY via the prism 110. The projection lens 130 is held inside the lens tube 162. The electro-optical device 10 is fixed to one end of the lens tube 162. The second prism portion 112 of the prism 110 is connected to the lens tube 162 holding the projection lens 130 and indirectly supports the projection lens 130 and the electro-optical device 10.

An electronic apparatus that is mounted on a user's head and covers the front of eyes, such as the head-mounted display 100, needs to be small and light. Further, the electro-optical device 10 used in an electronic apparatus such as the head-mounted display 100 needs to have a higher resolution, finer pixels, more grey-scales of display, and lower power consumption.

Configuration of Electro-Optical Device

Figure 4:
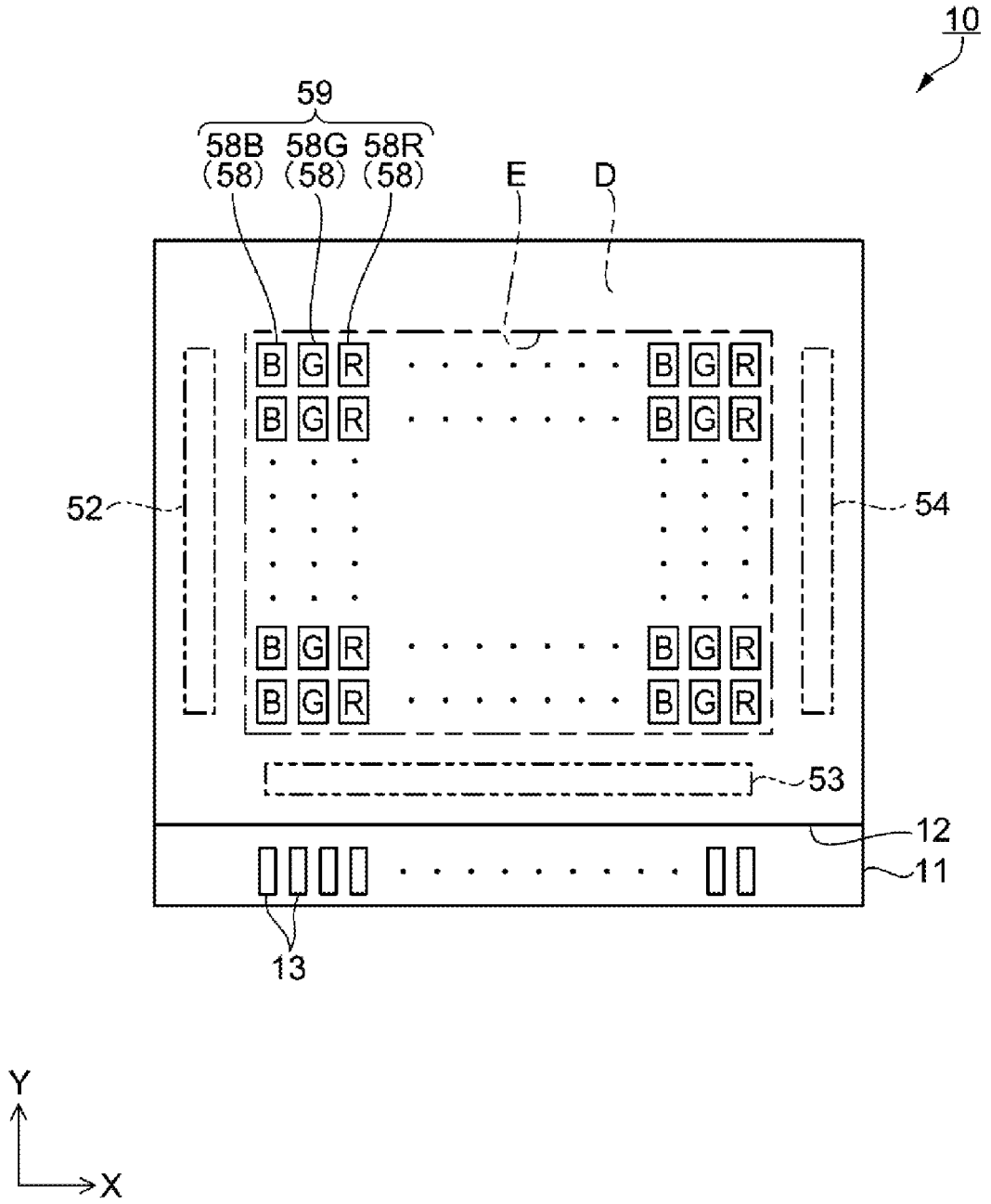
FIG. 4 is a schematic plan view illustrating a configuration of an electro-optical device according to the present exemplary embodiment.

Next, a configuration of an electro-optical device will be described with reference to FIG. 4. FIG. 4 is a schematic plan view illustrating the configuration of the electro-optical device according to the present exemplary embodiment. The present exemplary embodiment will be described by taking, as an example, a case where the electro-optical device 10 is an organic EL device including an organic EL element as a light emitting element. As illustrated in FIG. 4, the electro-optical device 10 according to the present exemplary embodiment includes an element substrate 11 and a protective substrate 12. The element substrate 11 is provided with a color filter, which is not illustrated. The element substrate 11 and the protective substrate 12 are disposed to face each other and bonded together with a filling agent, which is not illustrated.

The element substrate 11 is formed of a single crystal semiconductor substrate, such as a single crystal silicon substrate, for example. The element substrate 11 includes a display region E and a non-display region D surrounding the display region E. In the display region E, for example, a sub-pixel 58B that emits blue (B) light, a sub-pixel 58G that emits green (G) light, and a sub-pixel 58R that emits red (R) light are arranged in, for example, a matrix. Each of the sub-pixel 58B, the sub-pixel 58G, and the sub-pixel 58R is provided with a light emitting element (see FIG. 6). In the electro-optical device 10, a pixel 59 including the sub-pixel 58B, the sub-pixel 58G, and the sub-pixel 58R serves as a display unit to provide a full color display.

In this specification, the sub-pixel 58B, the sub-pixel 58G, and the sub-pixel 58R may not be distinguished from one another and may be collectively referred to as a sub-pixel 58. The display region E is a region through which light emitted from the sub-pixel 58 passes and that contributes to display. The non-display region D is a region through which light emitted from the sub-pixel 58 does not pass and that does not contribute to display.

The element substrate 11 is larger than the protective substrate 12 and a plurality of external connection terminals 13 are aligned along a first side of the element substrate 11 extending from the protective substrate 12. A data line drive circuit 53 is provided between the plurality of external connection terminals 13 and the display region E. A scan line drive circuit 52 is provided between another second side orthogonal to the first side and the display region E. An enable line drive circuit 54 is provided between a third side that is orthogonal to the first side and opposite from the second side and the display region E.

The protective substrate 12 is smaller than the element substrate 11 and is disposed so as to expose the external connection terminals 13. The protective substrate 12 is a light transmitting substrate, and, for example, a quartz substrate, a glass substrate, and the like may be used as the protective substrate 12. The protective substrate 12 serves to protect the light emitting element 20 disposed in the sub-pixel 58 in the display region E from damage and is disposed to face at least the display region E.

Note that, a color filter may be provided on the light emitting element 20 in the element substrate 11 or provided on the protective substrate 12. When beams of light corresponding to colors are emitted from the light emitting element 20, a color filter is not essential. The protective substrate 12 is also not essential, and a protective layer that protects the light emitting element 20 may be provided instead of the protective substrate 12 on the element substrate 11.

It is assumed in this specification that a direction along the first side in which the external connection terminals 13 are aligned is an X direction or a row direction, and a direction along the second side and third side, which are the other two sides orthogonal to the first side and opposite from each other, is a Y direction or a column direction. For example, the present exemplary embodiment adopts a so-called a stripe arrangement in which the sub-pixels 58 that emit the same color are arranged in the column direction, which is the Y direction, and the sub-pixels 58 that emit different colors are arranged in the row direction, which is the X direction.

Note that, the arrangement of the sub-pixels 58 in the row direction, which is the X direction, may not be limited to the order of B, G, and R as illustrated in FIG. 4 and may be in the order of, for example, R, G, and B. The arrangement of the sub-pixels 58 is not limited to the stripe arrangement and may be a delta arrangement, a Bayer arrangement or an S-stripe arrangement. In addition, the sub-pixels 58B, the sub-pixels 58G, and the sub-pixels 58R are not limited to the same shape or size.

First Exemplary Embodiment

Configuration of Circuit of Electro-Optical Device

Figure 5:
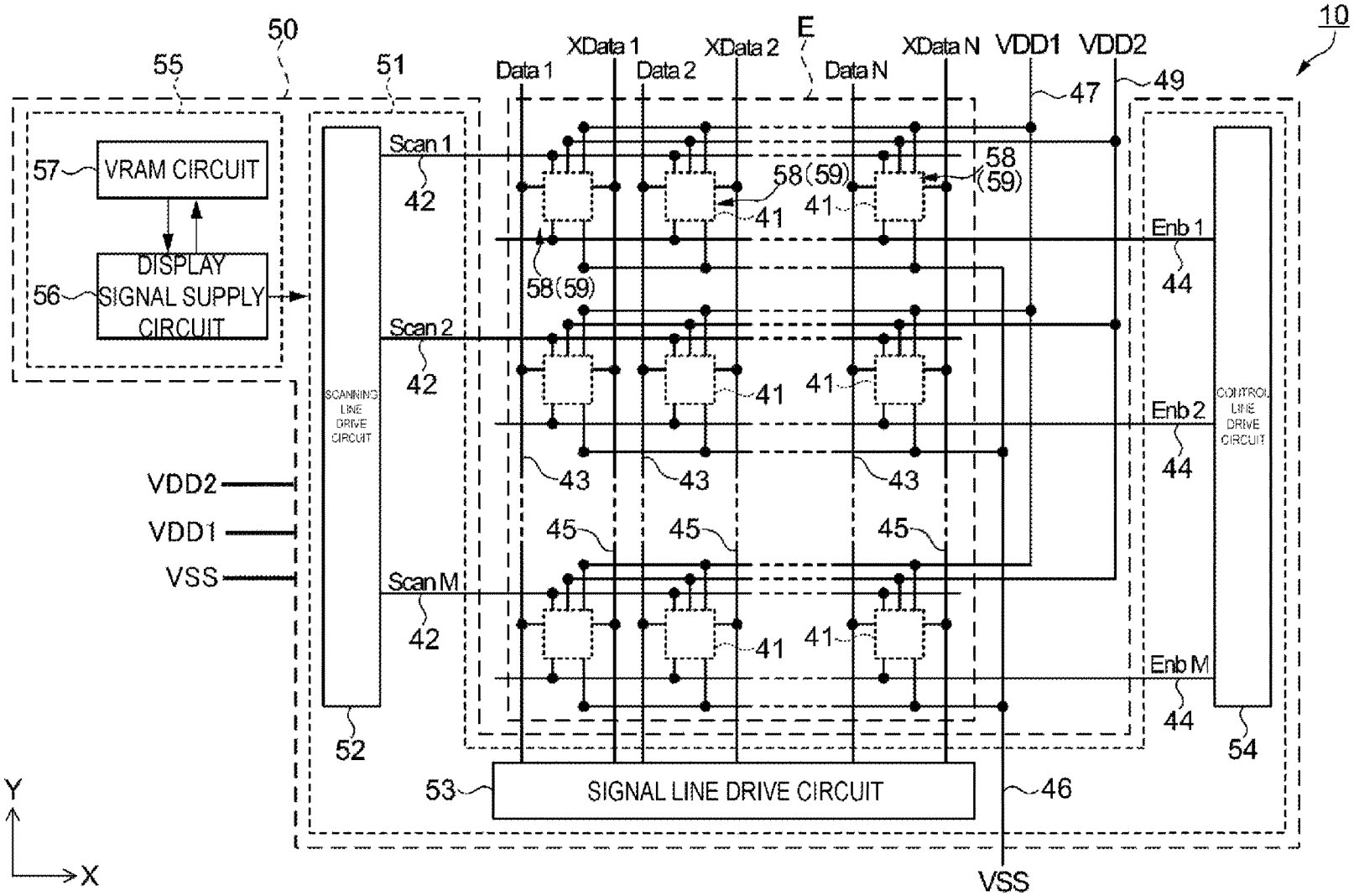
FIG. 5 illustrates a block diagram of a circuit of the electro-optical device according to the present exemplary embodiment.

Next, a configuration of the circuit of the electro-optical device will be described with reference to FIG. 5. FIG. 5 illustrates a block diagram of the circuit of the electro-optical device according to the present exemplary embodiment. As illustrated in FIG. 5, formed in the display region E of the electro-optic device 10 are a plurality of scan lines 42 and a plurality of data lines 43 that cross each other with the sub-pixels 58 being arranged in a matrix to correspond to the respective intersections of the scan lines 42 and the data lines 43. Each of the sub-pixels 58 includes a pixel circuit 41 including the light emitting element 20 (see FIG. 8), and the like.

An enable line 44 is formed for each of the corresponding scan lines 42 in the display region E of the electro-optical device 10. The scan line 42 and the enable line 44 extend in the row direction. Further, a complementary data line 45 is formed for each of the corresponding data lines 43 in the display region E. The data line 43 and the complementary data line 45 extend in the column direction.

In the electro-optical device 10, the sub-pixels 58 in M rows×N columns are arranged in matrix in the display region E. Specifically, M scan lines 42, M enable lines 44, N data lines 43, and N complementary data lines 45 are formed in the display region E. Note that, M and N are integers of two or greater, and M=720 and N=1280×p as one example in the present exemplary embodiment. p is an integer of one or greater and indicates the number of basic display colors. The present exemplary embodiment is described by taking, as an example, a case where p=3, that is, the basic display colors are three colors of R, G, and B.

The electro-optical device 10 includes a drive unit 50 outside the display region E. The drive unit 50 supplies various signals to the respective pixel circuits 41 arranged in the display region E, such that an image in which the pixels 59 formed of sub-pixels 58 for three colors serve as units of display is displayed in the display region E. The drive unit 50 includes a drive circuit 51 and a control unit 55. The control unit 55 supplies a display signal to the drive circuit 51. The drive circuit 51 supplies a drive signal to each of the pixel circuits 41 through the plurality of scan lines 42, the plurality of data lines 43, and the plurality of enable lines 44, based on the display signal.

Furthermore, in the non-display region D and the display region E, a first high potential line 47 as a first potential line supplied with a first potential, a low potential line 46 as a second potential line supplied with a second potential, and a second high potential line 49 as a third potential line supplied with a third potential are arranged. To each of the pixel circuits 41, the first high potential line 47 supplies the first potential, the low potential line 46 supplies the second potential, and the second high potential line 49 supplies the third potential.

In the present exemplary embodiment, the first potential (V1) represents a first high potential VDD1 (e.g., V1=VDD1=3.0 V), the second potential (V2) represents a low potential VSS (e.g., V2=VSS=0 V), and the third potential (V3) represents a second high potential VDD2 (e.g., V3=VDD2=7.0 V). Therefore, the first potential is higher than the second potential, while the third potential is higher than the first potential.

In the present exemplary embodiment, the first potential (first high potential VDD1) and the second potential (low potential VSS) constitute a low-voltage power-supply, and the third potential (second high potential VDD2) and the second potential (low potential VSS) constitute a high-voltage power-supply. The second potential serves as a reference potential in the low-voltage power-supply and the high-voltage power-supply.

Note that, although the second potential line (low potential line 46), the first potential line (first high potential line 47), and the third potential line (second high potential line 49) extend in the row direction within the display region E as one example in the present exemplary embodiment, they may extend in the column direction, some of them may extend in the row direction while the other may extend in the column direction, or they may be arranged in a grid pattern in the row and column directions.

The drive circuit 51 includes the scan line drive circuit 52, the data line drive circuit 53, and the enable line drive circuit 54. The drive circuit 51 is provided in the non-display region D (see FIG. 4). In the present exemplary embodiment, the drive circuit 51 and the pixel circuit 41 are formed on the element substrate 11 illustrated in FIG. 4. In the present exemplary embodiment, a single crystal silicon substrate is used as the element substrate 11. Specifically, the drive circuit 51 and the pixel circuit 41 are each formed of an element such as a transistor formed on the single crystal silicon substrate.

The scan lines 42 are electrically connected to the scan line drive circuit 52. The scan line drive circuit 52 outputs a scanning signal (Scan) that allows the pixel circuits 41 to be selected or unselected in the row direction to each of the scan lines 42, and the scan lines 42 supplies the scanning signals to the pixel circuits 41. In other words, the scanning signal has a selection state and a non-selection state, and the scan lines 42 is appropriately selected in response to the scanning signals received from the scan line drive circuits 52. The scanning signal takes an intermediate potential between the second potential (low potential VSS) and the third potential (second high potential VDD2).

As described later, in the present exemplary embodiment, both of a second transistor 32 and a second complementary transistor 38 are of the N-type (see FIG. 8), and thus a selection signal, which is a scanning signal in the selection state, is at High, i.e. high potential, and a non-selection signal, which is a scanning signal in the non-selection state, is at Low, i.e. low potential. The selection signal is set to a higher potential, i.e. the first potential (V1) or higher, and is preferably set to the third potential (V3). In addition, the non-selection signal is set to a lower potential, i.e. the second potential (V2) or lower, and is preferably set to the second potential (V2).

Note that, to specify a scanning signal supplied to a scan line 42 in an i-th row of the M scan lines 42, the scanning signal is denoted as a scanning signal Scan i in the i-th row. The scan line drive circuit 52 includes a shift register circuit, which is not illustrated, and a signal for shifting the shift register circuit is output as a shift output signal for each stage. The shift output signals are then used to generate scanning signals from Scan 1 in a first row to Scan M in an M-th row.

The data lines 43 and the complementary data lines 45 are electrically connected to the data line drive circuit 53. The data line drive circuit 53 includes a shift register circuit, a decoder circuit, or a demultiplexer circuit, which is not illustrated. The data line drive circuit 53 supplies an image signal (Data) to each of the N data lines 43 and a complementary image signal (XData) to each of the N complementary data lines 45 in synchronization with the selection of the scan line 42. The image signal and the complementary image signal are digital signals each having the first potential or the second potential. In the present exemplary embodiment, with the first potential being VDD1 and the second potential being VSS, the image signal and the complementary image signal each have the potential of VDD1 or the potential of VSS.

Note that, to specify an image signal supplied to a data line 43 in a j-th column of the N data lines 43, the image signal is denoted as an image signal Data j in the j-th column. Similarly, to specify a complementary image signal supplied to a complementary data line 45 in the j-th column of the N complementary data lines 45, the complementary image signal is denoted as a complementary image signal XData j in the j-th column.

The enable lines 44 are electrically connected to the enable line drive circuit 54. The enable line drive circuit 54 outputs a control signal unique to each row that results from dividing the enable lines 44 into rows. The enable line 44 supplies this control signal to the pixel circuit 41 in the corresponding row. The control signal has an active state and an inactive state, and the enable line 44 may be appropriately brought into the active state in response to the control signal received from the enable line drive circuit 54. The control signal takes an intermediate potential between the second potential (low potential VSS) and the third potential (second high potential VDD2).

As described later, in the present exemplary embodiment, a fourth transistor 34 is of P-type (see FIG. 8), and thus the control signal in the active state, i.e. active signal, is at Low (low potential), and the control signal in the inactive state, i.e. inactive signal, is at High (high potential). When the first potential is expressed as V1, the second potential is expressed as V2, and the third potential is expressed as V3, the active signal is set to V3−(V1−V2) or lower, and is preferably set to the second potential (V2). In addition, the inactive signal is set to the third potential (V3) or higher, and is preferably set to the third potential (V3).

Note that, to specify a control signal supplied to an enable line 44 in the i-th row of the M enable lines 44, the control signal is denoted as a control signal Enb i in the i-th row. The enable line drive circuit 54 may supply the active signal or the inactive signal as a control signal to each row, or it may supply the active signal or the inactive signal as a control signal simultaneously to a plurality of rows. In the present exemplary embodiment, the enable line drive circuit 54 supplies the active signal or the inactive signal simultaneously to all of the pixel circuits 41 located in the display region E through the enable lines 44.

The control unit 55 includes a display signal supply circuit 56 and a video random access memory (VRAM) circuit 57. The VRAM circuit 57 temporarily stores a frame image and the like. The display signal supply circuit 56 generates an image signal and a clock signal, which are display signals, from a frame image temporarily stored in the VRAM circuit 57 and supplies the display signal to the drive circuit 51.

In the present exemplary embodiment, the drive circuit 51 and the pixel circuits 41 are formed on the element substrate 11. In the present exemplary embodiment, a single crystal silicon substrate is used as the element substrate 11. Specifically, the drive circuit 51 and the pixel circuits 41 are each formed of a transistor element formed on the single crystal silicon substrate.

The control unit 55 is formed of a semiconductor integrated circuit formed on a substrate (not illustrated) formed of a single crystal semiconductor substrate different from the element substrate 11. The substrate on which the control unit 55 is formed is connected to the external connection terminals 13 provided on the element substrate 11 with a flexible printed circuit (FPC). A display signal is supplied from the control unit 55 to the drive circuit 51 through this flexible printed circuit.

Configuration of Pixel

Figure 6:
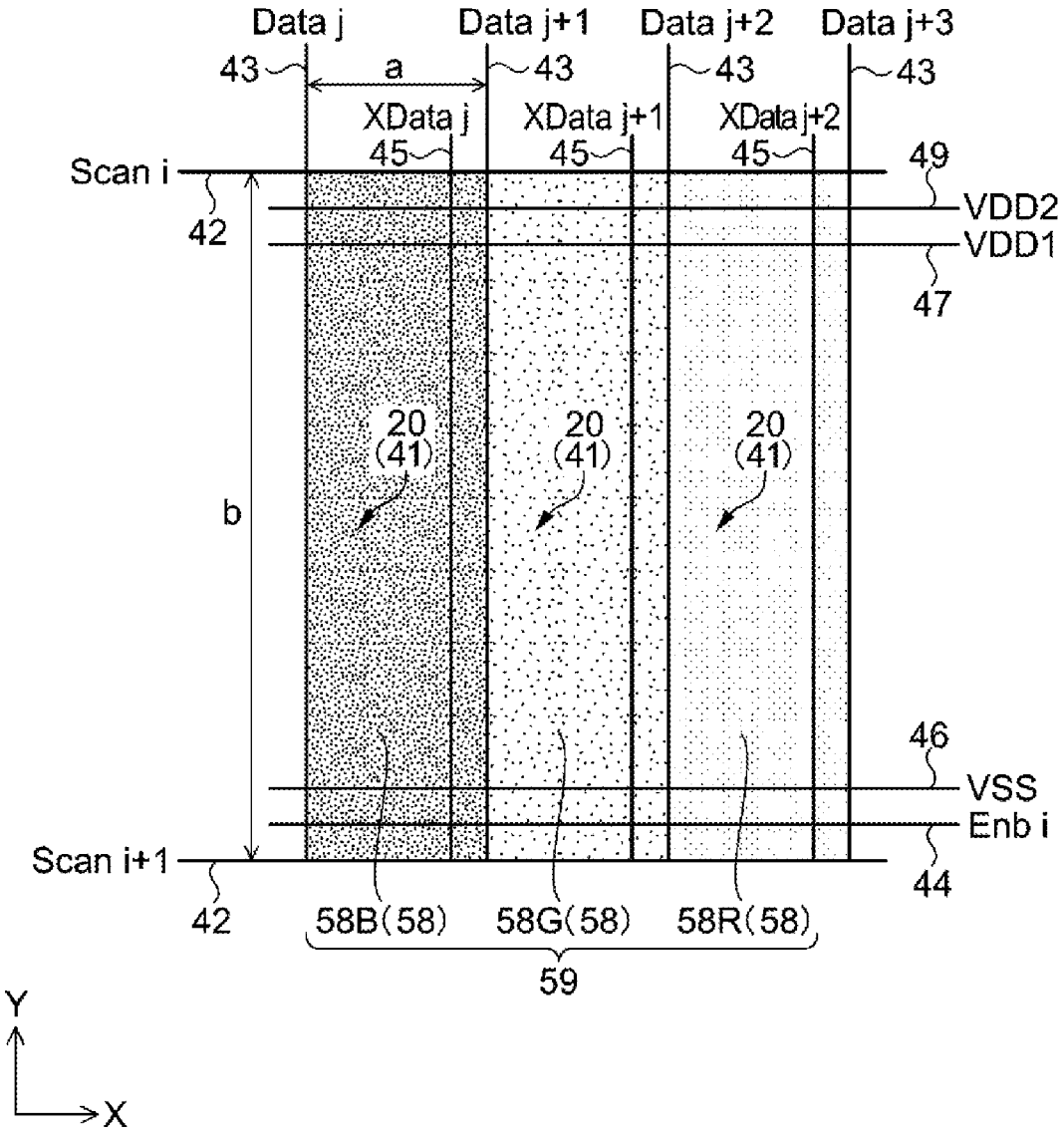
FIG. 6 illustrates a diagram for describing a configuration of a pixel according to the present exemplary embodiment.

Next, a configuration of a pixel according to the present exemplary embodiment will be described with reference to FIG. 6. FIG. 6 is a diagram for describing the configuration of the pixel according to the present exemplary embodiment.

As described above, in the electro-optical device 10, the pixel 59 including the sub-pixels 58 forms a unit of display to display an image. In the present exemplary embodiment, the length a of the sub-pixel 58 in the X direction, which is the row direction, is 4 micrometers (μm) and the length b of the sub-pixel 58 in the Y direction, which is the column direction, is 12 micrometers (μm). In other words, an arrangement pitch in the X direction, which is the row direction, of the sub-pixels 58 is 4 micrometers (μm), and an arrangement pitch in the Y direction, which is the column direction, of the sub-pixels 58 is 12 micrometers (μm).

Each of the sub-pixels 58 includes the pixel circuit 41 including the light emitting element (LED) 20. The light emitting element 20 emits white light. The electro-optical device 10 includes a color filter (not illustrated) through which light emitted from the light emitting element 20 passes. The color filter includes respective color filters for basic display colors p. In the present exemplary embodiment, the basic colors p=3, and respective color filters for colors of B, G, and R are each disposed in the corresponding sub-pixel 58B, 58G, or 58R.

In the present exemplary embodiment, an organic electro luminescence (EL) element is used as one example of the light emitting element 20. The organic EL element may have an optical resonant structure that amplifies the intensity of light having a specific wavelength. Specifically, the organic EL element may be configured such that a blue light is extracted from the white light emitted from the light emitting element 20 in the sub-pixel 58B; a green light is extracted from the white light emitted from the light emitting element 20 in the sub-pixel 58G; and a red light is extracted from the white light emitted from the light emitting element 20 in the sub-pixel 58R.

In addition to the above-described example, assuming that basic colors p=4, a color filter for a color other than B, G, and R, for instance, the sub-pixel 58 substantially without a color filter may be prepared as a color filter for white light, or the sub-pixel 58 including a color filter for light in another color such as yellow and cyan may be prepared. Furthermore, a light emitting diode element such as gallium nitride (GaN), a semiconductor laser element, and the like may be used as the light emitting element 20.

Digital Driving of Electro-optical Device

Figure 7:
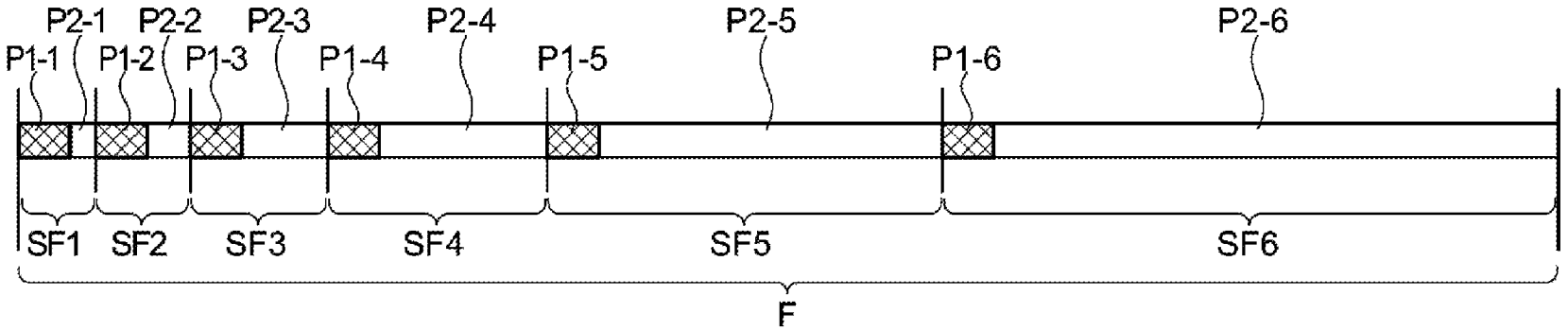
FIG. 7 illustrates a diagram for describing digital driving of the electro-optical device according to the present exemplary embodiment.

Next, a method for displaying an image by digital driving in the electro-optical device 10 according to the present exemplary embodiment will be described with reference to FIG. 7. FIG. 7 is a diagram for describing the digital driving of the electro-optical device according to the present exemplary embodiment.

The electro-optical device 10 displays a predetermined image in the display region E (see FIG. 4) by digital driving. In other words, the light emitting element (see FIG. 6) disposed in each of the sub-pixels 58 takes any one of states indicated by a binary value, that is, light emission, which is bright state, or non-light emission, which is dark display, and grey-scale of a displayed image is determined by a proportion of a light emitting period of each of the light emitting elements 20. This is referred to as time division driving.

As illustrated in FIG. 7, in the time division driving, one field (F) displaying one image is divided into a plurality of subfields (SFs) and the grey-scale display is expressed by controlling emission and non-emission of the light emitting element 20 for each of the subfields (SFs). An example in which a display with $2^6$=64 grey-scales is performed by a 6-bit time division grey-scale scheme will be described as one example here. In the 6-bit time division grey-scale scheme, one field F is divided into six subfields SF1 to SF6.

In FIG. 7, an i-th subfield in the one field F is denoted as SFi and the six subfields from the first subfield SF1 to the sixth subfield SF6 are illustrated here. Each of the subfields SF includes a display period P2 indicated by P2-1 to P2-6 as a second period and a signal writing period P1 which is a non-display period indicated by P1-1 to P1-6 as a first period, as necessary.

Note that, the subfields SF1 to SF6 may be collectively referred to as subfields SF without making a distinction, the non-display periods P1-1 to P1-6 may be collectively referred to as non-display periods P1 without making a distinction, and the display periods P2-1 to P2-6 may be collectively referred to as display periods P2 without making a distinction in this specification.

The light emitting element 20 is placed either in the emission or non-emission state during the display period P2 and in the non-emission state during the signal-writing period P1, which is the non-display period. The non-display period P1 is used, for example, to write an image signal to a memory circuit 60 (see FIG. 8) and adjust display time. When the shortest subfield (for example, SF1) is relatively long, the non-display period P1 (P1-1) may be omitted.

In the 6-bit time division grey-scale scheme, the display period P2 (P2-1 to P2-6) of each of the subfields SFs is set such that (P2-1 of SF1):(P2-2 of SF2):(P2-3 of SF3):(P2-4 of SF4):(P2-5 of SF5):(P2-6 of SF6)=1:2:4:8:16:32. For example, in a case where an image is displayed by a progressive scheme having a frame frequency of 30 Hz, then, one frame=one field (F)=33.3 milliseconds (msec).

In the above-described example, assuming that the non-display period P1 (P1-1 to P1-6) of each of the subfields SF is one millisecond, the display periods P2 are set such that (P2-1 of SF1)=0.434 milliseconds, (P2-2 of SF2)=0.868 milliseconds, (P2-3 of SF3)=1.735 milliseconds, (P2-4 of SF4)=3.471 milliseconds, (P2-5 of SF5)=6.942 milliseconds, and (P2-6 of SF6)=13.884 milliseconds.

Herein, given that the duration of the non-display period P1 is x (sec) and the duration of the shortest display period P2 is y (sec). In the above-described example, the shortest display period P2 is the display period P2-1 in the first subfield SF1. Given that the bit number (=the number of subfields SFs) in grey-scale, which is the number of the number of subfields SFs, is g, and the field frequency is f (Hz), then the relationship among them is expressed by Expression 1 below:

Expression 1

$$gx+(2^g-1)y=1/f \quad (1)$$

In the digital driving of the electro-optical device 10, grey-scale display is achieved based on a ratio of a total display period P2 to a light emission period within one field F. For example, for black display with a grey-scale of "0", the light emitting element 20 is placed into non-emission in all of the display periods P2-1 to P2-6 of the six subfields SF1 to SF6. On the other hand, for white display with a grey-scale of "63", the light emitting element 20 is placed into emission during all of the display periods P2-1 to P2-6 of the six subfields SF1 to SF6.

When display is obtained at intermediate intensity with, for example, a grey-scale of "7" of 64 grey-scales, the light emitting element 20 is caused to emit light in the display period P2-1 of the first subfield SF1, the display period P2-2 of the second subfield SF2, and the display period P2-3 of the third subfield SF3 while the light emitting element 20 is not caused to emit light in the display periods P2-4 to P2-6 of the other respective subfields SF4 to SF6. In this way, a display of intermediate grey-scale can be achieved by appropriately selecting emission or no-emission of the light emitting element 20 during the display period P2 for each of the subfields SF constituting the one field F.

According to an organic EL device as a typical analog driven electro-optical device in prior art, grey-scale display is performed by analog control of a current flowing through an organic EL element according to the gate potential of a drive transistor, such that any variation in voltage-current characteristics and threshold voltage of the drive transistor may cause a variation in luminance and unevenness in grey-scale between pixels, resulting in a decreased display quality. On the other hand, when a compensating circuit that compensates for variations in voltage-current characteristics and threshold voltage of a drive transistor is provided as described in JP-A-2004-062199, a current also flows through the compensating circuit, causing an increase in power consumption.

Also, in the typical organic EL device in prior art, a capacitance of a capacitor that stores an image signal being an analog signal needs to be increased in order to achieve more grey-scales of display. Thus, it is difficult to achieve a higher resolution and finer pixels at the same time, and power consumption also increases due to charge and discharge of a large capacitor. In other words, in a typical organic EL device in prior art, an electro-optical device capable of displaying a high-resolution, multi-grey-scale, and high-quality image at low power consumption is difficult to achieve.

In the electro-optical device 10 according to the present exemplary embodiment, the light emitting element 20 is operated based on binary values of ON and OFF, so that the light emitting element 20 is placed into either of binary states of emission or non-emission. Thus, the electro-optical device 10 is less affected by variations in voltage-current characteristics or threshold voltage of a transistor than electro-optical device 10 operated by analog driving, so that a high-quality displayed image with less variations in luminance and less unevenness in grey-scale between the pixels 59, i.e., sub-pixels 58, can be obtained. Furthermore, since a capacitor in digital driving does not need to have a large capacitance as required in analog driving, not only can a finer pixel 59, i.e., sub-pixels 58, be achieved, but the resolution can also be easily improved and the power consumption due to charge and discharge of a large capacitor can be reduced.

Furthermore, the number of grey-scales can be easily increased by increasing the number g of the subfields SF constituting the one field F in digital driving of the electro-optical device 10. In this case, with the non-display period P1 as described above, the number of grey-scales can be increased by simply shortening the shortest display period P2. For example, when display is performed with 256 grey-scales assuming that g=8 in the progressive scheme at the frame frequency f=30 Hz, the duration y of P2-1 of SF1, which is the shortest display period, may be simply set to 0.100 millisecond by Expression 1 assuming that duration x of the non-display period P1=one millisecond.

As described later, in digital driving of the electro-optical device 10, the non-display period P1 as the first period may be assigned to a signal-writing period during which an image signal is written in the memory circuit 60 or a signal-rewriting period during which an image signal is rewritten. Thus, 6-bit grey-scale display can be easily switched to 8-bit grey-scale display. In other words, 6-bit grey-scale display can be easily switched to 8-bit grey-scale display without changing the clock frequency of the drive circuit 51).

Furthermore, in digital driving of the electro-optical device 10, the image signal in the memory circuit 60 (see FIG. 8) of a sub-pixel 58 for which display is to be changed is rewritten among the subfields SF or among the fields F. On the other hand, the image signal in the memory circuit 60 of a sub-pixel 58 for which display is not to be changed is not rewritten (maintained); in other words, the image signal is maintained and as a result the power consumption can be reduced. Accordingly, this configuration can achieve the electro-optical device 10 that can display a multi-grey-scale and high-resolution image with less variation in luminance and less unevenness in grey-scale between the pixels 59, i.e., sub-pixels 58, while reducing energy consumption.

Example 1

Configuration of Pixel Circuit

Figure 8:
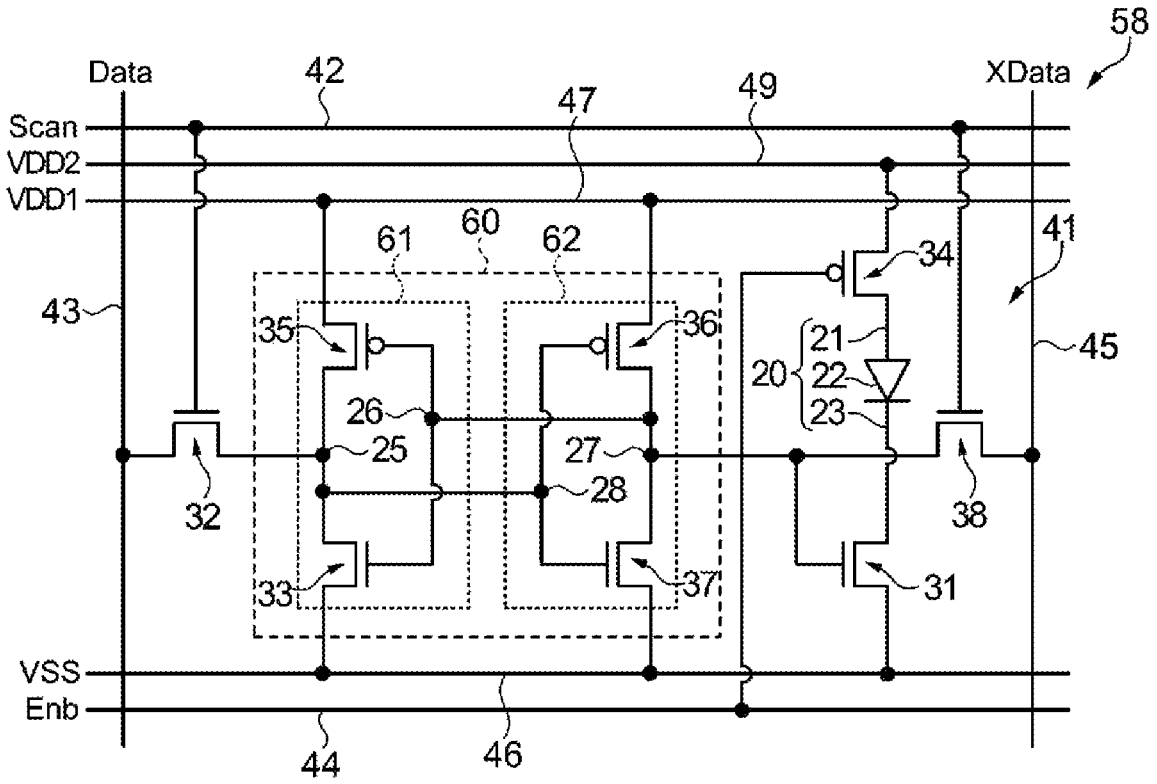
FIG. 8 illustrates a diagram for describing a configuration of a pixel circuit according to Example 1.

Next, a configuration of the pixel circuit according to a first exemplary embodiment will be described with Examples and Modification Examples. First, a configuration of a pixel circuit according to Example 1 of the first exemplary embodiment will be described with reference to FIG. 8. FIG. 8 is a diagram for describing the configuration of the pixel circuit according to Example 1.

As illustrated in FIG. 8, a pixel circuit 41 is provided for each of sub-pixels 58 disposed at intersections of scan lines 42 and data lines 43. An enable line 44 is disposed along the scan line 42 and a complementary data line 45 is disposed along the data line 43. The scan line 42, the data line 43, the enable line 44, and the complementary data line 45 correspond to each of the pixel circuits 41.

In the first exemplary embodiment (Example 1 and the following modification examples), to each of the pixel circuits 41, the first potential (VDD1) is supplied over the first high potential line 47, the second potential (VSS) is supplied over the low potential line 46, and the third potential (VDD2) is supplied over the second high potential line 49.

The pixel circuit 41 according to Example 1 includes a first transistor 31 of the N-type, the light emitting element 20, the fourth transistor 34 of the P-type, the memory circuit 60, the second transistor 32 of the N-type, and the second complementary transistor 38 of the N-type. The memory circuit 60 incorporated in the pixel circuit 41 enables digital driving of the electro-optical device 10 and helps to reduce the variation in the light emitting intensity of the light emitting element 20 among the sub-pixels 58 and thus the variation in display among the pixels 59, as compared to analog driving.

The first transistor 31, the light emitting element 20, and the fourth transistor 34 are disposed in series between the third potential line (second high potential line 49) and the second potential line (low potential line 46). The memory circuit 60 is disposed between the first potential line (first high potential line 47) and the second potential line (low potential line 46). The second transistor 32 is disposed between the memory circuit 60 and the data line 43. The second complementary transistor 38 is disposed between the memory circuit 60 and the complementary data line 45.

The memory circuit 60 includes a first inverter 61 and a second inverter 62. The memory circuit 60 includes the two inverters 61 and 62 that are connected to each other in circle to constitute a so-called static memory that stores a digital signal that is an image signal. An output terminal 25 of the first inverter 61 is electrically connected to an input terminal 28 of the second inverter 62, and an output terminal 27 of the second inverter 62 is electrically connected to an input terminal 26 of the first inverter 61.

In this specification, the state where a terminal A (such as an output or input terminal) and a terminal B (such as an output or input terminal) are electrically connected to each other means a state where the logic of the terminal A and the logic of the terminal B can be equal. For example, even when a transistor, a resistor, a diode, and the like are arranged between the terminal A and the terminal B, the terminals may be regarded as a state of electrically connected. Further, "dispose" as used in the expression "a transistor and other elements are disposed between A and B" does not mean how these elements are arranged on an actual lay-out, but means how these elements are arranged in a circuit diagram.

A digital signal stored in the memory circuit 60 has a binary value of High or Low. In the present exemplary embodiment, when the output terminal 25 of the first inverter 61 is Low, i.e. when the output terminal 27 of the second inverter 62 is High, the light emitting element 20 is brought into a state that allows emission, whereas when the output terminal 25 of the first inverter 61 is High, i.e. when the output terminal 27 of the second inverter 62 is Low, the light emitting element 20 is brought into a state of non-emission.

In the present exemplary embodiment, the two inverters 61 and 62 constituting the memory circuit 60 are disposed between the first potential line (first high potential line 47) and the second potential line (low potential line 46), and VDD1 as the first potential and VSS as the second potential are supplied to the two inverters 61 and 62. Therefore, High corresponds to the first potential (VDD1), and Low corresponds to the second potential (VSS).

When a digital signal is stored in the memory circuit 60 such that a potential of the output terminal 25 of the first inverter 61 is Low, for example, Low is input to the input terminal 28 of the second inverter 62 and a potential of the output terminal 27 of the second inverter 62 becomes High. Then, High is input to the input terminal 26 of the first inverter 61 and the potential of the output terminal 25 of the first inverter 61 becomes Low. In such a manner, the digital signal stored in the memory circuit 60 is maintained in the stable state until the digital signal is rewritten next.

The first inverter 61 includes a third transistor 33 of the N-type and a fifth transistor 35 of the P-type, and has a CMOS configuration. The third transistor 33 and the fifth transistor 35 are disposed in series between the first potential line (first high potential line 47) and the second potential line (low potential line 46). A source of the third transistor 33 is electrically connected to the second potential line (low potential line 46). A source of the fifth transistor 35 is electrically connected to the first potential line (first high potential line 47).

The second inverter 62 includes a sixth transistor 36 of the P-type and a seventh transistor 37 of the N-type, and has a CMOS configuration. The sixth transistor 36 and the seventh transistor 37 are disposed in series between the first potential line (first high potential line 47) and the second potential line (low potential line 46). A source of the sixth transistor 36 is electrically connected to the first potential line (first high potential line 47). A source of the seventh transistor 37 is electrically connected to the second potential line (low potential line 46).

The output terminal 25 of the first inverter 61 is a drain of the third transistor 33 and the fifth transistor 35. The output terminal 27 of the second inverter 62 is a drain of the sixth transistor 36 and the seventh transistor 37. The input terminal 26 of the first inverter 61 is a gate of the third transistor 33 and the fifth transistor 35, and is electrically connected to the output terminal 27 of the second inverter 62. Similarly, the input terminal 28 of the second inverter 62 is a gate of the sixth transistor 36 and the seventh transistor 37, and is electrically connected to the output terminal 25 of the first inverter 61.

Note that, it is assumed in the present exemplary embodiment that both of the first inverter 61 and the second inverter 62 have the CMOS configuration, but these inverters 61 and 62 may be formed of a transistor and a resistor. For example, one of the third transistor 33 and the fifth transistor 35 in the first inverter 61 may be replaced with a resistor, or one of the sixth transistor 36 and the seventh transistor 37 in the second inverter 62 may be replaced with a resistor.

The light emitting element 20 is an organic EL element in the present exemplary embodiment, and includes an anode 21 as a pixel electrode, a light emitting section 22 as a light emission functional layer, and a cathode 23 as a counter electrode. The light emitting section 22 is configured to emit light by a part of energy being discharged as fluorescence or phosphorescence when an exciton is formed by a positive hole injected from the anode 21 side and an electron injected from the cathode 23 side and the exciton disappears (the positive hole recombines with the electron).

In the pixel circuit 41 according to Example 1, the light emitting element 20 is disposed between the first transistor 31 and the fourth transistor 34. The anode 21 of the light emitting element 20 is electrically connected to a drain of the fourth transistor 34. The cathode 23 of the light emitting element 20 is electrically connected to a drain of the first transistor 31.

The first transistor 31 is a drive transistor for the light emitting element 20. In other words, when the first transistor 31 is brought into the ON-state, the light emitting element 20 may emit light. A gate of the first transistor 31 is electrically connected to the output terminal 27 of the second inverter 62 in the memory circuit 60. A source of the first transistor 31 is electrically connected to the second potential line (low potential line 46). The drain of the first transistor 31 is electrically connected to the light emitting element 20 (cathode 23). In other words, the first transistor 31 of the N-type is disposed on the low potential side with respect to the light emitting element 20.

The fourth transistor 34 is a control transistor that controls light emission of the light emitting element 20. When the fourth transistor 34 is brought into the ON-state, the light emitting element 20 may emit light. As described later, in the present exemplary embodiment, the light emitting element 20 emits light when an active signal is supplied as a control signal to the enable line 44, the fourth transistor 34 is then brought into the ON-state, the output terminal 27 of the second inverter 62 reaches a potential corresponding to light emission, and the first transistor 31 is then brought into the ON-state.

A gate of the fourth transistor 34 is electrically connected to the enable line 44. A source of the fourth transistor 34 is electrically connected to the third potential line (second high potential line 49). The drain of the fourth transistor 34 is electrically connected to the light emitting element 20 (anode 21). In other words, the fourth transistor 34 of the P-type is disposed on the high potential side with respect to the light emitting element 20.

Herein, a source potential is compared with a drain potential and the one having a lower potential is a source in the N-type transistor. A source potential is compared with a drain potential and the one having a higher potential is a source in the P-type transistor. The N-type transistor is disposed on the low potential side with respect to the light emitting element 20. On the other hand, the P-type transistor is disposed on the high potential side with respect to the light emitting element 20. The N-type transistor and the P-type transistor are disposed with respect to the light emitting element 20 in such a manner, and thus each of the transistors can be operated almost linearly. Hereinafter, operating a transistor almost linearly is referred to as "simply operating linearly".

Preferably, a polarity of the first transistor 31 and a polarity of the fourth transistor 34 is opposite to each other. In Example 1, the first transistor 31 is of the N-type, the fourth transistor 34 is of the P-type, the first transistor 31 of the N-type is disposed on the low potential side with respect to the light emitting element 20, and the fourth transistor 34 of the P-type is disposed on the high potential site with respect to the light emitting element 20. Therefore, the first transistor 31 and the fourth transistor 34 can be linearly operated, and variations in threshold voltages of the first transistor 31 and the fourth transistor 34 can be prevented from affecting light emitting intensity of the light emitting element 20.

The source of the first transistor 31 is electrically connected to the second potential line (low potential line 46). The source of the fourth transistor 34 is electrically connected to the third potential line (second high potential line 49). A source potential of the first transistor 31 is fixed to the second potential. A source potential of the fourth transistor 34 is fixed to the third potential. In this way, even when a source-drain voltage of the first transistor 31 and that of the fourth transistor 34 are small, electric conductivity of the first transistor 31 in the ON-state and that of the fourth transistor 34 in the ON-state can be large. As a result, most of a potential difference between the third potential (VDD2) and the second potential (VSS) is applied to the light emitting element 20. Thus, the display characteristic is less likely to be affected by variations in the threshold voltages of the first transistor 31 and the fourth transistor 34, and uniformity of the light emitting intensity of the light emitting element 20 between the pixels 59, i.e. sub-pixels 58, can be improved.

The second transistor 32 is disposed between the input terminal 28 of the second inverter 62 constituting the memory circuit 60, and the data line 43. One of a source and a drain of the second transistor 32 of the N-type is electrically connected to the data line 43, and the other is electrically connected to the input terminal 28 of the second inverter 62 constituting the memory circuit 60, namely, electrically connected to the gates of the sixth transistor 36 and the seventh transistor 37, and moreover electrically connected to drains of the third transistor 33 and the fifth transistor 35. A gate of the second transistor 32 is electrically connected to the scan line 42.

The second complementary transistor 38 is disposed between the input terminal 26 of the first inverter 61 constituting the memory circuit 60 and the complementary data line 45. One of a source and a drain of the second complementary transistor 38 of the N-type is electrically connected to the complementary data line 45, and the other is electrically connected to the input terminal 26 of the first inverter 61 constituting the memory circuit 60, namely, electrically connected to the gates of the third transistor 33 and the fifth transistor 35, and moreover electrically connected to drains of the sixth transistor 36 and the seventh transistor 37. A gate of the second complementary transistor 38 is electrically connected to the scan line 42.

The electro-optical device 10 according to the present exemplary embodiment includes the plurality of complementary data lines 45 in the display region E (see FIG. 5). One data line 43 and one complementary data line 45 correspond to one pixel circuit 41. Signals complementary to each other are supplied to the data line 43 and the complementary data line 45 paired up with the data line 43 for one pixel circuit 41. In other words, a signal having a polarity reverse to a polarity of a signal supplied to the data line 43 is supplied to the complementary data line 45. Hereinafter, the signal having a polarity reverse is referred to as a reverse signal. For example, when High is supplied to the data line 43, Low is supplied to the complementary data line 45 paired up with the data line 43. When Low is supplied to the data line 43, High is supplied to the complementary data line 45 paired up with the data line 43.

The second transistor 32 and the second complementary transistor 38 are selection transistors for the pixel circuit 41. The gate of the second transistor 32 and the gate of the second complementary transistor 38 are electrically connected to the scan line 42. The second transistor 32 and the second complementary transistor 38 simultaneously switch between an ON-state and an OFF-state in response to a selection signal or a non-selection signal, which are scanning signals supplied to the scan line 42.

When the selection signal is supplied as the scanning signal to the scan line 42, the second transistor 32 and the second complementary transistor 38 are selected and are both brought into the ON-state. Then, there is continuity between the data line 43 and the input terminal 28 of the second inverter 62 in the memory circuit 60. At the same time, there is continuity between the complementary data line 45 and the input terminal 26 of the first inverter 61 in the memory circuit 60.

In this way, a digital image signal is written to the input terminal 28 of the second inverter 62 from the data line 43 via the second transistor 32. Further, a digital complementary image signal, which is a reverse signal of a digital image signal, is written to the input terminal 26 of the first inverter 61 from the complementary data line 45 via the second complementary transistor 38. As a result, the digital image signal and the digital complementary image signal are stored in the memory circuit 60.

The digital image signal and the digital complementary image signal stored in the memory circuit 60 are maintained in a stable state until the second transistor 32 and the second complementary transistor 38 are selected next and are both brought into the ON-state and the digital image signal and the digital complementary image signal are newly written over the data line 43 and the complementary data line 45, respectively.

It is preferable to satisfy the first condition that an ON-resistance of the second transistor 32 is lower than those of the third transistor 33 and the fifth transistor 35. Conductive-types and dimensions such as gate length and gate width of these transistors, a drive condition such as a potential vale when the scanning signal is the selection signal, and the like are determined to satisfy this first condition. Similarly, it is preferable to satisfy the second condition that an ON-resistance of the second complementary transistor 38 is lower than those of the sixth transistor 36 and the seventh transistor 37. Conductive-types and dimensions such as gate length and gate width of these transistors, a drive condition such as a potential vale when the scanning signal is the selection signal, and the like are determined to satisfy this second condition. In this way, a signal stored in the memory circuit 60 can be rewritten quickly and reliably.

The electro-optical device 10 according to the present exemplary embodiment further includes the plurality of enable lines 44 in the display region E. The gate of the fourth transistor 34 is electrically connected to the enable line 44. The fourth transistor 34 being a control transistor for the light emitting element 20 switches between the ON-state and the OFF-state in response to an active signal or a inactive signal, which are control signals supplied to the enable line 44.

When the active signal is supplied as the control signal to the enable line 44, the fourth transistor 34 is turned into the ON-state. While the fourth transistor 34 is in the ON-state, the light emitting element 20 can emit light. On the other hand, when the inactive signal is supplied as the control signal to the enable line 44, the fourth transistor 34 is turned into the OFF-state and the light emitting element 20 does not emit light. While the fourth transistor 34 is in the OFF-state, a stored image signal can be rewritten without causing the memory circuit 60 to malfunction. This point will be described below.

In the present exemplary embodiment, the enable line 44 and the scan line 42 are independent of each other for each of the pixel circuits 41, and thus the second transistor 32 and the fourth transistor 34 operate while being independent of each other. As a result, while the fourth transistor 34 is in the OFF-state, the second transistor 32 can be turned into the ON-state.

In other words, when an image signal is written into the memory circuit 60, the second transistor 32 and the second complementary transistor 38 are tuned into the ON-state after the fourth transistor 34 is turned into the OFF-state, and an image signal and a reverse signal of the image signal are supplied to the memory circuit 60. The fourth transistor 34 is in the OFF-state while the second transistor 32 is in the ON-state. Thus, the light emitting element 20 does not emit light while an image signal is written into the memory circuit 60. In this way, grey-scale by time division is accurately expressed.

After the image signal is written into the memory circuit 60, the second transistor 32 and the second complementary transistor 38 are turned into the OFF-state and then the fourth transistor 34 is turned into the ON-state to cause the light emitting element 20 to emit light. Upon this situation, if the first transistor 31 is in the ON-state, an electric current path is formed from the third potential line (second high potential line 49) to the second potential line (low potential line 46) through the fourth transistor 34, the light emitting element 20, and the first transistor 31, and thus an electric current flows to the light emitting element 20.

When the fourth transistor 34 is in the ON-state, the second transistor 32 and the second complementary transistor 38 are in the OFF-state. Thus, an image signal and a reverse signal of the image signal are not supplied to the memory circuit 60 while the light emitting element 20 emits light. In this way, an image signal stored in the memory circuit 60 is not mistakenly rewritten, and high-quality image display without false display is achieved.

Relationship Between Each Potential and Threshold Voltage of Transistor

As described above, in the present exemplary embodiment, the first potential (VDD1) and the second potential (VSS) constitute the low-voltage power-supply, and the third potential (VDD2) and the second potential (VSS) constitute the high-voltage power-supply. With such a configuration, the electro-optical device 10 that operates at a high speed and achieves bright state is achieved. This point will be described below.

In the following description, the first potential is expressed as V1 (V1=3.0 V as one example), the second potential is expressed as V2 (V2=0 V as one example), and the third potential is expressed as V3 (V3=7.0 V as one example). In the present exemplary embodiment, a potential difference (V1−V2=3.0 V) between the first potential and the second potential, which is a voltage of the low-voltage power-supply, is smaller than a potential difference (V3−V2=7.0 V) between the third potential and the second potential, which is a voltage of the high-voltage power-supply (V1−V2<V3−V2).

With each of the potentials being set as described above, the low-voltage power-supply supplied with the first potential and the second potential causes the drive circuit 51 and the memory circuit 60 to operate at high speed because of scaling-down of transistors constituting the drive circuit 51 and the memory circuit 60. On the other hand, the high-voltage power-supply supplied with the third potential and the second potential causes the light emitting element 20 to emit bright light. In other words, the configuration of the present exemplary embodiment enables each of the circuits to operate at high speed and achieves the electro-optical device 10 in which the light emitting element 20 emits light at high intensity.

The light emitting element such as an organic EL element generally requires a relatively high voltage (for example, 5 V or higher) to emit light. However, in a semiconductor device, increasing the power-supply voltage necessitates increasing the transistor dimensions such as gate length L and gate width W in order to prevent operational failures, resulting in the slow operation of circuits. On the other hand, decreasing the power-supply voltage in order to operate circuits at high speeds leads to a decreased light emitting intensity of the light emitting element. In other words, in a typical configuration in prior art, in which a power-supply voltage is used both for emission of the light emitting element and for operation of circuits, it is difficult to achieve both high light emitting intensity of the light emitting element and high-speed operation of the circuits.

In contrast, in the present exemplary embodiment the electro-optical device 10 possesses a low-voltage power-supply and a high-voltage power-supply and the low-voltage power-supply is used for the operation of the drive circuit 51 and the memory circuit 60. This enables us to reduce the dimensions of the transistors constituting the drive circuit 51 and the memory circuit 60, such that L=approximately 0.5 micrometers (μm). This is smaller than L=approximately 0.75 micrometers (μm) of the first transistor 31 and the fourth transistor 34. Therefore the drive circuit 51 and the memory circuit 60 are driven at a low voltage of V1−V2=3.0 V and operate at a high speed.

Then, the high-voltage power-supply causes the light emitting element 20 to emit light at a high voltage of V3−V2=7.0 V, and thus the light emitting element 20 can be caused to emit light at high intensity. Furthermore, as described later, the first transistor 31 and the fourth transistor 34 disposed in series with the light emitting element 20 are linearly operated, and thus most of a high voltage of V3−V2=7.0 V can be applied to the light emitting element 20. Accordingly, intensity of light emitted by the light emitting element 20 can be further increased.

In the present exemplary embodiment, a threshold voltage ($V_{th1}$) of the first transistor 31 serving as a drive transistor is positive ($0<V_{th1}$). When an image signal stored in the memory circuit 60 corresponds to non-light emission, a potential of the output terminal 27 in the memory circuit 60 is Low, i.e., the second potential (V2). The source of the first transistor 31 is connected to the second potential line (low potential line 46). This means that the source potential and a gate potential of the first transistor 31 are both correspond to the second potential (V2). As a result, a gate-source voltage $V_{gs1}$ of the first transistor 31 is 0 V.

Therefore, if the threshold voltage $V_{th1}$ ($V_{th1}$=0.36 V as one example) of the first transistor 31 is positive ($0<V_{th1}$), the gate-source voltage $V_{gs1}$ of the first transistor 31 of the N-type will be smaller than the threshold voltage $V_{th1}$, and thus the first transistor 31 will be in the OFF-state when the image signal corresponds to non-light emission. In this way, when an image signal represents non-light emission, the first transistor 31 is reliably in the OFF-state.

In the present exemplary embodiment, a potential difference between the first potential (V1) and the second potential (V2) is greater than the threshold voltage $V_{th1}$ of the first transistor 31 ($V_{th1}$<V1−V2). When an image signal stored in the memory circuit 60 corresponds to emission, the potential of the output terminal 27 in the memory circuit 60 is High. High is the first potential (V1), and thus the gate-source voltage $V_{gs1}$ of the first transistor 31 is equal to the potential difference between the first potential (V1) and the second potential (V2) ($V_{gs1}$=V1−V2=3.0 V−0 V=3.0 V).

In a case where the potential difference (V1−V2=3.0 V) between the first potential (V1) and the second potential (V2) is greater than the threshold voltage $V_{th1}$ ($V_{th1}$=0.36 V) of the first transistor 31 ($V_{th1}$<V1−V2), the gate-source voltage $V_{gs1}$ of the first transistor 31 of the N-type is greater than the threshold voltage $V_{th1}$ when a potential of the output terminal 27 in the memory circuit 60 is High, and the first transistor 31 is in the ON-state. Thus, the first transistor 31 is reliably placed in the ON-state when the image signal represents emission.

The gate of the fourth transistor 34 is electrically connected to the enable line 44. The fourth transistor 34 serves as a control transistor. This transistor will be in the OFF-state when being supplied with the inactive signal as the control signal from the enable line 44 and will be in the ON-state when being supplied with the active signal. In the present exemplary embodiment (Example 1), the fourth transistor 34 is of the P-type. As described above, the inactive signal is set to a higher potential, i.e. the third potential (V3) or higher, and is preferably set to the third potential (V3). In addition, the active signal is set to a lower potential, i.e. V3−(V1−V2) or lower, and is preferably set to the second potential (V2).

When the inactive signal with the third potential (V3) is supplied from the enable line 44 to the gate of the fourth transistor 34, both of the source potential and a gate potential of the fourth transistor 34 are at the third potential (V3), and a gate-source voltage $V_{gs4}$ of the fourth transistor 34 then becomes 0 V. With a threshold voltage $V_{th4}$ ($V_{th4}$=−0.36 V as one example) of the fourth transistor 34 of the P-type, the gate-source voltage $V_{gs4}$ of the fourth transistor 34 is greater than the threshold voltage $V_{th4}$, and the fourth transistor 34 is then in the OFF-state. Therefore, when the control signal is the inactive signal, the fourth transistor 34 is reliably in the OFF-state.

When the active signal with a potential of V3−(V1−V2) or lower, e.g. 7.0 V−(3.0 V−0 V)=4.0 V or lower, is supplied from the enable lines 44 to the gate of the fourth transistor 34, the gate-source voltage $V_{gs4}$ of the fourth transistor 34 is −(V1−V2) or lower, e.g. 4.0−7.0 V=−3.0 V or lower. Therefore, the gate-source voltage $V_{gs4}$ of the fourth transistor 34 is sufficiently smaller than the threshold voltage $V_{th4}$. When the control signal is the active signal, the fourth transistor 34 is reliably in the ON-state.

The lower the potential of the active signal, the larger the gate-source voltage $V_{gs4}$ of the fourth transistor 34 in the ON-state. If the potential of the active signal is set to the second potential (V2), the gate-source voltage $V_{gs4}$ of the fourth transistor 34 at the active state is as large as V2−V3, e.g. 0 V−7.0 V=−7.0 V, resulting in a low ON-resistance of the fourth transistor 34. This causes smaller influence of display quality on variations in a threshold voltage of the fourth transistor 34 during the light emitting element 20 being emitting light.

Among the three kinds of the existing potentials, namely first potential, second potential, and third potential, the highest, the third potential (V3), is set to the inactive signal and the lowest, the second potential (V2), is set to the active signal. This eliminates an introduction of additional potential (potential line) for the inactive and active signals. This also causes a sufficiently large absolute value of the gate-source voltage of the fourth transistor 34 when it receives the active signal and a sufficiently low ON-resistance of the fourth transistor 34. Therefore, even when variations in a threshold voltage are present in the fourth transistors 34, their negative effects on light emitting intensity of the light emitting elements are sufficiently suppressed.

In other words, in the configuration of the present exemplary embodiment, only with two kinds of electrical systems of the low-voltage power-supply and the high-voltage power-supply, the non-light emission is reliably achieved by turning the first transistor 31 and the fourth transistor 34 into the OFF-state when the light emitting element 20 does not need to emit light, and the light emission is reliably achieved by turning the first transistor 31 and the fourth transistor 34 into the ON-state when the light emitting element 20 needs to emit light.

The gate of the second transistor 32 is electrically connected to the scan line 42. The second transistor 42 serves as a selection transistor. This transistor will be in the OFF-state when being supplied with the non-selection signal from the scan line 42 and will be in the ON-state when being supplied with the selection signal. In the present exemplary embodiment, the second transistor 32 is of the N-type. As described above, the non-selection signal is set to a lower potential, i.e. the second potential (V2) or lower, and is preferably set to the second potential (V2). In addition, the selection signal is set to a higher potential, i.e. the first potential (V1) or higher, and is preferably set to the third potential (V3).

It is preferable that the first transistor 31 and the second transistor 32 are the same conductive type. In the first exemplary embodiment, both of the first transistor 31 and the second transistor 32 are of the N-type. Therefore, when a potential of an image signal supplied to the gate of the first transistor 31 is High, the first transistor 31 is in the ON-state. When a scanning signal supplied to the gate of the second transistor 32 is the selection signal (High), the second transistor 32 is in the ON-state. An image signal of High is the first potential (V1). The selection signal (High) is set to the first potential (V1) or higher, and preferably be set to the third potential (V3).

Setting a potential of the selection signal with the third potential (V3) and rewriting an image signal in the memory circuit 60 from Low to High will be described herein. Before an image signal is rewritten, the low, i.e. the second potential (V2), is the input terminal 28 of the second inverter 62, which is the output terminal 25 of the first inverter 61 and which is electrically connected to either of the source and the drain of the second transistor 32. When the selection signal with the third potential (V3) is supplied from the scan lines 42 to the gate of the second transistor 32, a gate-source voltage $V_{gs2}$ of the second transistor 32 becomes V3−V2=7.0 V−0 V=7.0 V. The value is greater than a threshold voltage $V_{th2}$ of the second transistor 32, e.g. $V_{th2}$=0.36 V and the second transistor 32 is thus turned into the ON-state.

While an image signal of High (V1) is written into the memory circuit 60 from the data lines 43, a potential of the output terminal 25 of the first inverter 61 gradually rises from Low (V2) to High (V1). Along with this, the gate-source voltage $V_{gs2}$ of the second transistor 32 is gradually lowered to V3−V1=7.0 V−3.0 V=4.0 V. Even when the gate-source voltage $V_{gs2}$ of the second transistor 32 reaches the lowest value of 4.0 V, the gate-source voltage $V_{gs2}$ is still sufficiently larger than the threshold voltage $V_{th2}$ of the second transistor 32. Therefore, until an image signal is completely written into the memory circuit 60, the ON-resistance of the second transistor 32 is kept low. The image signal is thus securely written into the memory circuit 60.

Here tentatively assumes a case when the second transistor 32 is a P-type second transistor 32A, with the second transistor 32 having a characteristic opposite to that of the first transistor 31. In this case, the second transistor 32A is brought into the ON-state when the selection signal is Low. When a potential of the selection signal is set to the second potential (V2), when an image signal in the memory circuit 60 is rewritten from High to Low, and when the selection signal with the second potential (V2) is supplied over each of the scan lines 42, a gate-source voltage $V_{gs2}$ of the second transistor 32A becomes V2−V1=0 V−3.0 V=−3.0 V. This value is lower than a threshold voltage $V_{th2}$ of the second transistor 32A (e.g., $V_{th2}$=−0.36 V). The second transistor 32A is thus brought into the ON-state.

When an image signal with Low (V2) is written over each of the data lines 43 into the memory circuit 60, a potential of the input terminal 28 of the second inverter 62 gradually decreases from High (V1), and the gate-source voltage $V_{gs2}$ of the second transistor 32A gradually increases from −3.0 V. As a result, before the potential of the input terminal 28 reaches the second potential (V2), the potential reaches the threshold voltage $V_{th2}$ of the second transistor 32A of the P-type. The second transistor 32A is thus brought into the OFF-state.

Before the second transistor 32A is brought into the OFF-state, as the gate-source voltage $V_{gs2}$ increases and approaches to the threshold voltage $V_{th2}$, an ON-resistance of the second transistor 32A increases. This would cause rewriting of an image signal into the memory circuit 60 to a take certain time, or may lead to erroneous rewriting. To avoid this, the potential of the selection signal is set to a further lower potential. In this case, however, another potential line different from the potential would be further required.

As described in the first exemplary embodiment, the polarity of the first transistor 31 and the polarity of the second transistor 32 are identical to each other, i.e., are both the N-type, setting a potential of the selection signal with the third potential that is highest between the first potential and the third potential eliminates provision of a new potential line. When the second transistor 32 is brought into the ON-state, and an image signal is written into the memory circuit 60, the gate-source voltage $V_{gs2}$ of the second transistor 32 can be increased. Even when an image signal is written, and a source potential increases, the ON-resistance of the second transistor 32 can be kept lower. Therefore, the image signal can be written and rewritten promptly and securely into the memory circuit 60.

From the above-described results, a relationship between each of the preferable potentials (V1, V2, and V3) in the present exemplary embodiment and the threshold voltage ($V_{th1}$) of the first transistor 31 is expressed by Expression 2 and Expression 3.

Expression 2

$$0<Vth1 \tag{2}$$

Expression 3

$$V2+Vth1<V1<V3 \tag{3}$$

Characteristics of Transistor

Next, characteristics of a transistor provided in the electro-optical device 10 according to the present exemplary embodiment will be described. In the electro-optical device 10 according to the present exemplary embodiment, the first transistor 31 and the fourth transistor 34 are disposed in series with the light emitting element 20 between the third potential line (second high potential line 49) and the second potential line (low potential line 46) constituting the high-voltage power-supply. Further, preferably, an ON-resistance of the first transistor 31 may also be sufficiently lower than an ON-resistance of the light emitting element 20. Further, preferably, the ON-resistance of the fourth transistor 34 may also be sufficiently lower than the ON-resistance of the light emitting element 20.

The expression of "sufficiently low" represents a drive condition for linearly operating the first transistor 31 and the fourth transistor 34, and specifically represents a state where the ON-resistance of the first transistor 31 and the ON-resistance of the fourth transistor 34 are each less than or equal to 1/100, preferably, less than or equal to 1/1000 of the ON-resistance of the light emitting element 20. In this way, when the light emitting element 20 emits light, the first transistor 31 and the fourth transistor 34 can be linearly operated.

As a result, most of a potential drop occurring in the first transistor 31, the fourth transistor 34, and the light emitting element 20 connected in series with each other is applied to the light emitting element 20. Thus, when the light emitting element 20 emits light, variations in threshold voltages of both of the transistors 31 and 34 have a smaller influence. In other words, with such a configuration, an influence of variations in threshold voltages of the first transistor 31 and the fourth transistor 34 can be reduced, and thus variations in luminance and unevenness in grey-scale between the pixels 59, i.e., sub-pixels 58, can be suppressed and image display having excellent uniformity can be achieved.

The reason is that a potential drop in both of the transistors 31 and 34 is less than or equal to 1% of a power supply voltage while the light emitting element 20 receives greater than or equal to 99% of the power supply voltage by setting the ON-resistance of the first transistor 31 and the fourth transistor 34 to be less than or equal to 1/100 of the ON-resistance of the light emitting element 20. Since both of the transistors 31 and 34 have a small potential drop of less than or equal to 1%, variations in threshold voltages of both of the transistors 31 and 34 have a smaller influence on a light emission characteristic of the light emitting element 20.

In the present exemplary embodiment (Example 1), a series resistance of the first transistor 31 and the fourth transistor 34 is approximately 1/1000 of the ON-resistance of the light emitting element 20. In this case, since the light emitting element 20 receives approximately 99.9% of a power supply voltage and both of the transistors 31 and 34 have a potential drop of approximately 0.1%, an influence of variations in threshold voltages of both of the transistors 31 and 34 on the light emission characteristic of the light emitting element 20 is almost negligible.

The ON-resistance of a transistor depends on the polarity, gate length, gate width, threshold voltage, gate-insulating-film thickness, and the like of the transistor. In the present exemplary embodiment, a polarity, a gate length, a gate width, a threshold voltage, a gate-insulating-film thickness, and the like of both of the transistors 31 and 34 may be determined in such a way that the ON-resistance of the first transistor 31 and the fourth transistor 34 is sufficiently lower than the ON-resistance of the light emitting element 20. This point will be described below.

In the present exemplary embodiment, the organic EL element is used in the light emitting element 20, and the transistors such as the first transistor 31 and the fourth transistor 34 are formed on the element substrate 11 formed of a single crystal silicon substrate. A voltage-current characteristic of the light emitting element 20 is roughly expressed by Expression 4 below:

Expression 4

$$I_{EL} = L_{EL} W_{EL} J_0 \left\{ \exp\left( \frac{V_{EL} - V_0}{V_{tm}} \right) - 1 \right\} \tag{4}$$

In Expression 4, $I_{EL}$ is a current flowing through the light emitting element 20, $V_{EL}$ is a voltage applied to the light emitting element 20, $L_{EL}$ is a length of the light emitting element 20 in a plan view, $W_{EL}$ is a width of the light emitting element 20 in the plan view, $J_0$ is a current density coefficient of the light emitting element 20, $V_t$, is a coefficient voltage having a temperature dependence of the light emitting element 20, and $V_0$ is a threshold voltage of light emission of the light emitting element 20. Here, $V_{tm}$ is a certain voltage at a certain temperature.

Note that, when a voltage of the high-voltage power-supply is expressed as $V_P$ and a potential drop occurring in the first transistor 31 and the fourth transistor 34 is expressed as $V_{ds}$, $V_{EL}+V_{ds}=V_P$. In the present exemplary embodiment, $L_{EL}$=11 micrometers (μm), $W_{EL}$=3 micrometers (μm), $J_0$=1.449 milliamperes per square centimeters (mA/cm$^2$), $V_0$=3.0 volts (V), and $V_{tm}$=0.541 volt (V).

On the other hand, when the first transistor 31 and the fourth transistor 34 are expressed as an i-th transistor (i is 1 or 4), a drain current $I_{dsi}$ of the i-th transistor is expressed by Expression 5 below.

Expression 5

$$I_{dsi} = \frac{W_i}{L_i} \cdot \frac{\varepsilon_0 \varepsilon_{ox}}{t_{oxi}} \cdot \mu_i (V_{gsi} - V_{thi}) V_{dsi} \equiv Z_i (V_{gsi} - V_{thi}) V_{dsi} \tag{5}$$

In Expression 5, $W_i$ is the gate width of the i-th transistor, $L_i$ is the gate length of the i-th transistor, $\varepsilon_0$ is the permittivity of vacuum, $\varepsilon_{ox}$ is the permittivity of a gate insulating film, $t_{oxi}$ is the thickness of the gate insulating film, $\mu_i$ is the mobility of the i-th transistor, $V_{gsi}$ is the gate voltage, $V_{dsi}$ is the drain voltage at a potential drop by the i-th transistor, and $V_{thi}$ is the threshold voltage of the i-th transistor.

In Example 1, $W_1$=1.0 micrometer (μm), $W_4$=1.25 micrometers (μm), $L_1=L_4$=0.75 micrometers (μm), $t_{ox}$=20 nanometers (nm), $\mu_1$=240 square centimeters per volt per second (cm$^2$/V·s), $\mu_4$=150 square centimeters per volt per second (cm$^2$/V·s), $V_{th1}$=0.36 V, $V_{th4}$=−0.36 V, $V_{gs1}$=V1−V2=3.0 V, and $V_{gs4}$=V2−V3=−7 V.

Note that, when the first transistor 31 and the fourth transistor 34 are linearly operated, a voltage-current characteristic of the light emitting element 20 approximates Expression 6 below around $V_{ds}$=0 V by using a potential drop $V_{ds}$ of both of the transistors 31 and 34.

Expression 6

$$I_{EL} = -V_{ds} + I_0 \tag{6}$$

In Example 1, the coefficient k defined by Expression 6 is k=1.39×10$^{-6}$ (Ω$^{-1}$). $I_0$ is the amount of current when all voltage $V_P$ of the high-voltage power-supply applies to the light emitting element 20, and $I_0$=7.82×10$^{-7}$ (A).

Given this, the voltage at which the light emitting element 20 emits light is a voltage that satisfies $I_{EL}=I_{ds}$ using Expressions 4 and 6. In the present exemplary embodiment, $V_P$=V3−V2=7 V, $V_{ds1}$=0.0053 V, $V_{ds4}$=0.0027 V, $V_{EL}$=6.9920 V, and $I_{EL}=I_{ds1}=I_{ds4}$=7.672×10$^{-7}$ A. The ON-resistance of the first transistor 31 at this time is 6.859×10$^3$Ω, the ON-resistance of the fourth transistor 34 is 3.491×10$^3$Ω, and the ON-resistance of the light emitting element 20 is 9.113×10$^6$Ω.

Therefore, the ON-resistance of the first transistor 31 is approximately 1/1300 lower than 1/1000 of the ON-resistance of the light emitting element 20, and the ON-resistance of the fourth transistor 34 is approximately 1/2600 lower than 1/1000 of the ON-resistance of the light emitting element 20. Thus, most of the voltage of the high-voltage power-supply could be applied to the light emitting element 20.

Under this condition, even when a threshold voltage of a transistor fluctuates by greater than or equal to 30% (even when $V_{th1}$ and $V_{th4}$ fluctuate between 0.29 V and 0.53 V in Example 1), $V_{EL}$=6.99 V and $I_{EL}=I_{ds1}=I_{ds4}=7.67\times10^{-7}$ A are invariable. More specifically, even when $V_{th1}$ and $V_{th4}$ fluctuate between 0.29 V and 0.53 V, $V_{EL}$, $I_{EL}=I_{ds1}=I_{ds4}$ are invariable. Typically, the threshold voltage of the transistor does not greatly vary in such a manner. Therefore, the ON-resistance of the fourth transistor 34 is reduced to be lower than or equal to approximately 1/1000 of the ON-resistance of the light emitting element 20, and thus variations in threshold voltages of the first transistor 31 and the fourth transistor 34 do not substantially affect light emitting intensity of the light emitting element 20.

By simultaneously solving Expression 5 and Expression 6 with $I_{EL}=I_{dsi}$, the effect of variation in the threshold voltage of the i-th transistor on the current $I_{EL}=I_{dsi}$ can be approximated by Expression 7 below:

Expression 7

$$\left(1+\frac{k}{Z_i(V_{gsi}-V_{thi})}\right)I_{EL}=I_0 \tag{7}$$

Since $I_0$ is the amount of current when all the voltage $V_P$ of the high-voltage power-supply applies to the light emitting element 20, the gate voltage $V_{gsi}$ and $Z_i$ may be increased to cause the light emitting element 20 to emit light around the power supply voltage $V_P$ as seen from Expression 7. In other words, the light emitting intensity of the light emitting element 20 becomes less susceptible to variation in the threshold voltage of a transistor as $Z_i$ increases.

Since $k/Z_1=2.52\times10^{-2}$ V and $k/Z_4=3.22\times10^{-2}$ V have small values in Example 1, the second term on the left side of Expression 7 is $k/(Z_1(V_{gs1}-V_{th1}))=0.01$ for the first transistor 31 and $k/(Z_4(V_{gs4}-V_{th4}))=0.005$ for the fourth transistor 34, and is thus less than approximately 0.01 (1%). As a result, a current flowing to the light emitting element 20 for controlling light emitting intensity is not hardly affected by the threshold voltage of both of the transistors 31 and 34. In other words, variations in threshold voltages ($V_{th1}$ and $V_{th4}$) of both of the transistors 31 and 34 affecting the light emitting intensity of the light emitting element 20 can be substantially eliminated by setting a value of $k/(Z_i(V_{gsi}-V_{thi}))$ to be less than approximately 0.01 (1%).

In Expression 7, k and $Z_i$ are defined by Expressions 5 and 6. Note that, since a mobility $\mu_i$ in the P-type transistor is smaller than a mobility $\mu_i$ in the N-type transistor, W of the P-type transistor is set to be greater than W of the N-type transistor. In the present exemplary embodiment, $W_3$ of the P-type transistor is set to be greater than $W_1$ of the N-type transistor, and $Z_4$ of the fourth transistor 34 of the P-type is set to be substantially identical to $Z_1$ of the first transistor 31 of the N-type.

The gate voltage $V_{gsi}$ may preferably be as high as possible in order to cause emission of the light emitting element 20 near the power supply voltage V. In the present exemplary embodiment (Example 1), the gate-source voltage $V_{gs4}$ of the fourth transistor 34 is increased by setting a potential of the active signal, which is the control signal, in the active state to the second potential (V2), while the third potential (V3) is set as the source potential of the fourth transistor 34.

In the electro-optical device 10 according to the present exemplary embodiment, between the first potential line (first high potential line 47) and the second potential line (low potential line 46) constituting the low-voltage power-supply, the third transistor 33 and the fifth transistor 35 constituting the first inverter 61 included in the memory circuit 60, and the sixth transistor 36 and the seventh transistor 37 constituting the second inverter 62 are disposed.

The transistors 33, 35, 36, and 37 each use a current that is less in amount than a current flowing into the first transistor 31 and the fourth transistor 34 operating with the high-voltage power-supply. An area of a channel forming region can be reduced. In other words, the memory circuit 60 can be made finer. When the area of the channel forming region in each of the transistors 33, 35, 36, and 37 is smaller, a transistor capacity can be reduced, achieving prompt charging and discharging. In other words, an image signal can be promptly written and rewritten into the memory circuit 60.

In the present exemplary embodiment, a gate length, when viewed in plan, of each of the third transistor 33, the fifth transistor 35, the sixth transistor 36, and the seventh transistor 37 included in the memory circuit 60 is shorter than a gate length, when viewed in plan, of each of the first transistor 31 and the fourth transistor 34 disposed in series with the light emitting element 20.

The gate length, when viewed in plan, of each of the third transistor 33, the fifth transistor 35, the sixth transistor 36, and the seventh transistor 37 is $L_3=L_5=L_6=L_7=0.5$ micrometers (μm). As described above, the gate length, when viewed in plan, of each of the first transistor 31 and the fourth transistor 34 is $L_1=L_4=0.75$ micrometers (μm). The gate length of each of the third transistor 33, the fifth transistor 35, the sixth transistor 36, and the seventh transistor 37 is shorter.

In the present exemplary embodiment, the area of the channel forming region, when viewed in plan, of each of the third transistor 33, the fifth transistor 35, the sixth transistor 36, and the seventh transistor 37 is smaller than an area of a channel forming region, when viewed in plan, of the first transistor 31 and the fourth transistor 34. An area of a channel forming region of a transistor is substantially equal to an area of a gate electrode disposed opposite to each other, i.e., is substantially equal to a product of a gate length and a gate width when viewed in plan.

A gate width of each of the third transistor 33 and the seventh transistor 37 of the N-type is $W_3=W_7=0.5$ micrometers (μm). A gate width of each of the fifth transistor 35 and the sixth transistor 36 of the P-type is $W_5=W_6=0.75$ micrometers (μm). Therefore, the area of the channel forming region of each of the third transistor 33 and the seventh transistor 37 is 0.5×0.5=0.25 square-micrometers ($\mu m^2$). The area of the channel forming region of each of the fifth transistor 35 and the sixth transistor 36 is 0.5×0.75=0.375 square-micrometers ($\mu m^2$).

As described above, the gate width of the first transistor 31 is $W_1=1.0$ micrometer (μm). The area of the channel forming region of the first transistor 31 is 0.75×1.0=0.75 square-micrometers ($\mu m^2$). The gate width of the fourth transistor 34 is $W_4=1.25$ micrometers (μm). The area of the channel forming region of the fourth transistor 34 is 0.75×1.25=0.9375 square-micrometers ($\mu m^2$). Therefore, the area of the channel forming region of each of the third transistor 33, the fifth transistor 35, the sixth transistor 36, and the seventh transistor 37 is smaller.

As described above, in the present exemplary embodiment, the area of the channel forming region of each of the transistors 33, 35, 36, and 37 included in the memory circuit 60 is reduced smaller than the area of the channel forming region of each of the transistors 31 and 34 disposed in series with the light emitting element 20. The memory circuit 60 can be made finer, and can be operated at a higher speed. The light emitting element 20 can emit light at higher intensity.

Method for Driving Pixel Circuit

Figure 9:
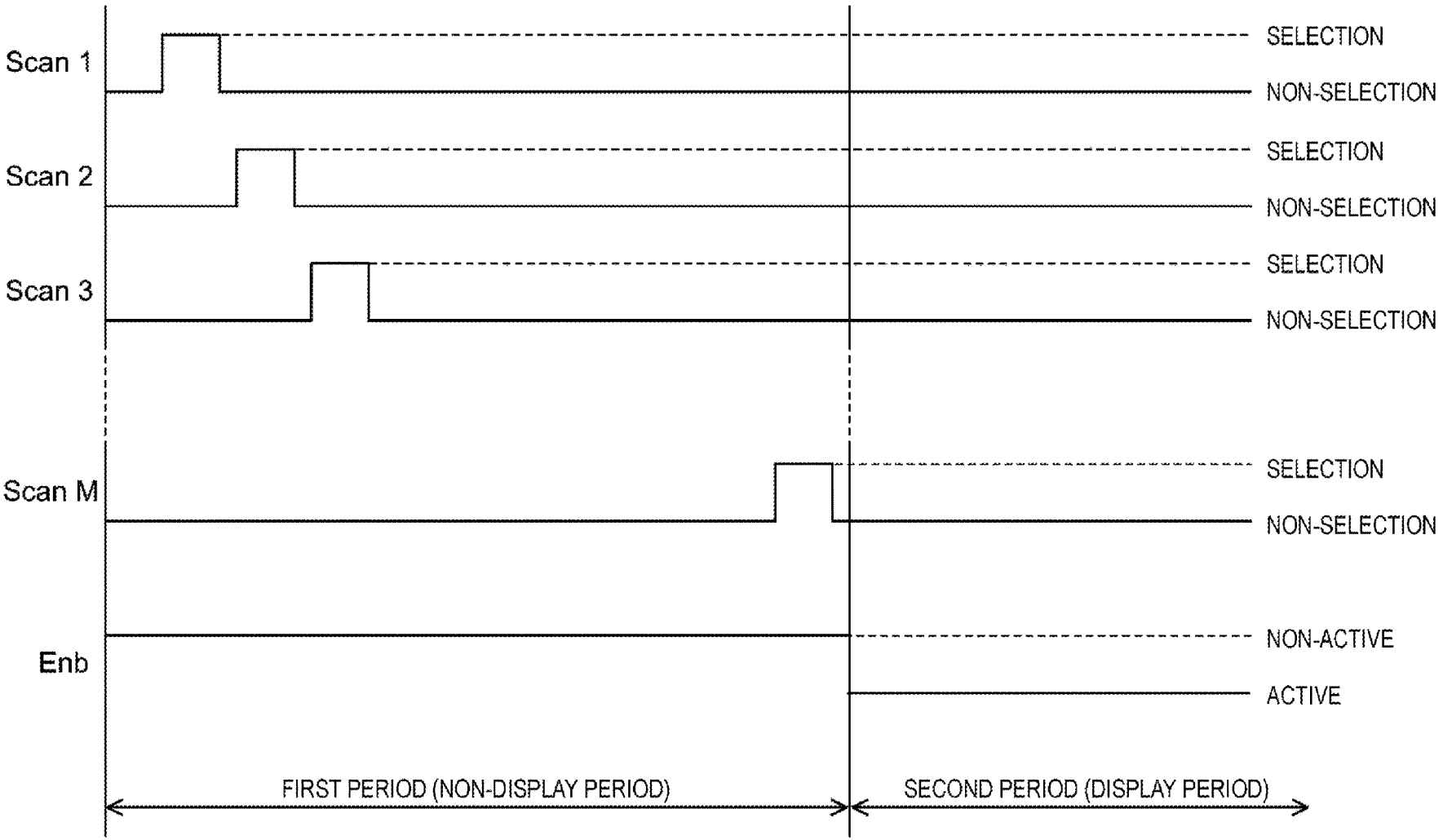
FIG. 9 illustrates a diagram for describing a method for driving a pixel circuit according to the present exemplary embodiment.

Next, a method for driving a pixel circuit in the electro-optical device 10 according to the present exemplary embodiment will be described with reference to FIG. 9. FIG. 9 is a diagram illustrating a method for driving a pixel circuit according to the present exemplary embodiment. In FIG. 9, the horizontal axis is a time axis and includes a first period, which is a non-display period, and a second period, which is a display period. The first period corresponds to P1 indicated by P1-1 to P1-6 illustrated in FIG. 7. The second period corresponds to P2 indicated by P2-1 to P2-6 illustrated in FIG. 7.

In the vertical axis in FIG. 9, Scan 1 to Scan M represent scanning signals supplied to the respective scan lines 42 from the first row to the M-th row of the M scan lines 42 (see FIG. 5). The scanning signal includes a selection signal, which is a scanning signal, in a selection state and a non-selection signal, which is a scanning signal, in a non-selection state. Enb represents a control signal supplied to the enable line 44 (see FIG. 5). The control signal includes an active signal, which is a control signal in an active state and an inactive signal, which is a control signal, in an inactive signal.

As described with reference to FIG. 7, one field (F) during which a single image is displayed is divided into a plurality of subfields (SFs), and each of the subfields (SFs) includes the first period, which is a non-display period, and the second period, which is a display period, starting after the first period ends. The first period is a signal-writing period during which an image signal is written to the memory circuit 60 (see FIG. 8) in each of the pixel circuits 41 (see FIG. 5) located in the display region E. The second period is a period during which the light emitting element 20 (see FIG. 8) can emit light in each of the pixel circuits 41 located in the display region E.

As illustrated in FIG. 9, in the electro-optical device 10 according to the present exemplary embodiment, an inactive signal is supplied as the control signal to all of the enable lines 44 during the first period. When the inactive signal is supplied to the enable lines 44, the fourth transistors 34 (see FIG. 8) are brought into the OFF-state, and the light emitting elements 20 in all of the pixel circuits 41 located in the display region E are then brought into a state of not emitting light.

During the first period, a selection signal is supplied as the scanning signal to any of the scan lines 42 in each of the subfields (SFs). When the selection signal is supplied to the scan line 42, the second transistor 32 and the second complementary transistor 38 (see FIG. 8) are brought into the ON-state in the selected pixel circuit 41. In this way, an image signal is written to the memory circuit 60 from the data line 43 and the complementary data line 45 (see FIG. 8) in the selected pixel circuit 41. In this way, the image signal is written to and stored in the memory circuit 60 in each pixel circuit 41 during the first period.

During the second period, an active signal is supplied as the control signal to all of the enable lines 44. When the active signal is supplied to the enable lines 44, the fourth transistors 34 are brought into the ON-state, and the light emitting elements 20 in all of the pixel circuits 41 located in the display region E are then brought into a state of being likely to emit light. During the second period, a non-selection signal for bringing the second transistors 32 into the OFF-state is supplied as the scanning signal to all of the scan lines 42. In this way, an image signal written in the subfield (SF) is maintained in the memory circuit 60 of each of the pixel circuits 41.

As described above, the first period, which is a non-display period, and the second period, which is a display period, can be controlled independently in the present exemplary embodiment, such that grey-scale display by digital time division driving can be achieved. As a result, the second period can be set to be shorter than the first period, such that display with higher grey-scale can be achieved.

Furthermore, a control signal supplied to the enable line 44 can be shared among the plurality of pixel circuits 41, such that driving of the electro-optic device 10 can be facilitated. Specifically, for digital driving without the first period, extremely complicated driving is needed to set a light emission period to be shorter than one vertical period in which selection of all the scan lines 42 is completed. In contrast, a control signal supplied to the enable line 44 is shared among the plurality of pixel circuits 41 in the present exemplary embodiment, and thus the electro-optical device 10 can be easily driven by simply setting the second period to be short even when some subfields (SFs) have a light emission period shorter than one vertical period in which selection of all the scan lines 42 is completed.

As described above, the configuration of the pixel circuit 41 according to the present exemplary embodiment can achieve the electro-optical device 10 that can display a high-resolution, multi-grey-scale, and high-quality image at low power consumption, while operating at a higher speed and achieving brighter display.

Hereinafter, modification examples of the configuration of the pixel circuit according to the first exemplary embodiment will be described. In the following description of the modification examples, the differences from Example 1 or the above-described modification examples will be described. The same components as those of Example 1 or the above-described modification examples are designated by the same numerals in the drawings and their description will be omitted. Note that, a method for driving the pixel circuit described above is the same as the method in Example 1, and the same effects as the effects in Example 1 are also obtained from configurations in the following modification examples.

Modification Example 1

Configuration of Pixel Circuit

Figure 10:
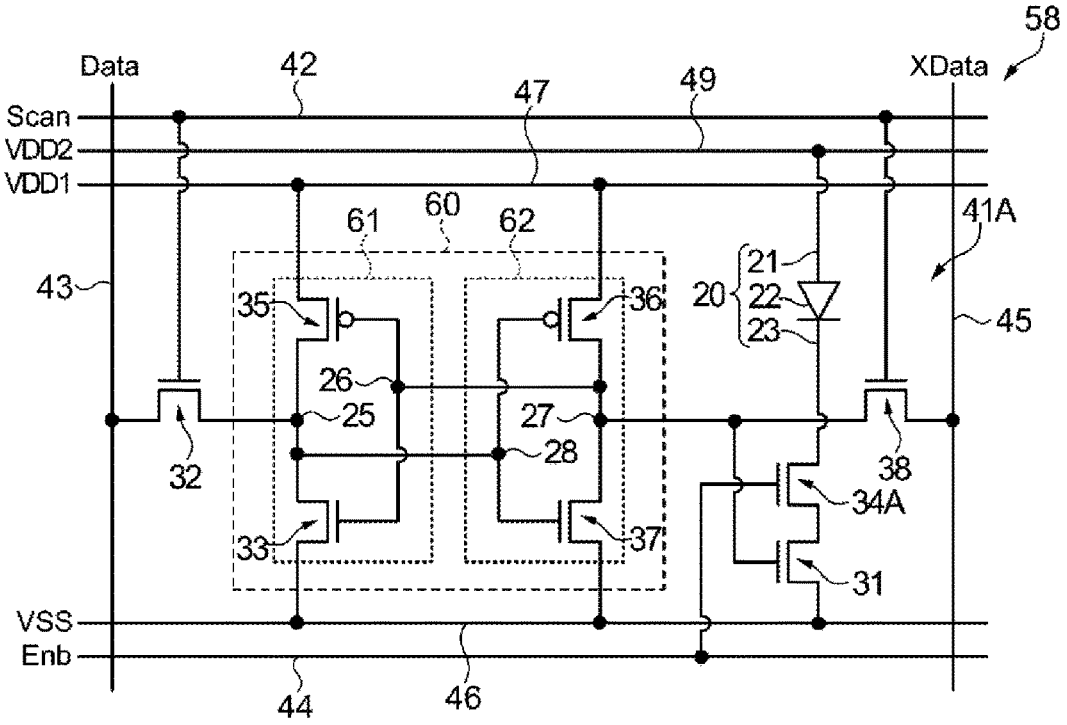
FIG. 10 illustrates a diagram for describing a configuration of a pixel circuit according to Modification Example 1.

First, a pixel circuit according to Modification Example 1 of the first exemplary embodiment will be described. FIG. 10 is a diagram for describing a configuration of a pixel circuit according to Modification Example 1. As illustrated in FIG. 10, a pixel circuit 41A according to Modification Example 1 is different from the pixel circuit 41 according to Example 1 in that a fourth transistor 34A is an N-type transistor and is disposed between the light emitting element 20 and the first transistor 31, but the other configuration is the same.

The pixel circuit 41A according to Modification Example 1 includes the light emitting element 20, the fourth transistor 34A of the N-type, the first transistor 31 of the N-type, the memory circuit 60, the second transistor 32 of the N-type, and the second complementary transistor 38 of the N-type. The anode 21 of the light emitting element 20 is electrically connected to the third high potential line (second high potential line 49). The cathode 23 of the light emitting element 20 is electrically connected to a drain of the fourth transistor 34A.

A source of the fourth transistor 34A is electrically connected to the drain of the first transistor 31. The source of the first transistor 31 is electrically connected to the second potential line (low potential line 46). Therefore, in the pixel circuit 41A according to Modification Example 1, the fourth transistor 34A of the N-type is disposed on the low potential side with respect to the light emitting element 20, and the first transistor 31 of the N-type is disposed on the low potential side with respect to the fourth transistor 34A.

In the Modification Example 1, the fourth transistor 34A is of the N-type. The inactive signal is set to a lower potential than a source potential of the fourth transistor 34A, and is preferably set to the second potential (V2). In addition, the active signal is set to a higher potential than the source potential of the fourth transistor 34A, and is preferably set to the third potential (V3).

The first transistor 31 is disposed between the fourth transistor 34A and the second potential line (low potential line 46). Thus, when the first transistor 31 is in the ON-state and the fourth transistor 34A is also in the ON-state, the source potential of the fourth transistor 34A is slightly higher than the second potential (V2). However, the source potential of the first transistor 31 can be fixed to the second potential (V2), and thus the first transistor 31 can be linearly operated. Therefore, the source potential of the fourth transistor 34A can be substantially equal to the second potential (V2).

When the inactive signal with the second potential (V2) is supplied over the enable line 44 to the fourth transistor 34A, a gate-source voltage $V_{gs4}$ of the fourth transistor 34A then becomes substantially 0 V. With a threshold voltage $V_{th4}$ ($V_{th4}$=0.36 V as one example) of the fourth transistor 34A of the N-type, the gate-source voltage $V_{gs4}$ of the fourth transistor 34A is smaller than the threshold voltage $V_{th4}$, and the fourth transistor 34A is then brought into the OFF-state. Therefore, when the control signal is the inactive signal, the fourth transistor 34A can be reliably in the OFF-state.

When the active signal with the third potential (V3) is supplied over the enable line 44, the gate-source voltage $V_{gs4}$ of the fourth transistor 34A is substantially equal to a potential difference (V3−V2=7.0 V−0 V=7.0 V) between the second potential (V2) and the third potential (V3). Therefore, the gate-source voltage $V_{gs4}$ of the fourth transistor 34A is sufficiently greater than the threshold voltage $V_{th4}$. When the control signal is the active signal, the fourth transistor 34A can be reliably in the ON-state, and can be linearly operated.

When the first transistor 31 and the fourth transistor 34A are in the ON-state, there is continuity in a path from the third potential line (second high potential line 49) to the second potential line (low potential line 46) through the light emitting element 20, the fourth transistor 34A, and the first transistor 31, and a current flows to the light emitting element 20. When the light emitting element 20 is allowed to emit light, the first transistor 31 and the fourth transistor 34A can be linearly operated. Variations in threshold voltages of the transistors 31 and 34A have a smaller influence. In this way, most of a high voltage of V3−V2=7.0 V can be applied to the light emitting element 20 also in the pixel circuit 41A according to Modification Example 1. Accordingly, intensity of light emitted by the light emitting element 20 can be further increased.

Modification Example 2

Figure 11:
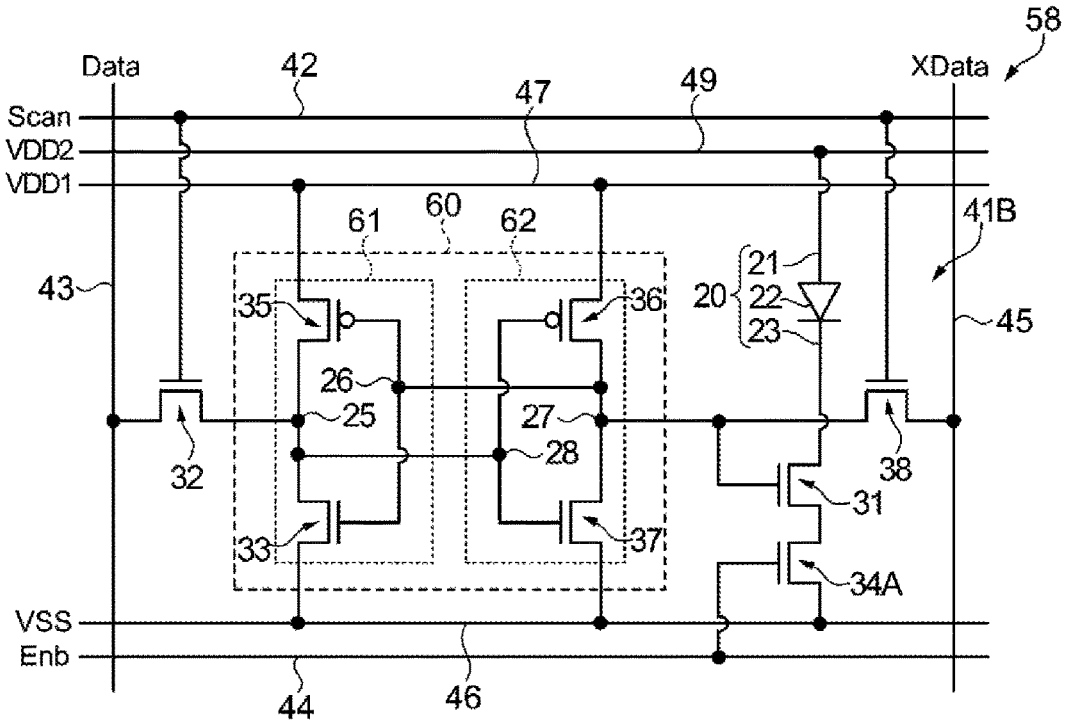
FIG. 11 illustrates a diagram for describing a configuration of a pixel circuit according to Modification Example 2.

Next, a pixel circuit according to Modification Example 2 of the first exemplary embodiment will be described. FIG. 11 is a diagram for describing a configuration of the pixel circuit according to Modification Example 2. As illustrated in FIG. 11, a pixel circuit 41B according to Modification Example 2 is different from the pixel circuit 41A according to Modification Example 1 in that the first transistor 31 is disposed between the light emitting element 20 and the fourth transistor 34A, but the other configuration is the same.

The pixel circuit 41B according to Modification Example 2 includes the light emitting element 20, the first transistor 31 of the N-type, the fourth transistor 34A of the N-type, the memory circuit 60, the second transistor 32 of the N-type, and the second complementary transistor 38 of the N-type. The anode 21 of the light emitting element 20 is electrically connected to the third high potential line (second high potential line 49). The cathode 23 of the light emitting element 20 is electrically connected to the drain of the first transistor 31.

The source of the first transistor 31 is electrically connected to the drain of the fourth transistor 34A. The source of the fourth transistor 34A is electrically connected to the second potential line (low potential line 46). Therefore, in the pixel circuit 41B according to Modification Example 2, the first transistor 31 of the N-type is disposed on the low potential side with respect to the light emitting element 20, and the fourth transistor 34A of the N-type is disposed on the low potential side with respect to the first transistor 31.

The source of the fourth transistor 34A is electrically connected to the second potential line (low potential line 46) in Modification Example 2. Thus, when the light emitting element 20 emits light, that is, when the active signal with the third potential (V3) is supplied to the enable line 44, the gate-source voltage $V_{gs4}$ of the fourth transistor 34A becomes the potential difference ($V_{gs4}$=V3−V2=7.0 V) between the third potential (V3) and the second potential (V2). Therefore, the fourth transistor 34A can be reliably in the ON-state and be linearly operated.

In Modification Example 2, the fourth transistor 34A is disposed between the first transistor 31 and the second potential line (low potential line 46). Thus, when the fourth transistor 34A is in the ON-state and the first transistor 31 is also in the ON-state, the source potential of the first transistor 31 is slightly higher than the second potential (V2). However, the source potential of the fourth transistor 34A can be fixed to the second potential (V2), and thus the fourth transistor 34A can be linearly operated. Therefore, the source potential of the first transistor 31 can be substantially equal to the second potential (V2).

Therefore, when a potential of the output terminal 27 in the memory circuit 60 becomes High (first potential), the gate-source voltage $V_{gs1}$ of the first transistor 31 is substantially equal to the potential difference (V1−V2=3.0 V) between the first potential (V1) and the second potential (V2) and is greater than the threshold voltage ($V_{th1}$=0.36 V) of the first transistor 31. Thus, the first transistor 31 can be reliably in the ON-state and be linearly operated.

Even in each of the pixel circuits 41B according to the Modification Example 2, when the light emitting element 20 is allowed to emit light, the first transistor 31 and the fourth transistor 34A can be linearly operated. Variations in threshold voltages of the transistors 31 and 34A have a smaller influence. In this way, most of a high voltage of V3−V2=7.0 V can be applied to the light emitting element 20. Accordingly, intensity of light emitted by the light emitting element 20 can be further increased.

Modification Example 3

Figure 12:
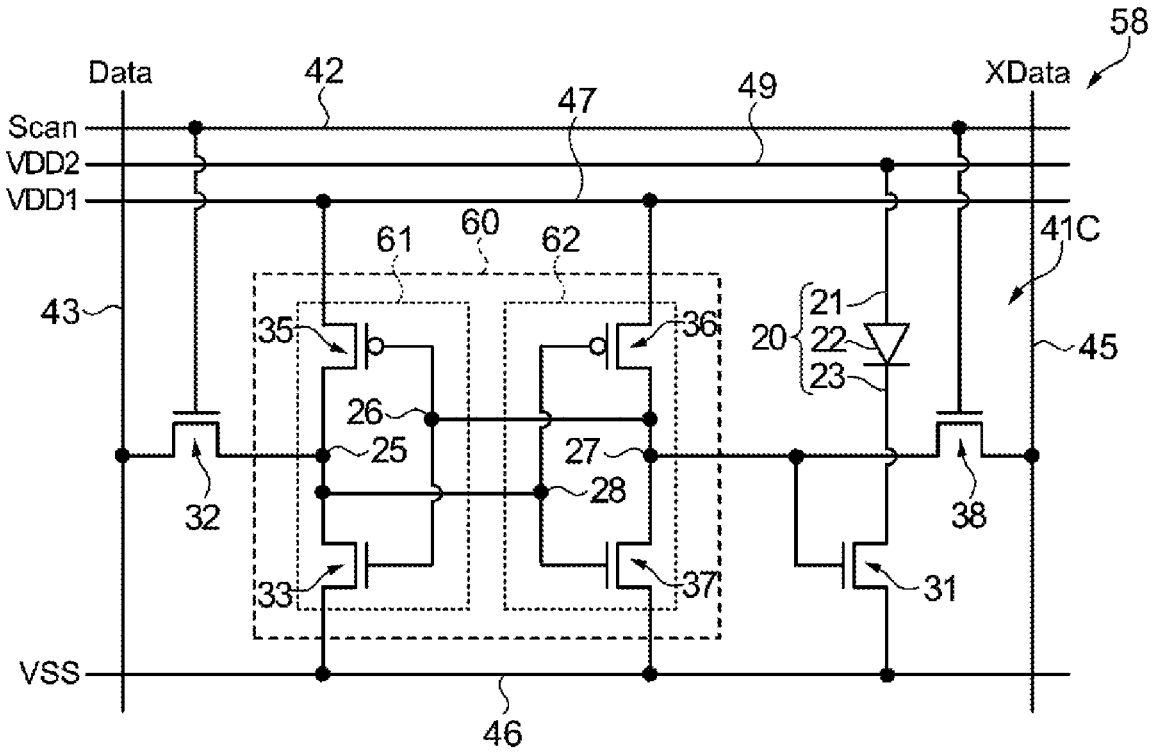
FIG. 12 illustrates a diagram for describing a configuration of a pixel circuit according to Modification Example 3.

Next, a pixel circuit according to Modification Example 3 of the first exemplary embodiment will be described. FIG. 12 is a diagram for describing a configuration of the pixel circuit according to Modification Example 3. As illustrated in FIG. 12, a pixel circuit 41C according to Modification Example 3 is different from Example 1 and the modification examples described above in that the fourth transistor 34 (or the fourth transistor 34A) is not provided, but the other configuration is the same.

The pixel circuit 41C according to Modification Example 3 includes the light emitting element 20, the first transistor 31 of the N-type, the memory circuit 60, the second transistor 32 of the N-type, and the second complementary transistor 38 of the N-type. The anode 21 of the light emitting element 20 is electrically connected to the third high potential line (second high potential line 49). The cathode 23 of the light emitting element 20 is electrically connected to the drain of the first transistor 31. The source of the first transistor 31 is electrically connected to the second potential line (low potential line 46).

The light emitting element 20 and the first transistor 31 are disposed in series between the third potential line (second high potential line 49) and the second potential line (low potential line 46) in the pixel circuit 41C according to Modification Example 3. When a potential of the output terminal 27 in the memory circuit 60 becomes High (first potential) and the first transistor 31 is in the ON-state, the light emitting element 20 emits light. When the light emitting element 20 emits light, the source potential of the first transistor 31 is fixed to the second potential (V2), and the first transistor 31 can be linearly operated. Variations in a threshold voltage of the first transistor 31 have a smaller influence. In this way, most of a high voltage of V3−V2=7.0 V can be applied to the light emitting element 20. Accordingly, intensity of light emitted by the light emitting element 20 can be further increased.

The enable line 44 is not needed in the pixel circuit 41C according to Modification Example 3, such that the number of wires and, thus, the number of wiring layers can be reduced. Since wiring layers are formed with interposed insulating layers, a large number of wiring layers may lead to an increased number of steps involved in the production process of an element substrate configuring an electro-optical device and decreased production yields. The configuration of Modification Example 3 enables image display by digital driving even with a fewer number of wiring layers. Thus, the number of manufacturing steps can be reduced and the production yield can be improved over Example 1 and the Modification Examples described above. Further, the number of light-shielding wirings and, thus, the light-shielding area can be reduced. Thus, a higher resolution and finer pixels can be achieved.

Second Exemplary Embodiment

Figure 13:
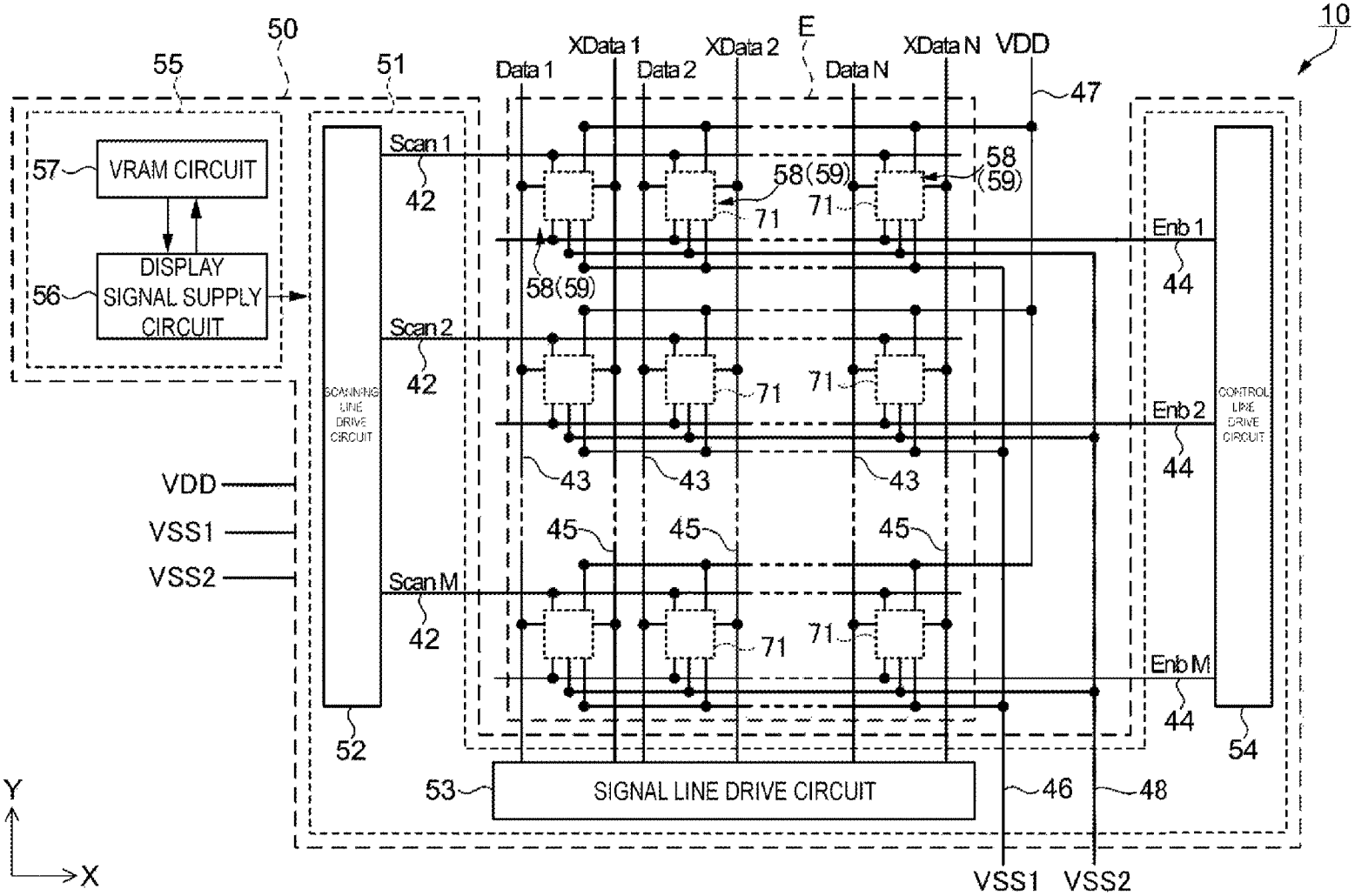
FIG. 13 illustrates a block diagram of a circuit of an electro-optical device according to a second exemplary embodiment of the invention.
Figure 14:
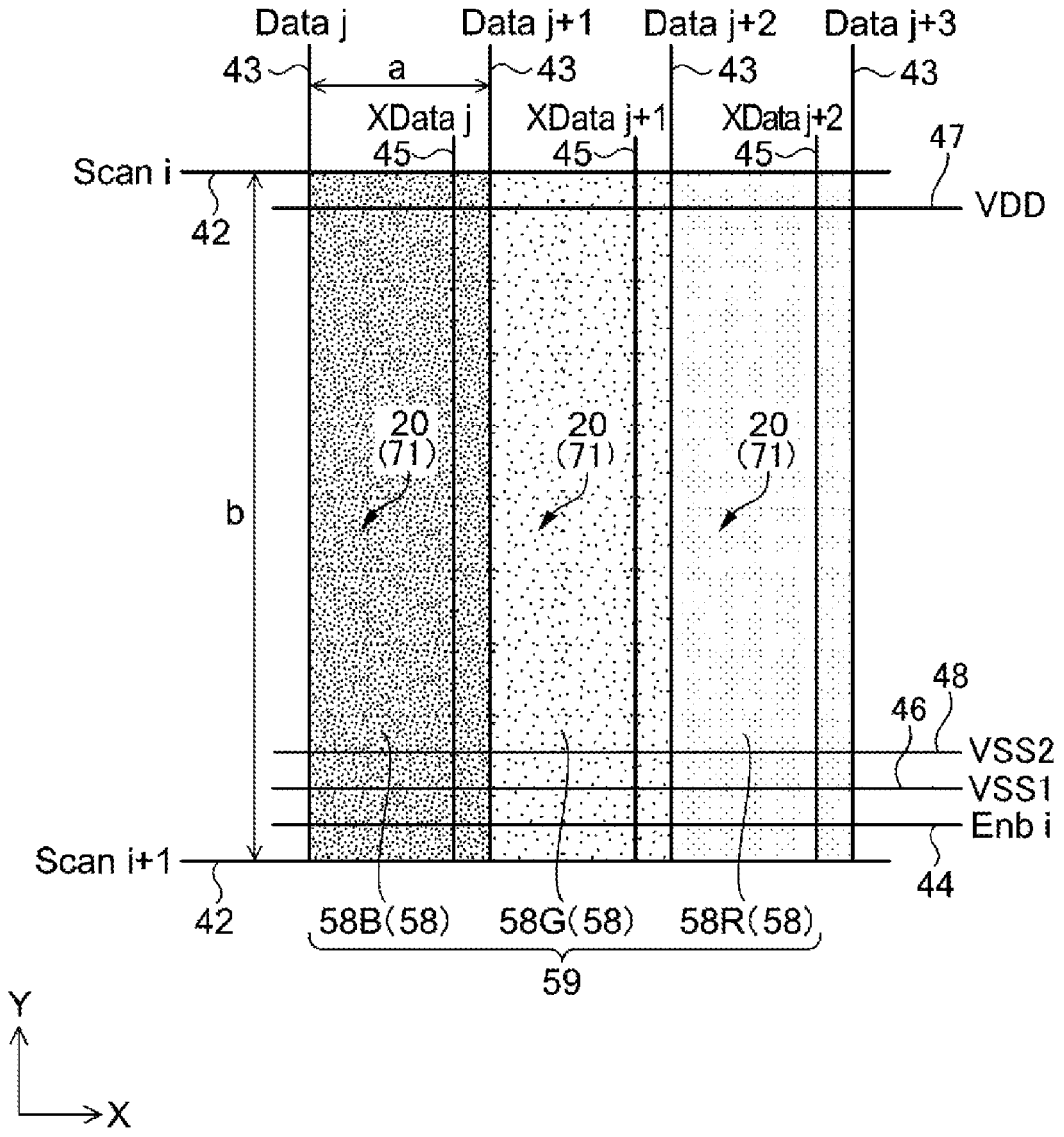
FIG. 14 illustrates a diagram for describing a configuration of a pixel circuit according to the second exemplary embodiment of the invention.

Next, a configuration of an electro-optical device according to a second exemplary embodiment will be described. The electro-optical device according to the second exemplary embodiment is different from the electro-optical device 10 according to the first exemplary embodiment in that a first transistor and a second transistor are of the P-type, and the second potential (V2) is higher than the first potential (V1) and the third potential (V3). Accordingly, the configuration of the pixel circuit according to the second exemplary embodiment also differs from the configuration of the pixel circuit according to the first exemplary embodiment. FIG. 13 illustrates a block diagram of a circuit of an electro-optical device according to a second exemplary embodiment of the invention. FIG. 14 illustrated a diagram for describing a configuration of a pixel circuit according to the second exemplary embodiment of the invention. As illustrated in FIG. 13 and FIG. 14, in the electro-optical device 10 according to the present exemplary embodiment, a first low potential VSS1, a second low potential VSS2, and a high potential VDD are supplied to the drive unit 50, and the first low potential VSS1, the second low potential VSS2, and the high potential VDD are supplied to a pixel circuit 71.

Hereinafter, the configuration of the pixel circuit according to the second exemplary embodiment will be described with reference to an example and a plurality of modification examples. In the following description of examples and modification examples, the differences from Example 1 or modification examples of first embodiment will be described. The same components as those of Example 1 or modification examples are designated by the same numerals in the drawings and their description will be omitted.

Example 2

Configuration of Pixel Circuit

Figure 15:
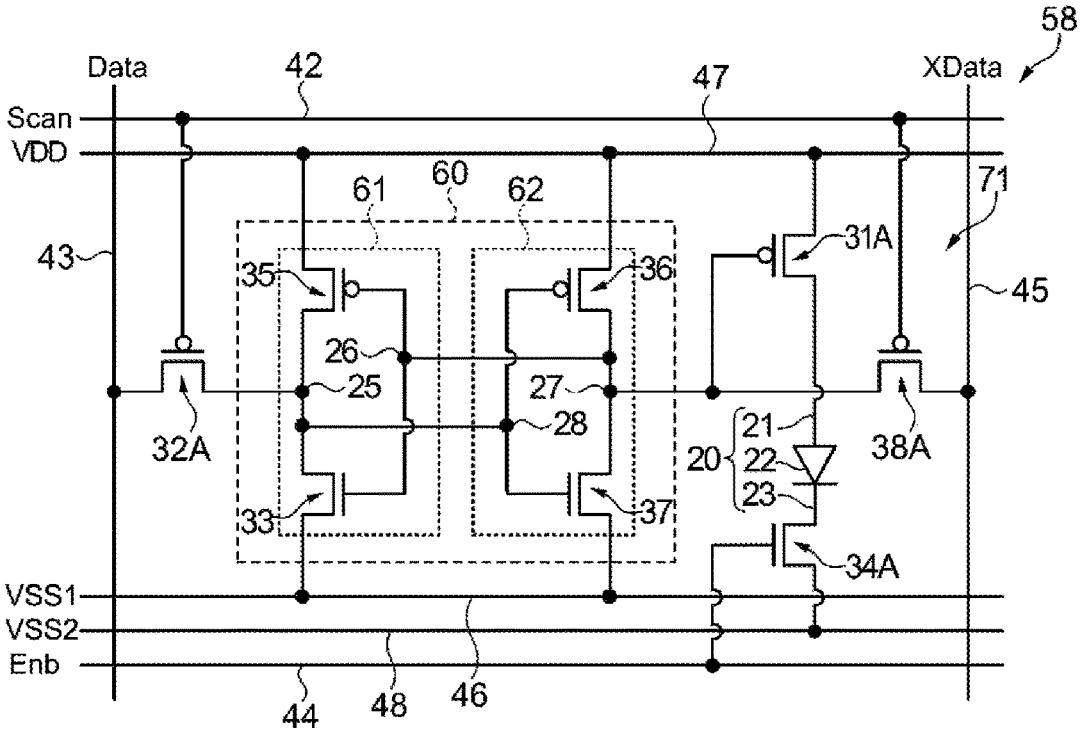
FIG. 15 illustrates a diagram for describing a configuration of a pixel circuit according to Example 1.

First, the configuration of the pixel circuit according to Example 2 of the second exemplary embodiment will be described with reference to FIG. 15. FIG. 15 is a diagram for describing the configuration of the pixel circuit according to Example 2. As illustrated in FIG. 15, a pixel circuit 71 according to Example 2 includes a first transistor 31A of the P-type, the light emitting element 20, the fourth transistor 34A of the N-type, the memory circuit 60, the second transistor 32A of the P-type, and a second complementary transistor 38A of the P-type.

Note that, the high potential and the low potential are switched in the second exemplary embodiment (Example 2 and modification examples below) from the first exemplary embodiment. Specifically, the first potential (V1) represents a first low potential VSS1 (e.g., V1=VSS1=4.0 V), the second potential (V2) represents a high potential VDD (e.g., V2=VDD=7.0 V), and the third potential (V3) represents a second low potential VSS2 (e.g., V3=VSS2=0 V). Therefore, the first potential is lower than the second potential, while the third potential is lower than the first potential.

In the present exemplary embodiment, the first potential (first low potential VSS1) and the second potential (high potential VDD) constitute the low-voltage power-supply, and the third potential (second low potential VSS2) and the second potential (high potential VDD) constitute the high-voltage power-supply. The second potential serves as a reference potential in the low-voltage power-supply and the high-voltage power-supply.

Therefore, in the second exemplary embodiment (Example 2 and the following modification examples), to each of the pixel circuits 71, the first potential (VSS1) is supplied over the first low potential line 46 as the first potential line, the second potential (VDD) is supplied over the high potential line 47 as the second potential line, and the third potential (VSS2) is supplied over the second low potential line 48 as the third potential line.

In Example 2, the first transistor 31A, the light emitting element 20, and the fourth transistor 34A are disposed in series between the second potential line (high potential line 47) and the third potential line (second low potential line 48). As in the first exemplary embodiment, the memory circuit 60 is disposed between the first potential line (first low potential line 46) and the second potential line (high potential line 47). The second transistor 32A is disposed between the memory circuit 60 and the data line 43. The second complementary transistor 38A is disposed between the memory circuit 60 and the complementary data line 45.

The gate of the first transistor 31A is electrically connected to the output terminal 27 of the second inverter 62 in the memory circuit 60. A source of the first transistor 31A is electrically connected to the second potential line (high potential line 47). The drain of the first transistor 31A is electrically connected to the anode 21 of the light emitting element 20. A gate of the fourth transistor 34A is electrically connected to the enable line 44. The source of the fourth transistor 34A is electrically connected to the third potential line (second low potential line 48). The drain of the fourth transistor 34A is electrically connected to the cathode 23 of the light emitting element 20.

In each of the pixel circuits 71 according to Example 2, a characteristic of the first transistor 31A and a characteristic of the fourth transistor 34A are opposite to each other. The first transistor 31A of the P-type is disposed on the high potential side with respect to the light emitting element 20, and the fourth transistor 34A of the N-type is disposed on the low potential side with respect to the light emitting element 20. When the fourth transistor 34A and the first transistor 31A are in the ON-state, the light emitting element 20 may emit light. When the first transistor 31A and the fourth transistor 34A are in the ON-state, there is continuity in a path from the second potential line (high potential line 47) to the third potential line (second low potential line 48) through the first transistor 31A, the light emitting element 20, and the fourth transistor 34A, and a current flows to the light emitting element 20.

In the second exemplary embodiment (Example 2 and the following modification examples), the light emitting element 20 may emit light when the potential of the output terminal 25 of the first inverter 61 in the memory circuit 60 is High, i.e., when the potential of the output terminal 27 of the second inverter 62 is Low, and the light emitting element 20 does not emit light when the potential of the output terminal 25 of the first inverter 61 is Low, i.e., when the potential of the output terminal 27 of the second inverter 62 is High.

Relationship between Each Potential and Threshold Voltage of Transistor

Also, in the second exemplary embodiment (Example 2 and the following modification examples), the first potential (V1) and the second potential (V2) constitute the low-voltage power-supply, and the third potential (V3) and the second potential (V2) constitute the high-voltage power-supply. A potential difference (V2−V1=7.0 V−4.0 V=3.0 V) between the second potential (V2) and the first potential (V1), which is a voltage of the low-voltage power-supply, is smaller than a potential difference (V2−V3=7.0 V−0 V=7.0 V) between the second potential (V2) and the third potential (V3), which is a voltage of the high-voltage power-supply (V2−V1<V2−V3).

Also, in the second exemplary embodiment, the drive circuit 51 and the memory circuit 60 are driven by the low-voltage power-supply at a low voltage of V2−V1=3.0 V, such that the drive circuit 51 and the memory circuit 60 can be operated at a high speed. Then, the high-voltage power-supply causes the light emitting element 20 to emit light at a high voltage of V2−V3=7.0 V, and thus the light emitting element 20 can be caused to emit light at high intensity. Furthermore, the first transistor 31A and the fourth transistor 34A disposed in series with the light emitting element 20 are linearly operated, and thus most of a high voltage of V2−V3=7.0 V can be applied to the light emitting element 20. Accordingly, intensity of light emitted by the light emitting element 20 can be further increased.

In the second exemplary embodiment, the two inverters 61 and 62 constituting the memory circuit 60 are disposed between the first potential line (first low potential line 46) and the second potential line (high potential line 47), and VSS1 as the first potential and VDD as the second potential are supplied to the two inverters 61 and 62. Therefore, Low corresponds to the first potential (VSS1), and High corresponds to the second potential (VDD).

In the present exemplary embodiment, a threshold voltage ($V_{th1}$) of the first transistor 31A serving as a drive transistor is negative ($V_{th1}<0$). When an image signal stored in the memory circuit 60 corresponds to non-light emission, a potential of the output terminal 27 in the memory circuit 60 is High (second potential). The source of the first transistor 31A is connected to the second potential line (high potential line 47). This means that a source potential corresponds to the second potential (VDD). As a result, a gate-source voltage $V_{gs1}$ of the first transistor 31A is 0 V.

Therefore, when, with respect to the threshold voltage $V_{th1}$ ($V_{th1}$=−0.36 V as one example) of the first transistor 31A, the gate-source voltage $V_{gs1}$ is 0 V, the gate-source voltage $V_{gs1}$ is greater than the threshold voltage $V_{th1}$, and thus the first transistor 31A is brought into the OFF-state. In this way, when an image signal represents non-light emission, the first transistor 31A can be reliably in the OFF-state.

When an image signal stored in the memory circuit 60 corresponds to light emission, a potential of the output terminal 27 in the memory circuit 60 is Low (first potential). A source potential of the first transistor 31A is the second potential, and thus the gate-source voltage $V_{gs1}$ of the first transistor 31A is equal to the potential difference between the first potential (V1) and the second potential (V2) ($V_{gs1}$=V1−V2=4.0 V−7.0 V=−3.0 V). Therefore, the gate-source voltage $V_{gs1}$ of the first transistor 31A is smaller than the threshold voltage $V_{th1}$, and the first transistor 31A is then brought into the ON-state. In this way, when an image signal represents light emission, the first transistor 31A can be reliably in the ON-state.

The inactive signal is supplied as the control signal to all the enable lines 44 in the first period, which is a non-display period, and the fourth transistors 34A are then brought into the OFF-state also in the second exemplary embodiment. As a result, the light emitting elements 20 are brought into a state of not emitting light. Then, when the selection signal is supplied as the scanning signal to any of the scan lines 42 in the first period, the selected second transistor 32A and the selected second complementary transistor 38A are brought into the ON-state, and an image signal is written over the data line 43 and the complementary data line 45 into the memory circuit 60.

The active signal is supplied as the control signal to all the enable lines 44 in the second period, which is a display period, and the fourth transistors 34A are then brought into the ON-state. As a result, the light emitting elements 20 are brought into a state of being likely to emit light. The non-selection signal for bringing the second transistors 32A into the OFF-state is supplied as the scanning signal to all the scan lines 42 in the second period. As described above, the first period and the second period can also be controlled independently in the second exemplary embodiment, such that grey-scale display by digital time division driving can be achieved.

In the second exemplary embodiment (Example 2), the fourth transistor 34A is of the N-type, and thus an active signal, which is a control signal, in the active state is at a high potential, and an inactive signal, which is a control signal, in the inactive state is at a low potential. Specifically, the inactive signal is set to a lower potential, i.e., the third potential (V3) or lower, and is preferably set to the third potential (V3). In addition, the active signal is set to a higher potential, i.e., V3+(V2−V1) or higher, and is preferably set to the second potential (V2).

When the inactive signal with the third potential (V3) is supplied over the enable line 44 to the gate of the fourth transistor 34A, both of the source potential and the gate potential of the fourth transistor 34A become the third potential (V3), and the gate-source voltage $V_{gs4}$ of the fourth transistor 34A then becomes 0 V. With the threshold voltage $V_{th4}$ ($V_{th4}$=0.36 V as one example) of the fourth transistor 34A of the N-type, the gate-source voltage $V_{gs4}$ of the fourth transistor 34A is smaller than the threshold voltage $V_{th4}$, and the fourth transistor 34A is then brought into the OFF-state. Therefore, when the control signal is the inactive signal, the fourth transistor 34A can be reliably in the OFF-state.

When the active signal with a potential of V3+(V2−V1) or higher, i.e., 0 V+(7.0 V−4.0 V)=3.0 V or higher, is supplied over each of the enable lines 44, the gate-source voltage $V_{gs4}$ of the fourth transistor 34A is 3.0−0 V=3.0 V or higher. Therefore, the gate-source voltage $V_{gs4}$ of the fourth transistor 34A is sufficiently greater than the threshold voltage $V_{th4}$ When the control signal is the active signal, the fourth transistor 34A can be reliably in the ON-state.

When a potential of the active signal is increased, the gate-source voltage $V_{gs4}$ of the fourth transistor 34A increases. When a potential of the active signal is the second potential (V2), the gate-source voltage $V_{gs4}$ of the fourth transistor 34A is V2−V3=7.0 V−0 V=7.0 V. An ON-resistance of the fourth transistor 34A being brought into the ON-state lowers. When the light emitting element 20 emits light, variations in a threshold voltage of the fourth transistor 34A have a smaller influence.

The second transistor 32A serving as a selection transistor is in the OFF-state when being supplied with the non-selection signal as the scanning signal over the scan line 42 electrically connected to the gate, and the second transistor 32A is in the ON-state when being supplied with the selection signal. In the second exemplary embodiment, the second transistor 32A is of the P-type. As described above, the non-selection signal is set to a higher potential, i.e., the second potential (V2) or higher, and is preferably set to the second potential (V2). In addition, the selection signal is set to a lower potential, i.e., the first potential (V1) or lower, and is preferably set to the third potential (V3).

Even in the second exemplary embodiment, the polarity of the first transistor 31 and a polarity of the second transistor 32A may be identical to each other. In the second exemplary embodiment, both of the first transistor 31A and the second transistor 32A are of the P-type. Therefore, when a potential of an image signal supplied to the gate of the first transistor 31A is Low, the first transistor 31A is brought into the ON-state. When a scanning signal supplied to a gate of the second transistor 32A is the selection signal (Low), the second transistor 32A is brought into the ON-state. When an image signal is Low, its potential is the first potential (V1). However, the selection signal (Low) is set to the first potential (V1) or lower, and is preferably set to the third potential (V3).

Setting a potential of the selection signal to the third potential (V3) and rewriting an image signal in the memory circuit 60 from High to Low will be described herein. Before an image signal is rewritten, the input terminal 28 of the second inverter 62 electrically connected with either of a source and a drain of the second transistor 32A is High, i.e., the second potential (V2). When the selection signal with the third potential (V3) is supplied over each of the scan lines 42 to the gate of the second transistor 32A, the gate-source voltage $V_{gs2}$ of the second transistor 32A becomes V3−V2=0 V−7.0 V=−7.0 V. The value is lower than the threshold voltage $V_{th2}$ of the second transistor 32A (e.g., $V_{th2}$=−0.36 V). The second transistor 32A is thus brought into the ON-state.

When an image signal with Low (V1) is written over each of the data lines 43 into the memory circuit 60, a potential of the input terminal 28 of the second inverter 62 gradually decreases from High (V2) to Low (V1). Along with this, an absolute value of the gate-source voltage $V_{gs2}$ of the second transistor 32A gradually lowers to V3−V1=0 V−4.0 V=−4.0 V. Even when the gate-source voltage $V_{gs2}$ of the second transistor 32A reaches a highest value, in this case, when the voltage reaches −4.0 V, which is a value closer to zero, the gate-source voltage $V_{gs2}$ is still sufficiently lower than the threshold voltage $V_{th2}$ of the second transistor 32A. Therefore, until an image signal is written into the memory circuit 60, the ON-resistance of the second transistor 32A is kept low. The image signal is thus securely written into the memory circuit 60.

Here tentatively assumes a case when the second transistor 32A is the second transistor 32 of the N-type, with the second transistor 32A having a characteristic opposite to that of the first transistor 31A. In this case, the second transistor 32 is brought into the ON-state when the selection signal is High. When a potential of the selection signal is set to the second potential (V2), when an image signal in the memory circuit 60 is rewritten from Low to High, and when the selection signal with the second potential (V2) is supplied over each of the scan lines 42, the gate-source voltage $V_{gs2}$ of the second transistor 32 becomes V2−V1=7.0 V−4.0 V=3.0 V. This value is higher than the threshold voltage $V_{th2}$ of the second transistor 32 (e.g., $V_{th2}$=0.36 V). The second transistor 32A is thus brought into the ON-state.

When an image signal with High (V2) is written over each of the data lines 43 into the memory circuit 60, a potential of the input terminal 28 of the second inverter 62 gradually increases from Low (V1), and the gate-source voltage $V_{gs2}$ of the second transistor 32 gradually decreases from 3.0 V. As a result, before the potential of the input terminal 28 reaches the second potential (V2), the potential reaches the threshold voltage $V_{th2}$ of the second transistor 32 of the N-type (e.g., 0.36 V). The second transistor 32 is thus brought into the OFF-state.

Before the second transistor 32 is brought into the OFF-state, as the gate-source voltage $V_{gs2}$ decreases and approaches to the threshold voltage $V_{th2}$, the ON-resistance of the second transistor 32 increases. This would cause rewriting of an image signal into the memory circuit 60 to take a certain time, or may lead to erroneous rewriting. To avoid this, the potential of the selection signal is set to a further lower potential. In this case, however, another potential line different from the potential would be further required.

As described in the present exemplary embodiment, the polarity of the first transistor 31A and the polarity of the second transistor 32A are identical to each other, i.e., are both of the P-type, setting a potential of the selection signal to the third potential that is lowest between the second potential and the third potential eliminates provision of a new potential line. When the second transistor 32A is brought into the ON-state, and an image signal is written into the memory circuit 60, the gate-source voltage $V_{gs2}$ of the second transistor 32A can be increased. Even when an image signal is written, and a source potential increases, the ON-resistance of the second transistor 32A can be kept lower. Therefore, the image signal can be written and rewritten promptly and securely into the memory circuit 60.

Therefore, the configuration of the pixel circuit 71 according to Example 2 of the second exemplary embodiment can achieve the electro-optical device 10 that can display a high-resolution, multi-grey-scale, and high-quality image at low power consumption, while operating at a higher speed and achieving brighter display.

Hereinafter, modification examples of the configuration of the pixel circuit according to the second exemplary embodiment will be described. In the following description of modification examples, the differences from Example 1 or the above-described modification examples will be described. The same components as those of Example 1 or the above-described modification examples are designated by the same numerals in the drawings and their description will be omitted.

Modification Example 4

Figure 16:
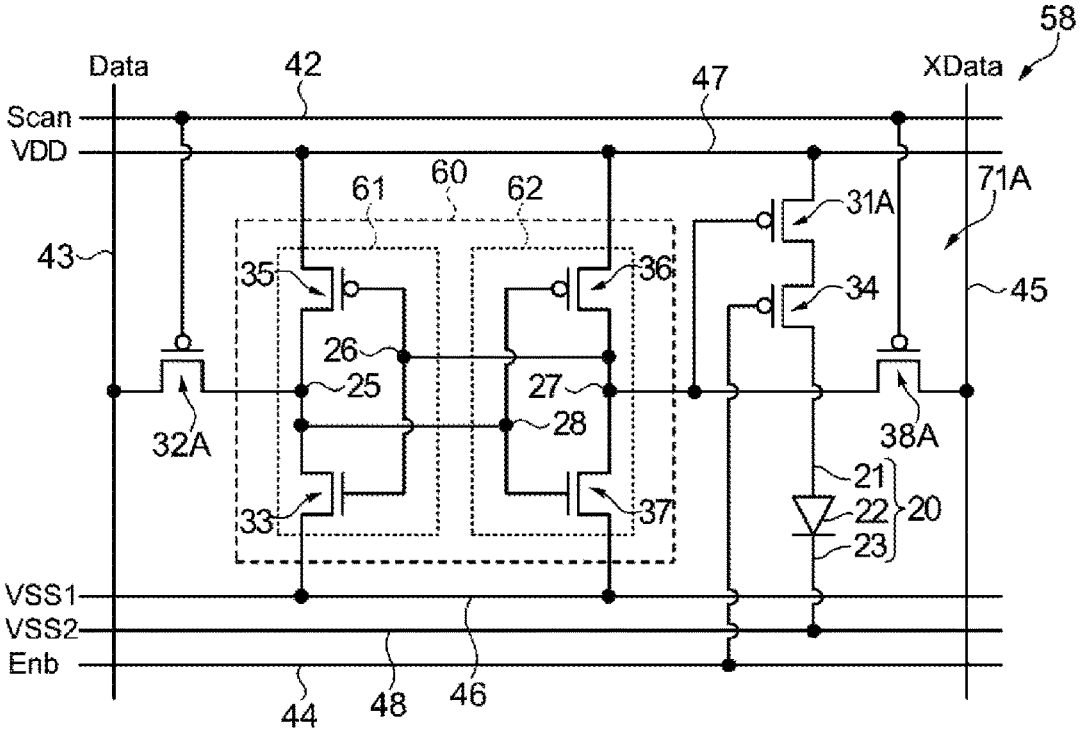
FIG. 16 illustrates a diagram for describing a configuration of a pixel circuit according to Modification Example 4.

Next, a pixel circuit according to a modification example (Modification Example 4) of the second exemplary embodiment will be described. FIG. 16 is a diagram for describing a configuration of the pixel circuit according to Modification Example 4. As illustrated in FIG. 16, a pixel circuit 71A according to Modification Example 4 is different from the pixel circuit 71 according to Example 2 in that the fourth transistor 34 is of the P-type and is disposed between the first transistor 31A and the light emitting element 20, but the other configuration is the same.

The pixel circuit 71A according to Modification Example 4 includes the first transistor 31A of the P-type, the fourth transistor 34 of the P-type, the light emitting element 20, the memory circuit 60, the second transistor 32A of the P-type, and the second complementary transistor 38A of the P-type. The drain of the first transistor 31A is electrically connected to the source of the fourth transistor 34. The drain of the fourth transistor 34 is electrically connected to the anode 21 of the light emitting element 20. In other words, the fourth transistor 34 of the P-type is disposed on the high potential side with respect to the light emitting element 20 and the first transistor 31A of the P-type is disposed on the high potential side with respect to the fourth transistor 34 in the pixel circuit 71A according to Modification Example 4.

Since the fourth transistor 34 is of the P-type in Modification Example 4, it is assumed that a potential of the inactive signal is a high potential, i.e., the second potential (V2), and a potential of the active signal is a low potential, i.e., the third potential (V3). When the active signal is supplied to the enable line 44, the gate potential of the fourth transistor 34 is the same potential as the third potential, and the fourth transistor 34 is brought into the ON-state. When the first transistor 31A and the fourth transistor 34A are in the ON-state, there is continuity in a path from the second potential line (high potential line 47) to the third potential line (second low potential line 48) through the first transistor 31A, the fourth transistor 34A, and the light emitting element 20, and a current flows to the light emitting element 20.

In Modification Example 4, the first transistor 31A is disposed between the fourth transistor 34 and the second potential line (high potential line 47). Thus, when the fourth transistor 34 is in the ON-state, the source potential of the fourth transistor 34 is slightly lower than the second potential (V2). However, the source potential of the fourth transistor 34 can be substantially equal to the second potential by linearly operating the first transistor 31A.

Therefore, the gate-source voltage $V_{gs4}$ of the fourth transistor 34 is substantially equal to the potential difference (V3−V2=−7.0 V) between the third potential (V3) and the second potential (V2) and is smaller than the threshold voltage $V_{th4}$ ($V_{th4}$=−0.36 V) of the fourth transistor 34 of the P-type, and thus the fourth transistor 34 is reliably in the ON-state. Then, the gate-source voltage $V_{gs4}$ of the fourth transistor 34 is sufficiently smaller than the threshold voltage $V_{t1,4}$, and thus the fourth transistor 34 can be linearly operated.

Modification Example 5

Figure 17:
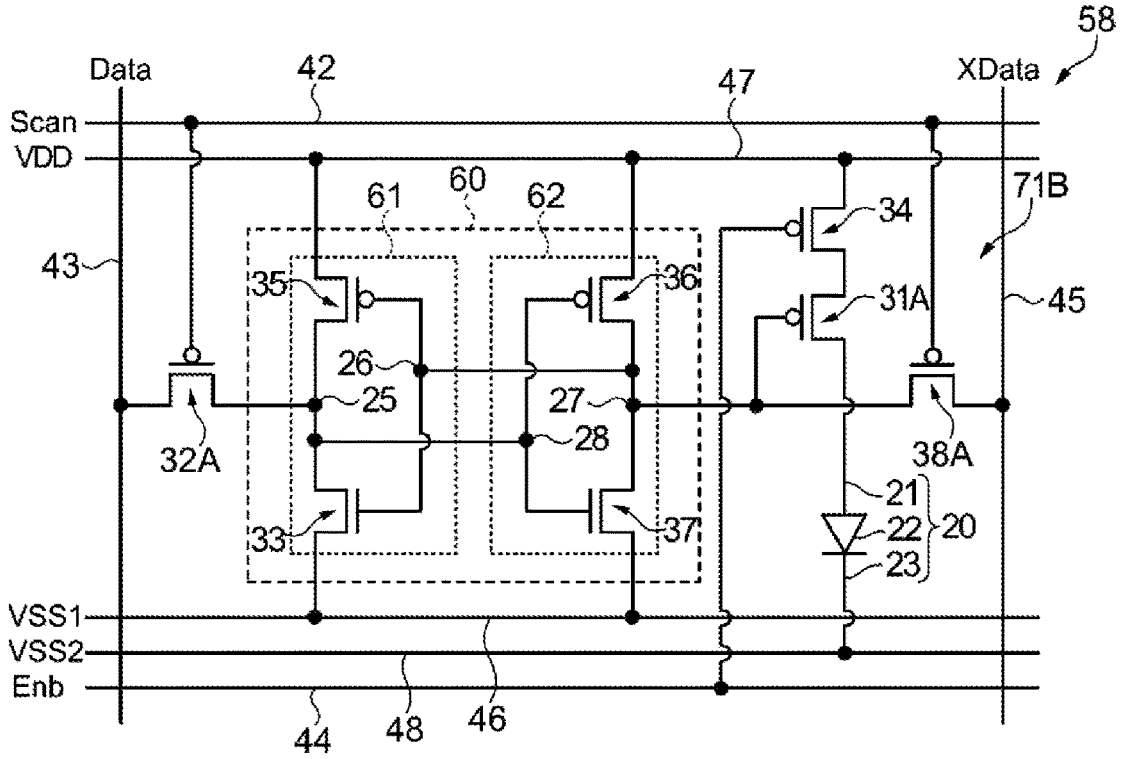
FIG. 17 illustrates a diagram for describing a configuration of a pixel circuit according to Modification Example 5.

Next, a pixel circuit according to a modification example (Modification Example 5) of the second exemplary embodiment will be described. FIG. 17 is a diagram for describing a configuration of the pixel circuit according to Modification Example 5. As illustrated in FIG. 17, a pixel circuit 71B according to Modification Example 5 is different from the pixel circuit 71A according to Modification Example 4 in that the first transistor 31A is disposed between the fourth transistor 34 and the light emitting element 20, but the other configuration is the same.

The pixel circuit 71B according to Modification Example 5 includes the fourth transistor 34 of the P-type, the first transistor 31A of the P-type, the light emitting element 20, the memory circuit 60, the second transistor 32A of the P-type, and the second complementary transistor 38A of the P-type. The source of the fourth transistor 34 is electrically connected to the second potential line (high potential line 47). The source of the first transistor 31A is electrically connected to the drain of the fourth transistor 34. The drain of the first transistor 31A is electrically connected to the anode 21 of the light emitting element 20. In other words, in the pixel circuit 71B according to Modification Example 5, the first transistor 31A of the P-type is disposed on the high potential side with respect to the light emitting element 20, and the fourth transistor 34 of the P-type is disposed on the high potential side with respect to the first transistor 31A.

In Modification Example 5, the fourth transistor 34 is disposed between the first transistor 31A and the second potential line (high potential line 47). Thus, when the first transistor 31A is in the ON-state, the source potential of the first transistor 31A is slightly lower than the second potential (V2). However, the source potential of the first transistor 31A can be substantially equal to the second potential by linearly operating the fourth transistor 34. Therefore, the gate-source voltage $V_{gs1}$ of the first transistor 31A is substantially equal to the potential difference (V1−V2=−3 V) between the first potential (V1) and the second potential (V2). Thus, the first transistor 31A can be reliably in the ON-state and be linearly operated.

Modification Example 6

Figure 18:
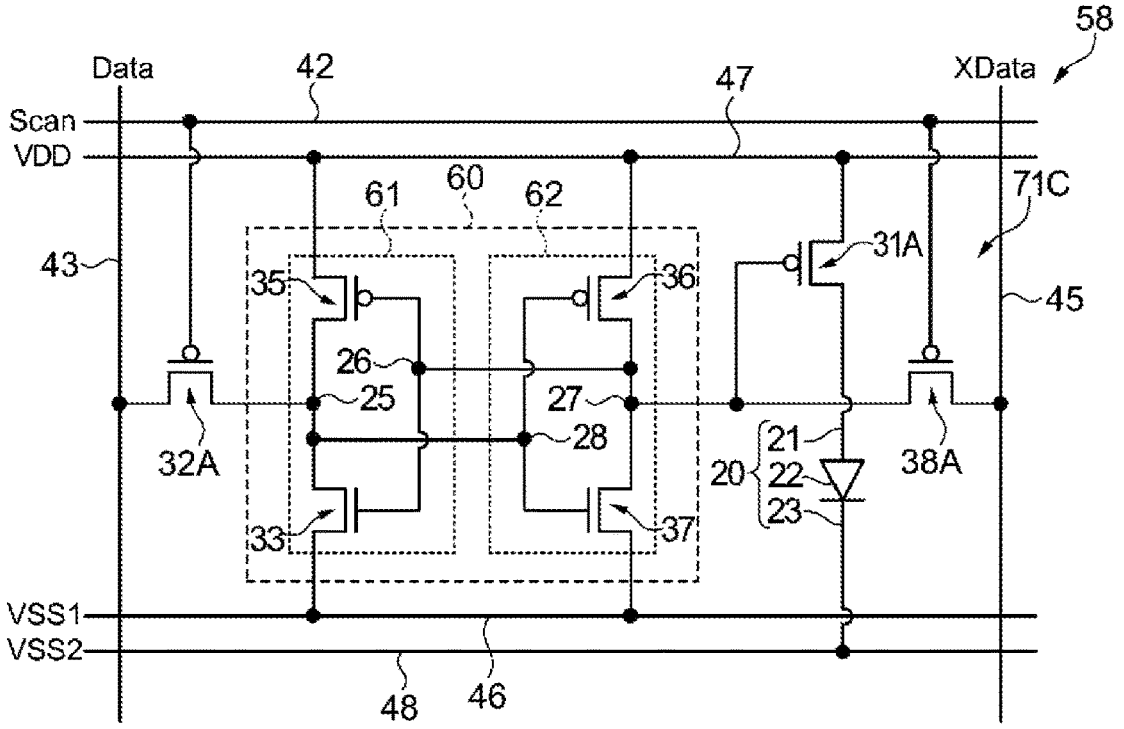
FIG. 18 illustrates a diagram for describing a configuration of a pixel circuit according to Modification Example 6.

Next, a pixel circuit according to a modification example (Modification Example 6) of the second exemplary embodiment will be described. FIG. 18 is a diagram for describing a configuration of the pixel circuit according to Modification Example 6. As illustrated in FIG. 18, a pixel circuit 71C according to Modification Example 6 is different from Example 2 and the modification examples described above in that the fourth transistor 34 (or the fourth transistor 34A) is not provided, but the other configuration is the same.

The pixel circuit 71C according to Modification Example 6 includes the light emitting element 20, the first transistor 31A of the P-type, the memory circuit 60, the second transistor 32A of the P-type, and the second complementary transistor 38A of the P-type. The source of the first transistor 31A is electrically connected to the second potential line (high potential line 47). The drain of the first transistor 31A is electrically connected to the anode 21 of the light emitting element 20. The cathode 23 of the light emitting element 20 is electrically connected to the third potential line (second low potential line 48).

The first transistor 31A and the light emitting element 20 are disposed in series between the second potential line (high potential line 47) and the third potential line (second low potential line 48) in the pixel circuit 71C according to Modification Example 6. Thus, when a potential of the output terminal 27 in the memory circuit 60 becomes Low (first potential) and the first transistor 31A is in the ON-state, the light emitting element 20 emits light. As with Example and Modification Examples described above, the light emitting intensity of the light emitting element 20 can also be increased and the variation in the threshold voltage $V_{th1}$ of the first transistor 31A affecting the light emitting intensity of the light emitting element 20 can be substantially eliminated in Modification Example 6.

The enable line 44 is not needed in the pixel circuit 71C according to Modification Example 6, such that the number of wires and, thus, the number of wiring layers can be reduced. Thus, the number of manufacturing steps can be reduced and the production yield can be improved over the examples and modification examples described above. Further, the number of light-shielding wirings and, thus, the light-shielding area can be reduced. Thus, a higher resolution and finer pixels can be achieved.

Third Exemplary Embodiment

Figure 19:
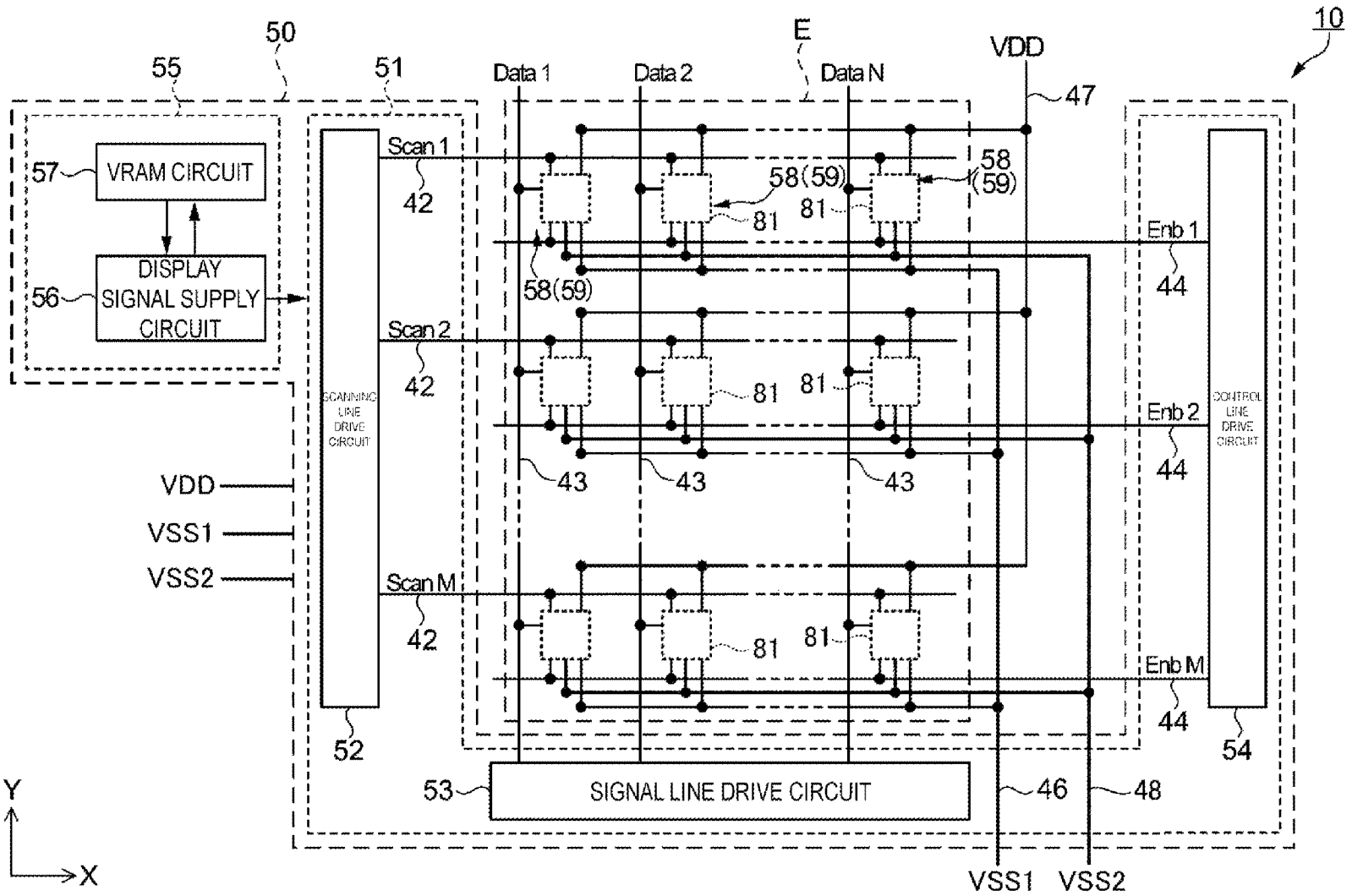
FIG. 19 illustrates a block diagram of a circuit of an electro-optical device according to a third exemplary of the invention.
Figure 20:
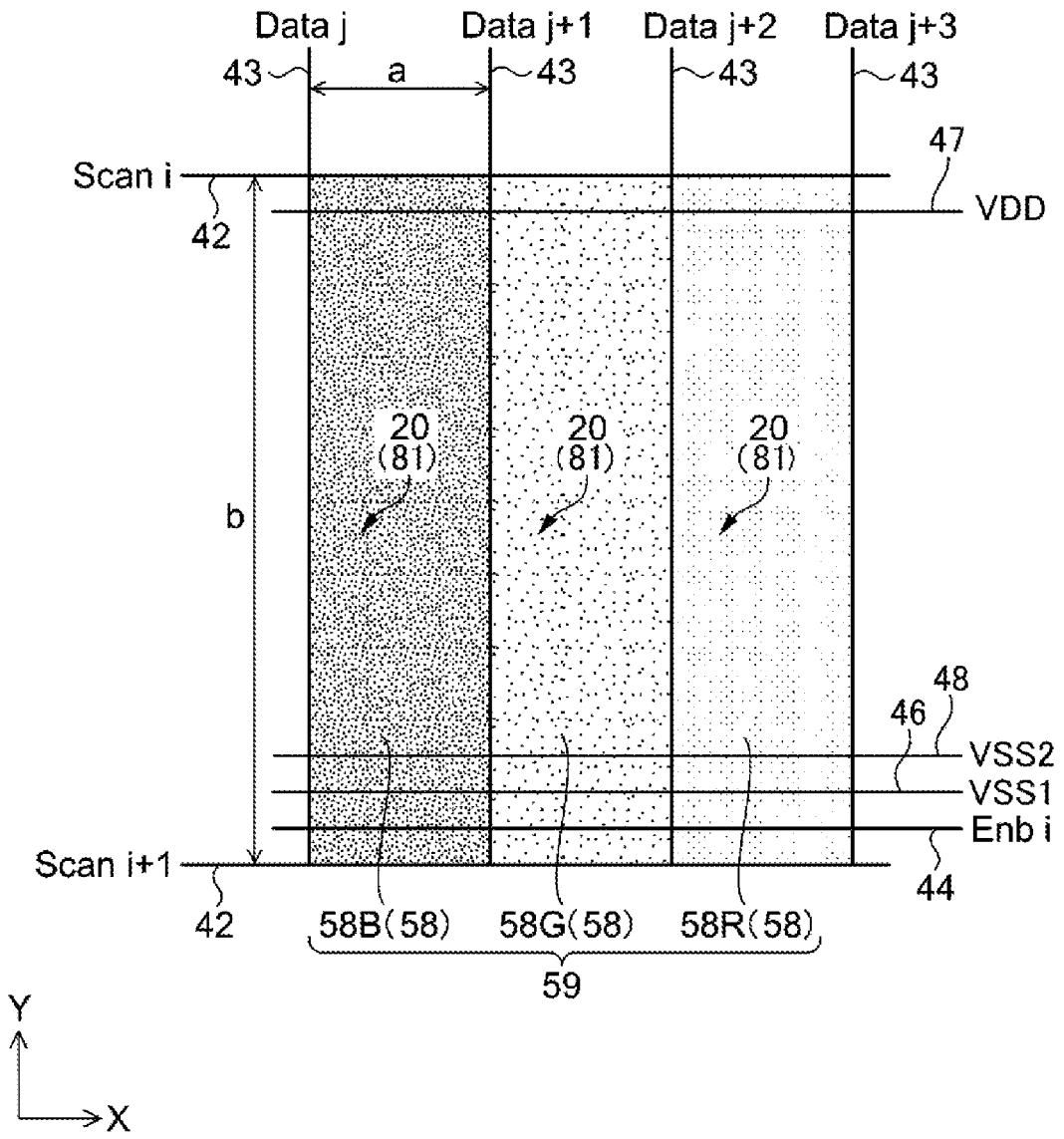
FIG. 20 illustrates a diagram for describing a configuration of a pixel according to the third exemplary embodiment of the invention.
Figure 21:
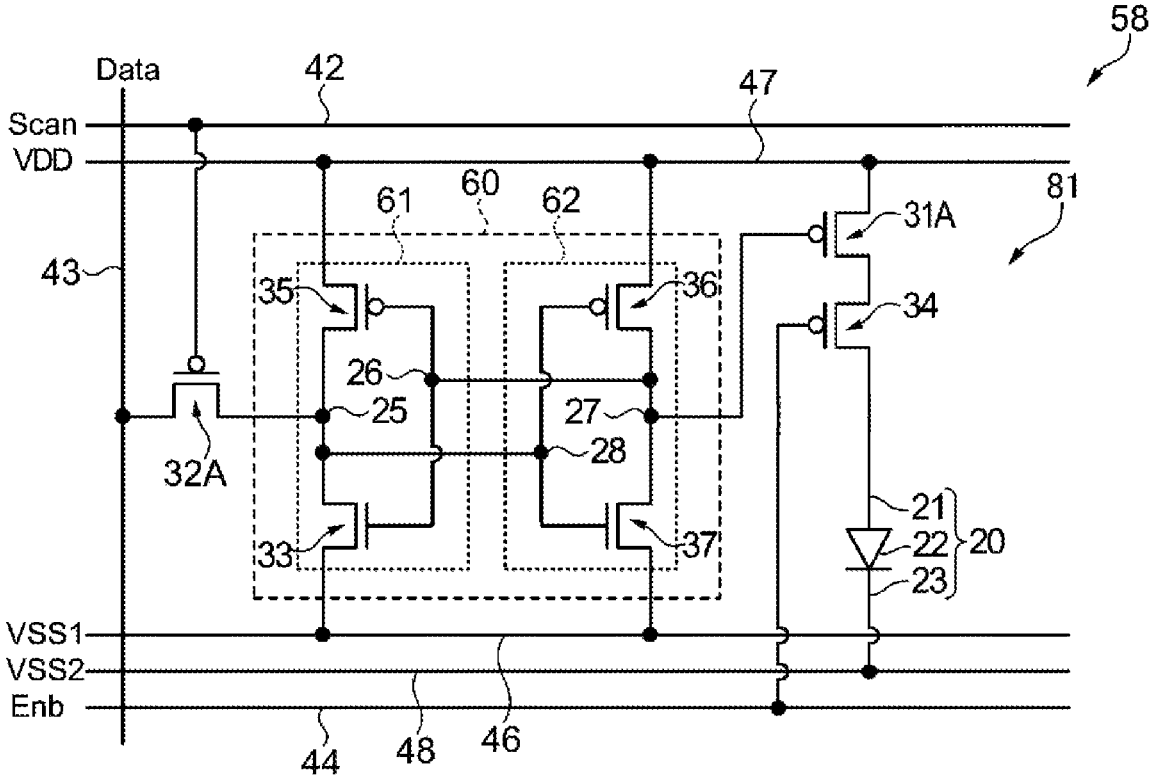
FIG. 21 illustrates a diagram for describing a configuration of a pixel circuit according to the third exemplary embodiment of the invention.

Next, a configuration of an electro-optical device according to a third exemplary embodiment will be described. FIG. 19 illustrates a block diagram of a circuit of an electro-optical device according to the third exemplary of the invention. FIG. 20 illustrates a diagram for describing a configuration of a pixel according to the third exemplary embodiment of the invention. FIG. 21 illustrates a diagram for describing a configuration of a pixel circuit according to the third exemplary embodiment of the invention.

As illustrated in FIG. 19, the data line drive circuit 53 supplies an image signal (Data) to each of the N data lines 43 in synchronization with the selection of the scan line 42. However, in the present exemplary embodiment, unlike the first exemplary embodiment and the second exemplary embodiment, the data line drive circuit 53 does not output a complementary image signal. Hence, as illustrated in FIG. 20, a pixel circuit 81 is provided with an image signal (Data) but is not provided with a complementary image signal. Therefore, as illustrated in FIG. 21, in the pixel circuit 81, energization to the light emitting element 20 is controlled by the first transistor 31A of the P-type having a gate, to which the image signal (Data) is provided via the first transistor 31A and the memory circuit 60, and by the fourth transistor 34 of the P-type having a gate, to which the control signal Enb is supplied.

The present exemplary embodiment has, on the basis of the second exemplary embodiment, a configuration in which the first low potential VSS1, the second low potential VSS2, and the high potential VDD are supplied to the drive unit 50 but it may have, on basis of the first exemplary embodiment, a configuration in which the first low potential VSS1, the second low potential VSS2, and the high potential VDD are supplied to the drive unit 50.

The above-described exemplary embodiments (examples and modification examples) merely illustrate one aspect of the invention, and any variation and application may be possible within the scope of the invention. For example, the followings are modified examples other than those described above.

Modification Example 7

While the gate of the first transistor 31 or the first transistor 31A is electrically connected to the output terminal 27 of the second inverter 62 in the memory circuit 60 in the pixel circuits of the above-described exemplary embodiments (examples and modification examples), the invention is not limited to such construction. The gate of the first transistor 31 or the first transistor 31A may be electrically connected to the output terminal 25 of the first inverter 61 in the memory circuit 60.

Modification Example 8

In the pixel circuits of the above-described exemplary embodiments (examples and modification examples), the second transistor 32 is disposed between the input terminal 28 of the second inverter 62 in the memory circuit 60 and the data line 43, and the second complementary transistor 38 is disposed between the input terminal 26 of the first inverter 61 in the memory circuit 60 and the complementary data line 45, but the invention is not limited to such an aspect. The second transistor 32 may be disposed between the input terminal 26 of the first inverter 61 and the data line 43, and the second complementary transistor 38 may be disposed between the input terminal 28 of the second inverter 62 and the complementary data line 45.

Modification Example 9

While the memory circuit 60 includes the two inverters 61 and 62 in the pixel circuits of the above-described exemplary embodiments (examples and modification examples), the invention is not limited to such construction. The memory circuit 60 may include an even number of two or more inverters.

Modification Example 10

While the electro-optical device has been described by taking, as an example, the organic EL device in which the light emitting elements 20 formed of organic EL elements are aligned in 720 rows×3840 (1280×3) columns on the element substrate 11 formed of a single crystal silicon substrate, which is a single crystal semiconductor substrate, in the above-described exemplary embodiments (examples and modification examples), the electro-optical device in the invention is not limited to such construction. For example, the electro-optical device may include a thin film transistor (TFT) as each transistor formed on the element substrate 11 formed of a glass substrate, or the electro-optical device may include a TFT on a flexible substrate formed of polyimide and the like. Further, the electro-optical device may be a micro LED display in which fine LED elements are aligned as light emitting elements in high density or a quantum dots display in which a nanosized semiconductor crystal material is used for the light emitting element. Furthermore, a quantum dot that converts incident light into light having a different wavelength may be used as a color filter.

Modification Example 11

While the electronic apparatus has been described in the above-described exemplary embodiments by taking, as an example, the see-through head-mounted display 100 incorporating the electro-optical device 10, the electro-optical device 10 of the invention is also applicable to other electronic apparatuses including a closed-type head-mounted display. Other types of electronic apparatus include, for example, projectors, rear-projection televisions, direct-viewing televisions, cell phones, portable audio devices, personal computers, video camera monitors, car navigation devices, head-up displays, pagers, electronic organizers, calculators, wearable devices such as wristwatches, handheld displays, word processors, workstations, video phones, POS terminals, digital still cameras, signage displays, and the like.

The entire disclosure of Japanese Patent Application No. 2017-222481, filed Nov. 20, 2017 and Application No. 2018-183517, filed Sep. 28, 2018 are expressly incorporated by reference herein.

What is claimed is:

1. An electro-optical device comprising:

a substrate including;

a scan line, a data line, a pixel circuit located at a position corresponding to an intersection of the scan line and the data line, a scan drive circuit supplying a scanning signal to the scan line, a first potential line supplying a first potential, a second potential line supplying a second potential, and a third potential line supplying a third potential, wherein the pixel circuit includes, a light emitting element, a memory circuit, a first transistor of which a gate is electrically connected to the memory circuit, and a second transistor of which a gate is electrically connected to the scan line, and the second transistor is disposed between the memory circuit and the data line, wherein the light emitting element and the first transistor are disposed in series between the second potential line and the third potential line, the scan drive circuit is connected to the first potential line and the second potential line, and A<B, wherein A is an absolute value of a potential difference between the first potential and the second potential, and B is an absolute value of a potential difference between the second potential and the third potential.

2. The electro-optical device according to claim 1, wherein the substrate is formed of a single crystal silicon substrate.

3. The electro-optical device according to claim 1, wherein the first transistor is P-type.

4. The electro-optical device according to claim 3, wherein the second transistor is P-type.

5. The electro-optical device according to claim 4, wherein the second potential is higher than the third potential.

6. The electro-optical device according to claim 5, further comprising:

an enable line, wherein the pixel circuit includes a fourth transistor of which a gate is electrically connected to the enable line, and the fourth transistor, the first transistor and the light emitting element are disposed in series between the second potential line and the third potential line.

7. The electro-optical device according to claim 6, wherein the fourth transistor is disposed between the second potential line and the first transistor.

8. The electro-optical device according to claim 7, wherein the fourth transistor is P-type.

9. The electro-optical device according to claim 1, further comprising:

an enable line, wherein the pixel circuit includes a fourth transistor of which a gate is electrically connected to the enable line, and the fourth transistor is disposed between the second potential line and the first transistor.

10. The electro-optical device according to claim 9, wherein the fourth transistor is P-type.

11. The electro-optical device according to claim 1, wherein the memory circuit is electrically connected to the first potential line and the second potential line.

12. The electro-optical device according to claim 1, wherein the first transistor and the second transistor are N-type.

13. The electro-optical device according to claim 12, wherein the second potential is lower than the third potential.

14. The electro-optical device according to claim 13, further comprising:

an enable line, wherein the pixel circuit includes a fourth transistor of which a gate is electrically connected to the enable line, and the fourth transistor is N-type and disposed between the second potential line and the first transistor.

15. An electronic apparatus comprising the electro-optical device according to claim 1.

16. An electro-optical device comprising:

a scan line;

a data line;

a pixel circuit located at a position corresponding to an intersection of the scan line and the data line;

a scan drive circuit supplying a scanning signal to the scan line, wherein the pixel circuit includes;

a light emitting element, a first transistor which controls a driving current for the light emitting element, the first transistor and the light emitting element are disposed in series between a second potential and a third potential, a second transistor of which a gate is electrically connected to the scan line, and one of a source and a drain of the second transistor is connected to the data line, the scan drive circuit connected to a first potential and the second potential, wherein the first potential is lower than the second potential and higher than the third potential, and A<B, wherein A is an absolute value of a potential difference between the first potential and the second potential, and B is an absolute value of a potential difference between the second potential and the third potential.

17. The electro-optical device according to claim 16, wherein the second transistor is P-type, the scan drive circuit supplies a selection signal of which potential is equal to or lower than the first potential and is equal to or higher than the third potential.

18. The electro-optical device according to claim 16, further comprising:

an enable line, wherein the pixel circuit includes a fourth transistor of which a gate is electrically connected to the enable line, and the fourth transistor is disposed between the second potential and the first transistor.

19. An electro-optical device disposed on a single crystal silicon substrate comprising:

a scan line;

a data line;

a pixel circuit located at a position corresponding to an intersection of the scan line and the data line;

a scan drive circuit supplying a scanning signal to the scan line, a first potential line supplying a first potential, a second potential line supplying a second potential, and a third potential line supplying a third potential, wherein the pixel circuit includes;

a light emitting element, a first transistor which controls a driving current for the light emitting element, the first transistor and the light emitting element are disposed in series between the second potential line and the third potential line, a second transistor of which a gate is electrically connected to the scan line, and one of a source and a drain of the second transistor is connected to the data line, the first potential line and the second potential line connect to the scan drive circuit to operates thereof, and A<B, wherein A is an absolute value of a potential difference between the first potential and the second potential, and B is an absolute value of a potential difference between the second potential and the third potential.

20. The electro-optical device according to claim 19, wherein the second transistor is P-type, the scan drive circuit supplies a selection signal of which potential is equal to or lower than the first potential and is equal to or higher than the third potential.

* * * * *